US007952534B2

(12) United States Patent
Iwata et al.

(10) Patent No.: US 7,952,534 B2
(45) Date of Patent: May 31, 2011

(54) MICROSTRIP ANTENNA

(75) Inventors: Kengo Iwata, Fukuoka (JP); Hiroshi Tsuboi, Fukuoka (JP); Kensuke Murata, Fukuoka (JP); Toshio Koguro, Fukuoka (JP); Youichi Murase, Fukuoka (JP)

(73) Assignee: Toto Ltd., Fukuoka (JP)

( * ) Notice: Subject to any disclaimer, the term of this patent is extended or adjusted under 35 U.S.C. 154(b) by 866 days.

(21) Appl. No.: 10/593,392

(22) PCT Filed: Mar. 23, 2005

(86) PCT No.: PCT/JP2005/005245

§ 371 (c)(1),
(2), (4) Date: Jul. 3, 2007

(87) PCT Pub. No.: WO2005/099039

PCT Pub. Date: Oct. 20, 2005

(65) Prior Publication Data

US 2008/0036662 A1 Feb. 14, 2008

(30) Foreign Application Priority Data

| | | |
|---|---|---|
| Mar. 31, 2004 | (JP) | 2004-107598 |
| Mar. 31, 2004 | (JP) | 2004-107802 |
| Mar. 31, 2004 | (JP) | 2004-107841 |
| Jul. 21, 2004 | (JP) | 2004-212437 |
| Jul. 21, 2004 | (JP) | 2004-212444 |
| Jul. 21, 2004 | (JP) | 2004-212449 |

(51) Int. Cl.
*H01Q 21/00* (2006.01)
*H01Q 1/38* (2006.01)

(52) U.S. Cl. ..... 343/893; 343/853; 343/700 MS

(58) Field of Classification Search ..... None
See application file for complete search history.

(56) References Cited

U.S. PATENT DOCUMENTS

| | | | | |
|---|---|---|---|---|
| 4,367,474 A | | 1/1983 | Schaubert | |
| 4,937,585 A | * | 6/1990 | Shoemaker | 343/700 MS |
| 5,021,795 A | | 6/1991 | Masiulis | |

(Continued)

FOREIGN PATENT DOCUMENTS

CN 2558089 Y 6/2003

(Continued)

OTHER PUBLICATIONS

New Antenna Engineering. pp. 108-113, Hironobu Arai, 1996, Sogo, Denshi Syuppan-Sya (without English translation).

(Continued)

*Primary Examiner* — Trinh V Dinh
(74) *Attorney, Agent, or Firm* — Posz Law Group, PLC

(57) ABSTRACT

A plurality of antenna electrodes 11, 12, 13, 14 on a substrate 1 can be connected to a ground electrode on the substrate 1 via connectors at spots 11A-11C, 12A-12C, 13A-13C, and 14A-14C. Each connector can be opened/closed by a switch; or provided with a impedance varying device. Any one of the antenna electrodes may be connected to the ground electrode by the switch or the impedance varying device. The radio wave beam outputted from this antenna electrode shifts in phase from the radio wave beams outputted from the other antenna electrodes, whereby the direction of the integrated radio wave beam is inclined. Connecting one or another of the spots 11A-11C, 12A-12C, 13A-13C, and 14A-14C to the ground electrode changes the direction and the magnitude of the integrated radio wave beam.

14 Claims, 45 Drawing Sheets

U.S. PATENT DOCUMENTS

| | | | | |
|---|---|---|---|---|
| 6,195,047 | B1 * | 2/2001 | Richards | 343/700 MS |
| 7,368,844 | B2 * | 5/2008 | Hashiba et al. | 310/216.048 |
| 7,683,844 | B2 * | 3/2010 | Alamouti et al. | 343/754 |
| 2003/0164797 | A1 * | 9/2003 | Ngai et al. | 343/700 MS |
| 2008/0088510 | A1 * | 4/2008 | Murata et al. | 343/700 MS |
| 2008/0308920 | A1 * | 12/2008 | Wan | 257/685 |

FOREIGN PATENT DOCUMENTS

| | | |
|---|---|---|
| JP | 60-1014 | 1/1985 |
| JP | 61-071701 | 12/1986 |
| JP | 1-279607 | 11/1989 |
| JP | 1-316005 | 12/1989 |
| JP | 02-126702 | 5/1990 |
| JP | 03-010407 | 1/1991 |
| JP | 3-166802 | 7/1991 |
| JP | A-4-32301 | 2/1992 |
| JP | 4-199904 | 7/1992 |
| JP | 5-22023 | 1/1993 |
| JP | 5-175719 | 7/1993 |
| JP | A-5-235606 | 9/1993 |
| JP | 6-29723 | 2/1994 |
| JP | A-6-77702 | 3/1994 |
| JP | A-7-128435 | 5/1995 |
| JP | 8-186431 | 7/1996 |
| JP | 8-288738 | 11/1996 |
| JP | A-9-214238 | 8/1997 |
| JP | 9-232857 | 9/1997 |
| JP | 9-238022 | 9/1997 |
| JP | A-9-232857 | 9/1997 |
| JP | 9-298418 | 11/1997 |
| JP | A-9-307343 | 11/1997 |
| JP | 10-028013 | 1/1998 |
| JP | 10-070411 | 3/1998 |
| JP | 10-154909 | 6/1998 |
| JP | A-10-190347 | 7/1998 |
| JP | 10-209739 | 8/1998 |
| JP | 10-224142 | 8/1998 |
| JP | A-10-247801 | 9/1998 |
| JP | 10-276034 | 10/1998 |
| JP | 10-335927 | 12/1998 |
| JP | 11-145722 | 5/1999 |
| JP | 11-150415 | 6/1999 |
| JP | 2000-269732 | 9/2000 |
| JP | A-2001-189612 | 7/2001 |
| JP | 2002-009538 | 1/2002 |
| JP | 2002-217638 | 8/2002 |
| JP | A-2002-299947 | 10/2002 |
| JP | 2003-124730 | 4/2003 |
| JP | 2003-124742 | 4/2003 |
| JP | 2003-142936 | 5/2003 |
| JP | A-2003-198217 | 7/2003 |
| JP | 2003-529259 | 9/2003 |
| JP | A-2003-258502 | 9/2003 |
| JP | A-2003-258548 | 9/2003 |
| JP | A-2003-347842 | 12/2003 |
| JP | 2004-023546 | 2/2004 |
| WO | WO 01/18909 | 3/2001 |

OTHER PUBLICATIONS

Illustrated Antenna System for Mobile Communications, pp. 120-129, Kyohei Fujimoto, 1996, Sogo Denshi Syuppan-Sya (without English translation).

Fujimoto, Kyohei. "Illustrated Antenna System for Mobile Communications," Sogo Senshi Syuppan-Sya (1996): pp. 40-45 and original document and English translation therof.

Fujimoto, Kyohei. "Illustrated Antenna System for Mobile Communications." Sogo Senshi Syuppan-Sya (1996): pp. 120-129 and original document and English translation therof.

Arai, Hironobu. "New Antenna Engineering" Sogo Senshi Syuppan-Sya (1996): pp. 108-113, with English translation.

Notification of the First Office Action issued from the Chinese Patent Office on Mar. 12, 2010 for the corresponding Chinese patent application No. 200580010231.X (with English translation).

* cited by examiner

| | |
|---|---|
| DIRECTIVITY | 8.17 dB |
| GAIN | 0.36 dB |
| ANGLE OF INCLINATION | 45 ° |

| | |
|---|---|
| DIRECTIVITY | 8.45 dB |
| GAIN | 0.64 dB |
| ANGLE OF INCLINATION | 45 ° |

| | |
|---|---|
| DIRECTIVITY | 8.24 dB |
| GAIN | 0.85 dB |
| ANGLE OF INCLINATION | 42 ° |

| | |
|---|---|
| DIRECTIVITY | 7.88 dB |
| GAIN | 1.00 dB |
| ANGLE OF INCLINATION | 39 ° |

| | |
|---|---|
| DIRECTIVITY | 7.58 dB |
| GAIN | 1.21 dB |
| ANGLE OF INCLINATION | 36 ° |

| | |
|---|---|
| DIRECTIVITY | 7.45 dB |
| GAIN | 0.85 dB |
| ANGLE OF INCLINATION | 33° |

MICROSTRIP ANTENNA

RELATED APPLICATIONS

This application is a 371 of PCT/JP05/05245 filed Mar. 23, 2005, which claims priority under 35 U.S.C. 119 to an application JP 2004-107598 filed on Mar. 31, 2004, JP 2004-107802 filed on Mar. 31, 2004, JP 2004-107841 filed on Mar. 31, 2004, JP 2004-212437 filed on Jul. 21, 2004, JP 2004-212444 filed on Jul. 21, 2004, and JP 2004-212449 filed on Jul. 21, 2004, the contents of which are incorporated herein by reference.

TECHNICAL FIELD

The present invention relates to a microstrip antenna which transmits microwaves or radio waves of a yet higher frequency, and in particular relates to a technique for controlling the direction of an integrated radio wave beam which is generated from a microstrip antenna. The present invention also relates to a high frequency sensor which employs a microstrip antenna.

BACKGROUND OF THE INVENTION

From the prior art, there has been known a microstrip antenna in which an antenna electrode and a ground electrode are respectively provided upon the surface and upon the rear surface of a substrate; and a radio wave in a vertical direction from the antenna electrode is generated by a high frequency microwave signal being applied between the antenna electrode and the ground electrode. The following techniques are known for controlling the direction of the integrated radio wave beam which is generated from the microstrip antenna. For example, with the technique described in Japanese Laid-Open Patent Publication Heisei 7-128435, a plurality of antenna electrodes are disposed upon the surface of the substrate, and the direction of the integrated radio wave beam is changed by changing the length of the feed line of the high frequency signal to each of these antenna electrodes, by switching over a high frequency switch. In other words, by the length of the feed lines to the plurality of antenna electrodes being different from one another, a phase difference is created between the radio waves which are emitted from each of the plurality of antenna electrodes, so that the integrated direction of the integrated radio wave beam is inclined towards that one of the antennas whose phase has been delayed. Furthermore, with the technique described in Japanese Laid-Open Patent Publication Heisei 9-214238, a plurality of antenna electrodes are arranged so that the directivities of their integrated radio wave beams are different, and the direction of the integrated radio wave beam is changed, by changing over the antenna electrode to which the high frequency signal is applied with a high frequency switch.

A body detection device which uses a radio wave generated from a microstrip antenna is known. With this body detection device, by changing the direction of the integrated radio wave beam from the microstrip antenna by doing as described above, it becomes possible to detect the position and the state of the body more accurately, as compared with the case in which the direction of the integrated radio wave beam is fixed. For example, it is possible to ascertain whether a body is present or not over a two dimensional range, and the state thereof, by scanning the two dimensional range while changing the direction angles in the X and the Y directions of the integrated radio wave beam which is transmitted from the microstrip antenna. The use of such a body detection device spans many fields, such as target detection for an automatically tracking missile, user detection for a toilet device, and the like. Whatever the use may be, it is extremely useful to be able to change the direction of the integrated radio wave beam which is transmitted from the micro antenna. For example, to describe this in terms of a user detection device for a toilet device, if the position and the state of the user can be detected more accurately, it is possible to control a washing device or a deodorization device or the like of the toilet more appropriately. By the way, it might be more suitable to apply a camera, if only the objective of accurately ascertaining the state of the user is considered, but naturally a camera cannot be employed for a toilet device. Furthermore, with a body detection device which utilizes radio waves, it is extremely important to control the direction of the integrated radio wave beam, in order to make it possible to ascertain the situation of the user more accurately. In this connection, in Japan, the frequencies of 10.525 GHz and 24.15 GHz may be used with the objective of detecting a human body, and moreover the frequency of 76 GHz may be used with the objective of on-vehicle collision prevention.

SUMMARY OF THE INVENTION

According to the prior art techniques disclosed in Japanese Laid-Open Patent Publication Heisei 7-128435 and Japanese Laid-Open Patent Publication Heisei 9-214238, it is necessary to switch the feed line over which the microwave signal is transmitted in order to change the direction of the integrated radio wave beam. For this, it is necessary to use a high frequency switch whose impedance with respect to the microwave signal of the specific frequency which is used is precisely adjusted to a predetermined suitable value, and such a high frequency switch is quite high in price. In particular, if the direction of the integrated radio wave beam is to be changed continuously or in a large number of steps, a large number of high frequency switches are required. However, it is not realistic to use a large number of high cost components for an application such as, for example, a user detection device for a toilet device.

Accordingly, the objective of the present invention is, with a microstrip antenna, to make it possible to incline the direction of the transmitted integrated radio wave beam with a simple structure.

Another objective of the present invention is, with a microstrip antenna, to make the direction of the transmitted integrated radio wave beam be variable with a simple structure.

The present invention is based upon novel information which the inventors have acquired through research. This novel information consists of the knowledge that, when an antenna electrode of a microstrip antenna is connected, at some spot within its area which is different from its feed point, to a ground electrode, then the phase of the microwave radio wave which is generated from this antenna electrode is deviated, as compared to when it is not thus connected to the ground electrode. And it also consists of the knowledge that, when the position of the spot upon the area of the antenna electrode where it is connected to the ground electrode changes, the amount of phase deviation of the phase also changes. The present invention applies the above described information to a microstrip antenna which is made so that it outputs a plurality of radio wave beams, and causes the phase of one of these partial beams among the plurality of radio wave beams to be deviated from that of the other beams. By doing this, the direction of the integrated radio wave beam which is made up by combining this plurality of radio wave beams comes to be inclined. If the amount of deviation of the phase is altered, then the direction comes to be altered, since it represents the inclination of the integrated radio wave beam.

If, for example, the microstrip antenna comprises a plurality of antenna electrodes, then a plurality of radio wave beams are outputted from that plurality of antenna electrodes. In this case, one partial antenna electrode among the plurality of antenna electrodes is connected to the ground electrode, at some spot within that electrode. When this is done, since the phase of the radio wave which is radiated from that antenna electrode is deviated from that of the radio waves which are radiated from the other antenna electrodes, accordingly the direction of the integrated radio wave beam which is their combination is inclined. Or, if one of the antenna electrodes is operated in a secondary resonant mode, two split radio wave beams are radiated from that one antenna electrode. In this case, if some spot which has been chosen from the area of this one antenna electrode is connected to the ground electrode, then the phase of one of the beams among the two radio wave beams which have been split is deviated from that of the other beam. Accordingly, the direction of the integrated radio wave beam which is made by combining them is inclined.

In order to ensure that it exerts no bad influence upon the characteristics of the antenna electrode, the connection member for connecting the antenna electrode to the ground electrode may be disposed at a location which, when the antenna electrode is seen in plan view, is within the area of the antenna electrode. A switch is provided for opening and closing the connection due to this connection member between the antenna electrode and the ground electrode, and, by turning this switch ON and OFF, the direction of the integrated radio wave beam may be changed over between a direction which is at right angles to the antenna electrode, and a direction which is inclined with respect thereto. If respective connection members and switches are provided at a plurality of spots upon the antenna electrode for which the amount of deviation of the phase is different, so that it is arranged to change the spot which is connected to the ground electrode, then the direction of the integrated radio wave beam may be changed in a plurality of steps. Since it will suffice for the switches described above to have an impedance characteristic which can satisfactorily pass a microwave signal of the specified frequency to some extent, and it is not necessary for them to have a precisely correct value of impedance as in the case of prior art technology, accordingly it is not necessary to use high frequency switches of high cost.

Instead of performing so called ON/OFF control in which the antenna electrode and the ground electrode are either connected together or separated from one another, it would also be possible to employ a method in which the degree of electrical coupling between the antenna electrode and the ground electrode, in other words the impedance with respect to the high frequency signal, is changed continuously or stepwise. The direction of the radio wave beam is changed in accordance with this change of impedance.

Based upon the theory described above, the microstrip antenna according to one aspect of the present invention includes: an insulating substrate; a plurality of antenna electrodes disposed upon one surface of said substrate, each having a feed point for application of a high frequency signal; a ground electrode disposed upon the other side of, or in the interior of, said substrate, for supplying ground level; and a connection member for connecting at least one antenna electrode among said plurality of antenna electrodes to said ground electrode, at least at one spot thereof which is different from said feed point thereof; and said connection member is disposed at a location within a plane region occupied by said at least one antenna electrode when said at least one antenna electrode is seen in plan view, such that the direction of the integrated radio wave beam which is emitted from said plurality of antenna electrodes is inclined from the direction normal to said substrate by connecting said at least one antenna electrode to said ground electrode at said location. Since, according to this microstrip antenna, a phase deviation exists between the radio wave beam which is outputted from that antenna electrode, among the plurality of antenna electrodes, which is connected to the ground electrode by the connection member, and the radio wave beams which are outputted from the other antenna electrodes, accordingly the direction of the integrated radio wave beam which is made by combining the plurality of radio wave beams which are outputted from the plurality of antenna electrodes is inclined.

In an appropriate embodiment, said at least one spot of said at least one antenna electrode which is connected to said ground electrode is located at a position differing from a position which is separated from said feed point of said at least one antenna electrode in a direction to its terminal edge by just a distance which is an odd number of times the quarter wavelength of said high frequency signal. By connecting this type of spot to the ground electrode, the above described operation of inclining the direction can be performed effectively.

In an appropriate embodiment, said connection member is an electrically conductive through hole which is pierced through at a spot of said substrate which corresponds to said at least one spot of said at least one antenna electrode, and has one end which is connected to said at least one spot of said at least one antenna electrode, and another end which is connected to said ground electrode. The diameter of this through hole may be, for example, less than or equal to 0.1 mm. Furthermore, according to another appropriate embodiment, at least one edge of said at least one antenna electrode is disposed along at least one edge of said substrate, and said connection member is an electric conductor which is arranged upon a side surface of said at least one edge of said substrate, and has one end which is connected to said at least one spot of said at least one edge of said at least one antenna electrode, and another end which is connected to said ground electrode. In either case, it is possible for the structure of the connection member to be very simple.

In an appropriate embodiment, said at least one spot of said at least one antenna electrode which is connected to said ground electrode is in the vicinity of a terminal edge of said at least one antenna electrode, and is located at a position approximately in the middle thereof in a direction which is orthogonal to the direction from said feed point to its terminal edge.

In an appropriate embodiment, there is further included a switch which opens and closes the connection between said at least one antenna electrode and said ground electrode via said connection member. By turning this switch ON and OFF, it is possible to change the direction of the integrated radio wave beam.

In an appropriate embodiment, said switch is disposed at a connection spot between said connection member and said ground electrode. Since a switch which is disposed in this manner is hidden at the rear of the antenna electrodes, accordingly it exerts no bad influence upon the characteristics of the antenna electrodes.

As the above described switch, it may comprise two electrical contact points which are respectively connected to said connection member and to said ground electrode, and these two electrical contact points may be arranged to be separated by a first gap between them in the ON state, and to be separated by a second gap which is larger than said first gap in the OFF state. Or, as the above described switch, it may comprise an insulating film which is provided between said two electrical contact points which are respectively connected to said connection member and to said ground electrode. In either case, it is possible to use a MEMS switch as a switch which has this type of construction.

Furthermore, a feed line for supplying high frequency electrical power to said plurality of antenna electrodes may be provided upon the same surface of the substrate as the antenna electrodes, or may be provided upon the opposite side thereof. Moreover, if the feed line is provided on the opposite side surface, the connection between the feed line and the antenna electrodes may be performed via through holes which are pierced through said substrate.

In an appropriate embodiment, the above described feed line has a root feed point which is connected to an oscillator circuit and located at the center of the substrate, and feed line branches off in both mutually opposite directions from said root feed point, and the direction of branching off of said feed line from said root feed point, and the direction of excitation of each of the antenna electrodes, do not agree with one another in one direction. Said connection members and said switches are provided for each of said plurality of antenna electrodes. According to this microstrip antenna, by actuating the switches of one or more of the electrodes which are positioned most towards the left side, for example, it is possible to incline the direction of the integrated radio wave beam, as seen in plan view, towards the right side, for example (or, conversely, when the switches of one or more of the electrodes which are positioned most towards the right side are actuated, the radio wave beam is inclined towards the left side); while, on the other hand, by actuating the switches of one or more of the electrodes which are positioned most towards the upper side, for example, it is possible to incline the direction of the integrated radio wave beam, as seen in plan view, towards the lower side, for example (or, conversely, when the switches of one or more of the electrodes which are positioned most towards the lower side are actuated, the radio wave beam is inclined towards the upper side). Furthermore, by changing the number of the switches which are turned ON at the same time on the same side, it is possible to change the magnitude of the angle of inclination of the direction which is inclined to the same side.

In an appropriate embodiment, said plurality of antenna electrodes upon the one surface of said substrate are covered by a dielectric body which has a relative permittivity which is larger than the relative permittivity of said substrate. To compare the wavelength of the high frequency signal at the surfaces of the antenna electrodes which are covered by the dielectric body, with the case in which the surfaces of the electrodes are directly in contact with the air, it becomes smaller; and, to that extent, it is possible to make the size of the antenna electrodes, and the gaps between them, smaller. In other words, it is possible to increase the number and the density of the antenna electrodes which can be arranged upon a substrate of the same size. As a result, it is possible to make finer the resolution of the inclination, with which it is possible to adjust the direction of the radio wave beam.

In an appropriate embodiment, said at least one antenna electrode is divided into a plurality of stripe electrodes which extend in a direction from said feed point to a terminal edge. Due to this, the gain and the directivity of the radio wave beam are enhanced.

A dielectric body may also be disposed so as to contact the end portions of said antenna electrodes. A cavity structure may also be formed in the vicinity of said antenna electrodes. And a non-feed electrode may be disposed in the vicinity of said antenna electrodes.

The microstrip antenna according to another aspect of the present invention comprises: an insulating substrate; at least one antenna electrode disposed upon one surface of said substrate, having a feed point for application of a high frequency signal; a ground electrode disposed upon the other side of, or in the interior of, said substrate, for supplying ground level; and a connection member for connecting said antenna electrode to said ground electrode, at least at one spot thereof which is different from said feed point thereof; and said connection member is disposed at a location within a plane region occupied by said antenna electrode when said antenna electrode is seen in plan view, such that the direction of the integrated radio wave beam which is emitted from said antenna electrode is inclined from the direction normal to said substrate by connecting said antenna electrode to said ground erectrode at said location. In an appropriate embodiment, said antenna electrode has a two dimensional configuration, so as to operate in a secondary resonant mode upon receipt of said high frequency signal. Since, according to this microstrip antenna, two split radio waves are outputted from the single antenna electrode, and the phase of one of the beams is deviated from that of the other beam, accordingly the direction of the combined radio wave beam is inclined.

The microstrip antenna according to another aspect of the present invention comprises: an insulating substrate; a plurality of antenna electrodes disposed upon one surface of said substrate, each having a respective feed point for application of a high frequency signal; a ground electrode disposed upon the other side of, or in the interior of, said substrate, for supplying ground level; and a plurality of connection members for connecting at least one antenna electrode among said plurality of antenna electrodes respectively to said ground electrode, at a plurality of spots thereof which are different from said feed points thereof. According to this microstrip antenna, since the phases between the radio wave beam which is outputted from that antenna electrode, among the plurality of antenna electrodes, which is connected to the ground electrode by the connection member, and the radio wave beam which is outputted from the other antenna electrodes, are out of phase with respect to one another, accordingly, the direction of the integrated radio wave beam which is combined the plurality of radio wave beams which are outputted from the plurality of antenna electrodes is inclined. Due to the switches, it is possible to select which among the plurality of connection members are to be made effective, and which are to be made ineffective. It is possible to change the direction of inclination and the angle of the direction of the integrated radio wave beam according to this selection.

The microstrip antenna according to another aspect of the present invention comprises: an insulating substrate; at least one antenna electrode disposed upon one surface of said substrate, and having a feed point for application of a high frequency signal; a ground electrode disposed upon the other side of, or in the interior of, said substrate, for supplying ground level; a plurality of connection members for connecting said antenna electrode to said ground electrode, at a plurality of spots there of which are different from said feed point thereof; and a plurality of switches which respectively open and close the connections between said antenna electrode and said ground electrode via said plurality of connection members. In an appropriate embodiment, said antenna electrode has a two dimensional configuration, so as to operate in a secondary resonant mode upon receipt of said high frequency signal. According to this microstrip antenna, two split radio wave beams are outputted from a single antenna electrode. And since, when one or more of the above described plurality of spots of the antenna electrode is connected to the ground electrode, the phases between these two radio wave beams are shifted from one another, accordingly the direction of the combined radio wave beam is inclined. By selecting, with the above described plurality of switches, which of the above described plurality of spots are to be connected to the ground electrode, it is possible to change the direction and the angle of inclination of the direction of the combined radio wave beam.

The microstrip antenna according to yet another aspect of the present invention comprises: an insulating substrate; a plurality of antenna electrodes disposed upon one surface of said substrate, each having a feed point for application of a high frequency signal; a ground electrode disposed upon the other side of, or in the interior of, said substrate, for supplying ground level; a connection member for electrically coupling at least one antenna electrode among said plurality of antenna electrodes to said ground electrode, at least at one spot thereof which is different from said feed point thereof; and an impedance variable device which varies the impedance of the electrical coupling between said at least one antenna electrode and said ground electrode via said connection member for said high frequency signal. Since, according to this microstrip antenna, the phases between the radio wave beam which is outputted from that antenna electrode, among the plurality of antenna electrodes, which is electrically coupled to the ground electrode by the connection member, and the radio wave beams which are outputted from the other antenna electrodes, are shifted from one another, accordingly the direction of the integrated radio wave beam which is made by combining the plurality of radio wave beams which are outputted from the plurality of antenna electrodes is inclined. By varying the impedance with which this electrical coupling is endowed with respect to said high frequency signal, it is possible to vary the direction and the angle of the inclination of the direction of the integrated radio wave beam.

In an appropriate embodiment, said impedance variable device is provided at a spot where said connection member and said ground electrode are electrically coupled together.

In an appropriate embodiment, said impedance variable device varies said impedance by varying the effective length or cross sectional area of an electric line between said at least one antenna electrode and said ground electrode via said connection member. In another appropriate embodiment, said impedance variable device varies the impedance of said circuit by varying the capacitance between said at least one antenna electrode and said ground electrode via said connection member.

In an appropriate embodiment, a plurality of electrically conductive through holes which are pierced through said substrate are provided to said at least one antenna electrode as said connection member, and a plurality of said switches are provided to said plurality of through holes. The diameter of the through holes is less than or equal to 0.1 mm. And said impedance change device selects and turns ON any one of different combinations of the switches from among said plurality of switches. By changing the combination of the switches which are turned ON, the direction of the radio wave beam may be changed.

It is possible to employ, as the above described impedance variable device, a device which comprises two electrical contact points which are respectively connected to said connection member and to said ground electrode, and in which said two electrical contact points are arranged to be separated by a first gap in a first state, and to be separated by a second gap which is larger than said first gap in a second state. Or, it is possible to employ, as the above described impedance variable device, a device which comprises two electrical contact points which are respectively connected to said connection member and to said ground electrode, with the mutual distance being variable, and an insulating film which is provided between said two electrical contact points. Whichever of these is done, it is possible to use a MEMS switch as the impedance change device of this type of structure.

The microstrip antenna according to still another aspect of the present invention comprises: an insulating substrate; at least one antenna electrode disposed upon one surface of said substrate, having a feed point for application of a high frequency signal; a ground electrode disposed upon the other side of, or in the interior of, said substrate, for supplying ground level; a connection member for electrically coupling said antenna electrode to said ground electrode, at least at one spot thereof which is different from said feed point thereof; and an impedance variable device which varies the impedance of the electrical coupling between said at least one antenna electrode and said ground electrode via said connection member for said high frequency signal. In an appropriate embodiment, said antenna electrode has a two dimensional configuration, so as to operate in a secondary resonant mode upon receipt of said high frequency signal.

Since, according to this microstrip antenna, two split radio waves are outputted from the single antenna electrode, and, due to the above described electrical coupling, the phase of one of the beams is shifted from that of the other beam, accordingly the direction of the combined radio wave beam is inclined. By varying the impedance of this electrical coupling for said high frequency signal, it is possible to vary the direction and the angle of inclination of the direction of the integrated radio wave beam.

The present invention also provides a high frequency sensor, comprising: a transmission antenna which utilizes a microstrip antenna according to the present invention; a reception antenna, integral with said transmission antenna or consisting of a unit separate from said transmission antenna, for receiving from a body a reflected wave or a transmitted wave of the radio wave which has been outputted from said transmission antenna; and a processing circuit which receives and processes the electric signal from said reception antenna.

BRIEF DESCRIPTION OF THE DRAWINGS

FIG. 47 is a figure, for the microstrip antenna of FIG. 45, showing examples of the relationships between the selection of the through holes which are ON, and the angle of inclination of the radio wave beam and so on;

in FIG. 74.

in FIG. 75.

DESCRIPTION OF THE PREFERRED EMBODIMENTS

Figure 1:
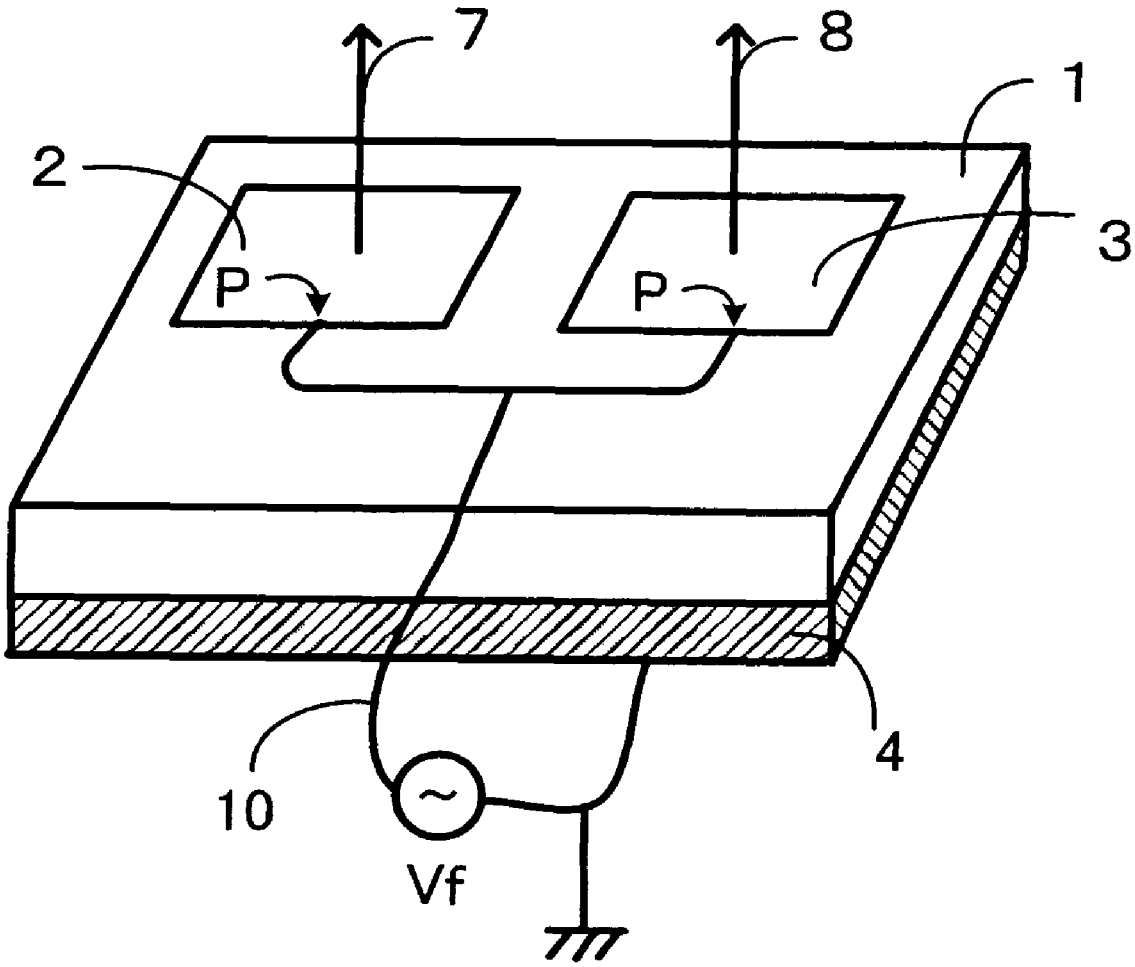
FIG. 1 is a perspective view of a general microstrip antenna which comprises a plurality of antenna electrodes.

In the following, embodiments of the microstrip antenna according to the present invention will be explained with reference to the drawings. FIG. 1 is a perspective view of a conventional microstrip antenna which is provided with a plurality of antenna electrodes.

In FIG. 1, an A antenna electrode 2 and a B antenna electrode 3, both of the same size and the same rectangular shape, are disposed upon the surface of an insulating substrate 1 so as to be in a laterally symmetric shape and positional relationship; and a ground electrode 4 is provided over almost the entire surface of the rear surface of the substrate 1. And, via feed lines 10, high frequency voltage Vf at, for example, 10.525 GHz is applied to feed points P, P which are provided at central points on edges of each of the A antenna electrode 2 and the B antenna electrode 3 on the same side thereof. The ground electrode 4 is connected to ground, so as to be supplied with ground level. The lengths of the feed lines 10 to the A antenna electrode 2 and to the B antenna electrode 3 are the same. It should be understood that the feed points P, P may sometimes be arranged at positions which are not upon the edges of the antenna electrodes 2, 3, but are brought a certain distance inwards from the edges of the antenna electrodes 2, 3. With this type of structure, radio wave beams 7, 8 of the same electric field intensity are transmitted from each of the A antenna electrode 2 and the B antenna electrode 3, in a vertical direction with respect to the substrate 1.

However, according to the results of experiments by the present inventors, it has been confirmed that, if some one antenna electrode among the plurality of antenna electrodes is connected to the ground electrode at some spot, since a phase deviation is created between the phase of the high frequency signal which propagates from the antenna electrode which has been connected to the ground electrode, and the phase of the high frequency signal which propagates from the antenna electrode which is not connected to the ground electrode, accordingly the direction of the integrated radio wave beam which is transmitted from the plurality of antenna electrodes becomes inclined. It should be understood that this phase deviation of the antenna electrode which is connected to the ground electrode with respect to the antenna electrode which is not connected to the ground electrode can be advanced or delayed, according to the connection position of the ground electrode on the antenna electrode and the shape of the antenna electrodes and so on. And the amount of this phase deviation also varies according to the connection position of the ground electrode on the antenna electrode, according to the shape of the antenna electrode, and so on.

For example it has been understood that, if the antenna electrodes are of some shape, since the phase of the high frequency signal which propagates from the antenna electrode which has been connected to the ground electrode is advanced with respect to the phase of the high frequency signal which propagates from the antenna electrode which is not connected to the ground electrode, accordingly the integrated radio wave formed by the combination of the radio wave beams which are outputted from the plurality of antenna electrodes inclines toward the side of that antenna electrode which is not connected to the ground electrode (i.e., to the side of that antenna electrode whose phase is delayed). In the following, this embodiment of the present invention will be explained, by way of example, in terms of a case in which the phase of the high frequency signal which propagates from the antenna electrode which has been connected to the ground electrode is advanced with respect to the phase of the high frequency signal which is not thus connected.

Figure 2:
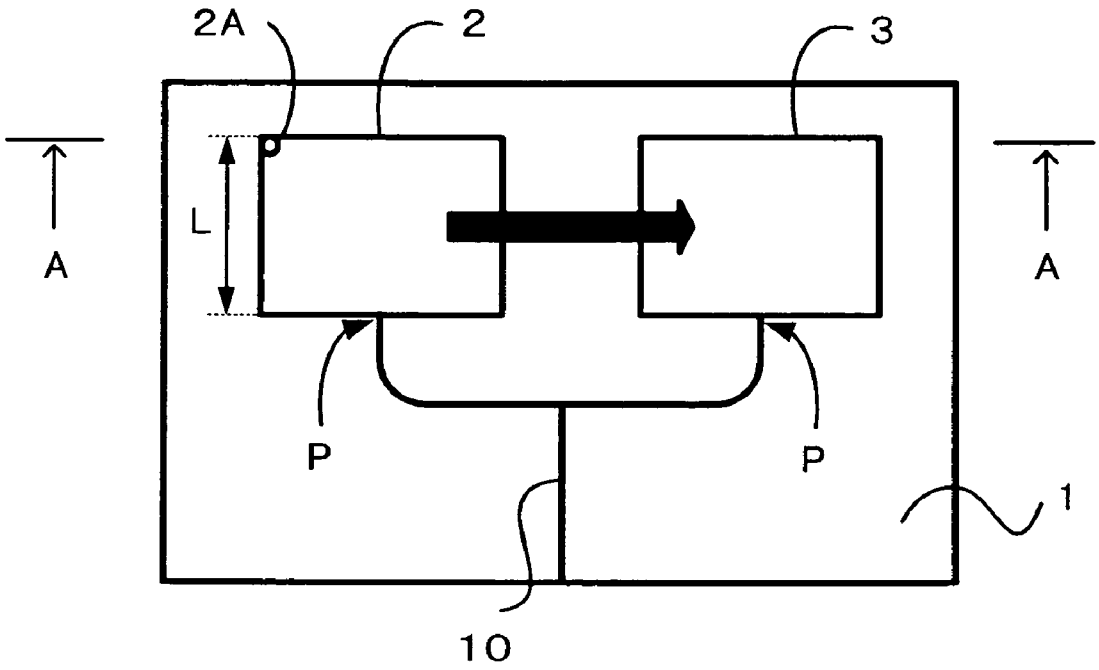
FIG. 2 is a plan view showing an embodiment of the microstrip antenna of the present invention.

FIG. 2 is a plan view showing an embodiment of the microstrip antenna of the present invention. And FIG. 3 is a sectional view of FIG. 2 in the plane A-A.

Figure 3:
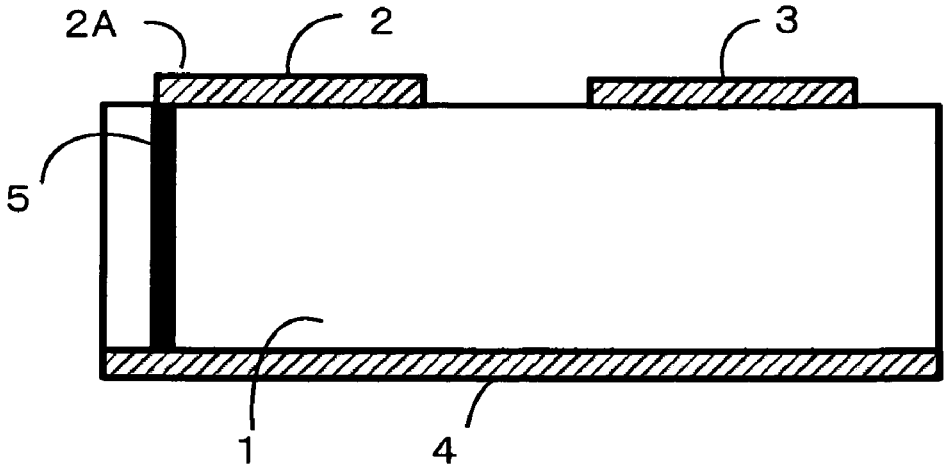
FIG. 3 is a sectional view of FIG. 2 in the plane A-A.

The microstrip antenna which is shown in FIGS. 2 and 3 has the same fundamental structure as does the one shown in FIG. 1; in other words, it comprises a substrate 1, an A antenna electrode 2, a B antenna electrode 3, a ground electrode 4, and feed lines 10. The A antenna electrode 2 and the B antenna electrode 3 are in a laterally symmetric shape and positional relationship. In addition to this, some one spot 2A on one of the electrodes, for example the A antenna electrode 2, is connected to the ground electrode 4. In other words, an electrically conductive connection member 5 (hereinafter termed a "through hole") is pierced through a spot on the substrate 1 which corresponds to the above described one spot 2A on the A antenna electrode 2, and this through hole 5 is coupled at its one end to the above described one spot on the A antenna electrode 2, while at its other end it is coupled to the ground electrode 4. In this manner, the above described one spot 2A on the A antenna electrode 2 is connected to the ground electrode 4 via the through hole 5. This spot on the antenna electrode which, in this manner, is connected to the ground electrode 4 (or which, as will be explained hereinafter, is made to be capable of being connected to ground by a switch or by some other type of electrical circuit, when desired) is termed the "ground contact point". As shown in FIG. 2, the lengths L of the antenna electrodes 2, 3 from the feed points P, P on the lower sides of the antenna electrodes 2, 3 as seen in the drawing to the edges on their opposite sides (their terminal edges) are designed to be the same as, or somewhat smaller than, the half wavelength $\lambda g/2$ of the high frequency signal on the substrate 1. Here, $\lambda g$ is the wavelength of the high frequency signal as it propagates over the substrate 1. Furthermore, if the wavelength of the high frequency radio wave signal in vacuum is termed $\lambda$, and the permittivity of the substrate 1 is termed $\in r$, then $\lambda = \in r1/2 \cdot \lambda g$. In the example shown in FIG. 2, the ground contact point 2A of the A antenna electrode 2 is positioned at one spot on the terminal edge on the opposite side of the edge where the feed point P is located. The phase of the radio wave beam which is emitted from the A antenna electrode 2 slightly leads that of the radio wave beam which is emitted by the B antenna electrode 3, and, as a result, the direction of the integrated radio wave beam which is formed by the combination of these two beams is inclined towards the side of the B antenna electrode 3, as shown by the arrow sign in FIG. 2.

Figure 4:
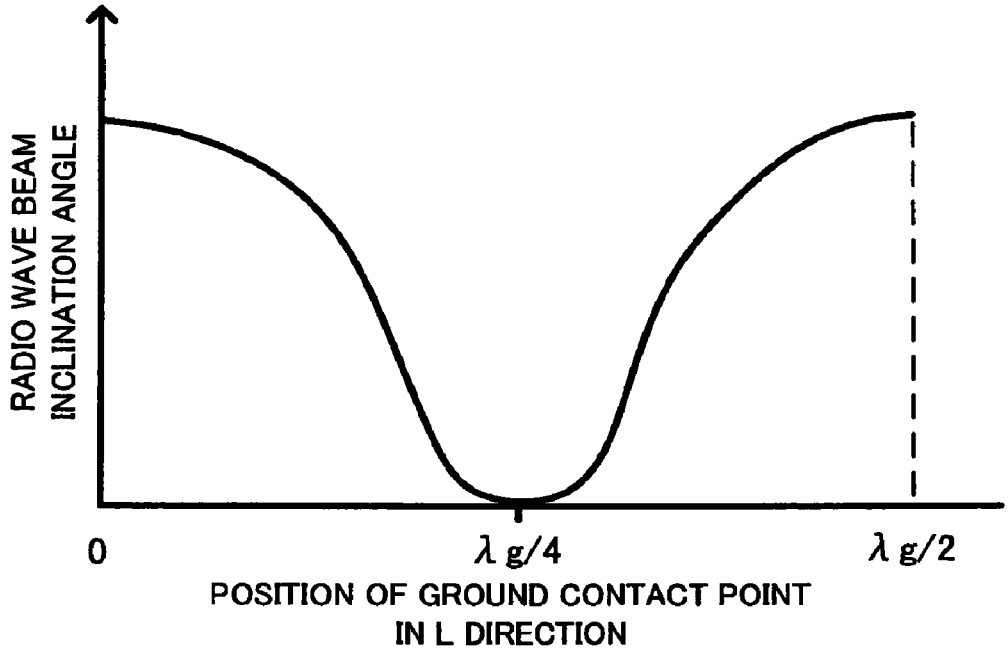
FIG. 4 is a figure showing the relationship, in this embodiment, between the position of a ground contact point of an antenna electrode, and the angle of inclination of the integrated radio wave beam.

In the structure shown in FIG. 2, when the position of the ground contact point 2 of the A antenna electrode 2 changes, the angle of inclination of the direction of the integrated radio wave beam changes. FIG. 4 is a characteristic diagram obtained experimentally for a case with the antenna electrodes 2, 3 being made in a certain shape, showing the relationship between the position of the ground contact point 2A and the angle of inclination with respect to the vertical direction on the surface of the substrate of the direction of the integrated radio wave beam. In FIG. 4, the horizontal axis shows the position of the ground contact point 2A in the direction of the length L shown in FIG. 2 when the feed point P of the A antenna electrode 2 is taken as origin, while the vertical axis shows the angle of inclination of the integrated radio wave beam.

As will be understood from FIG. 4, when the distance in the direction of the length L from the feed point P to the ground contact point 2A is almost zero (in other words, when the ground contact point 2A is upon the same edge as the feed point P) or is almost a half wavelength $\lambda g/2$ (in other words, when the ground contact point 2A is upon the terminal edge on the opposite side from the feed point P), then the angle of inclination of the integrated radio wave beam becomes maximum; while, conversely, when this distance is almost a quarter of a wavelength $\lambda g/4$ (in other words, when the ground contact point 2A is at a central position in the L direction), then the angle of inclination of the integrated radio wave beam is minimal (almost zero). Although this is not particularly shown in the figures, it should be understood that, if the position of the ground contact point 2A is changed in the direction which is orthogonal to the direction of the length L, then the angle of inclination of the integrated radio wave beam does not particularly change. For example, referring to FIG. 2, even when the ground contact point 2A which is upon the upper left edge of the A antenna electrode 2 (in the position $\lambda g/2$ in FIG. 4) is shifted towards the right along the upper side edge, the angle of inclination of the integrated radio wave beam does not greatly change. By contrast, when the ground contact point 2A which is upon the upper left edge is shifted downwards along the left side edge, then the angle of inclination decreases and becomes minimum at the central point (at the position $\lambda g/4$ in FIG. 4), and then increases and again becomes maximum when it arrives at the lower side edge (the position 0 in FIG. 4).

Figure 5:
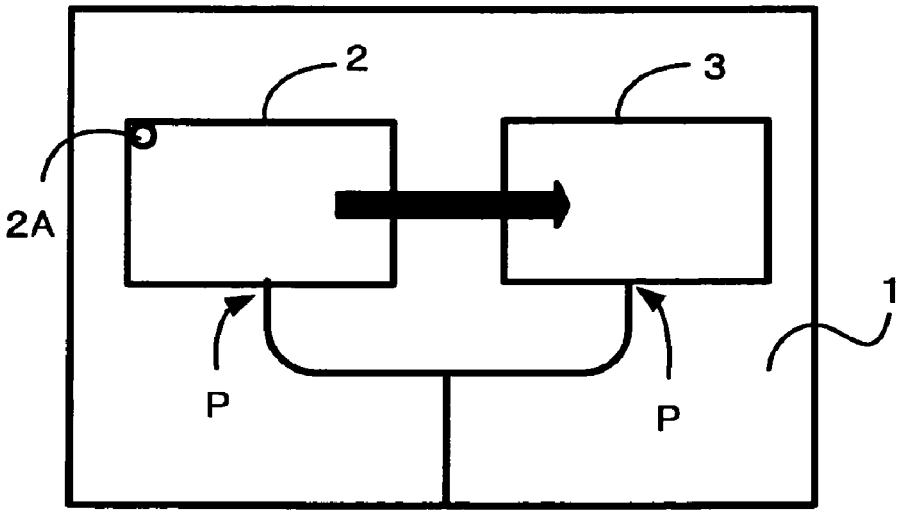
FIG. 5 is a plan view showing another example of arrangement of the ground contact point of the antenna electrode, in this embodiment.

Accordingly, as shown in FIG. 5, when the ground contact point 2A of the A antenna electrode 2 is located at a somewhat intermediate position from the terminal edge, then the inclination of the integrated radio wave beam becomes somewhat smaller than in the case shown in FIG. 2. When through holes 5 are provided in the positions of both of the two ground contact points 2A shown in FIG. 2 and FIG. 5, and a switch (not shown in the figures) is provided to each of those through holes 5, so that it is made possible to be able to open and close these through holes 5 individually, then it is possible to switch over the direction of the integrated radio wave beam between three directions, according as to whether all of these switches are OFF, or according to which single one thereof is ON.

Figure 6:
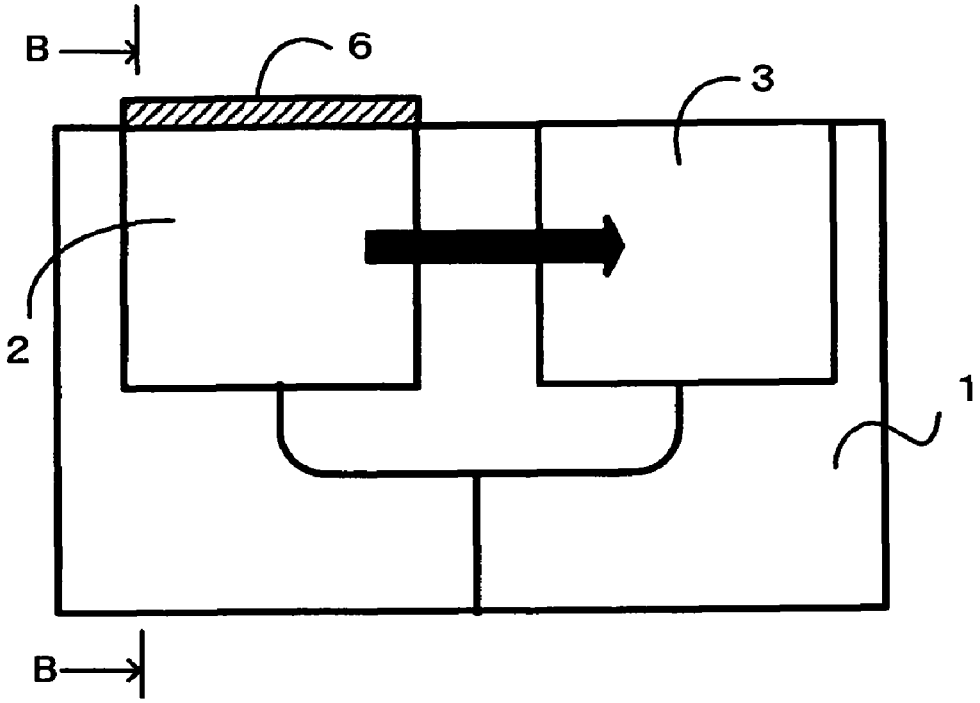
FIG. 6 is a plan view showing a second embodiment of the microstrip antenna of the present invention.

FIG. 6 is a plan view of a second embodiment of the microstrip antenna of the present invention. Furthermore, FIG. 7 is a sectional view of FIG. 6 in the plane B-B.

Figure 7:
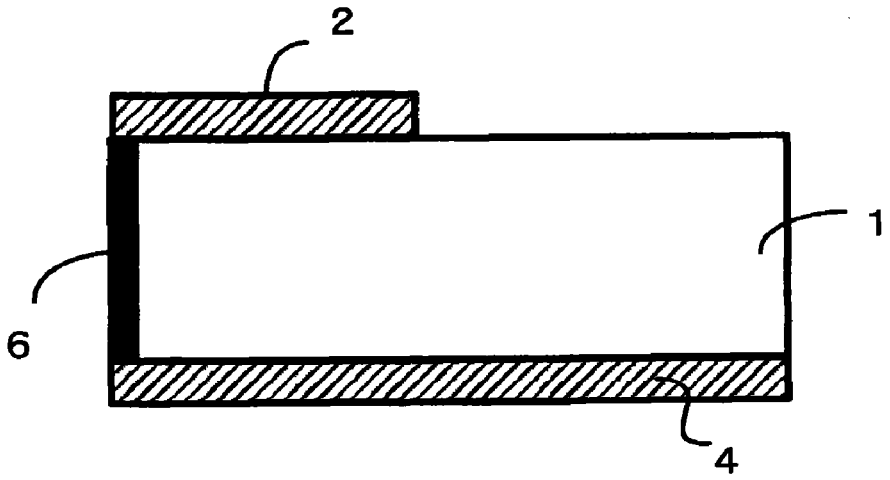
FIG. 7 is a sectional view of FIG. 6 in the plane B-B.

As shown in FIGS. 6 and 7, the terminal edges of the A antenna electrode 2 and the B antenna electrode 3 are positioned along the edge of the substrate 1. The terminal edge of the A antenna electrode 2 is connected to the ground electrode 4 by a connection member 6 which is disposed upon the side surface of the edge of the substrate 1. By connecting the terminal edge of the A antenna electrode 2 to the ground electrode 4 in this manner, in the same manner as in the case shown in FIG. 2, the integrated radio wave beam which is transmitted from the microstrip antenna is inclined in the direction of the B antenna electrode 3, as shown by the arrow sign in FIG. 6.

Figure 8:
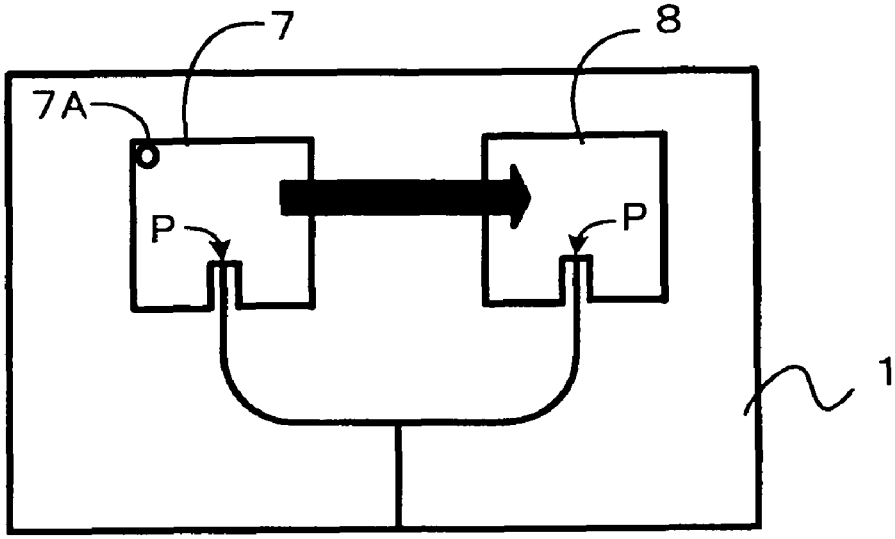
FIG. 8 is a plan view showing a third embodiment of the microstrip antenna of the present invention.

FIG. 8 is a plan view of a third embodiment of the microstrip antenna of the present invention.

As shown in FIG. 8, the feed points P, P of the A antenna electrode 7 and the B antenna electrode 8 are arranged at embedded positions of the respective antenna electrodes 7 and 8 (specifically, at points where the impedance of the transmission line 10 and the antenna impedance agree with one another). The ground contact point 7A of the A antenna electrode 7 is at the left end of its terminal edge, and this is connected to the ground electrode on the rear surface by a through hole not shown in the figures. Due to this, the integrated radio wave beam is inclined, for example, in the direction of the B antenna electrode 3, as shown by the arrow sign in FIG. 8.

Figure 9:
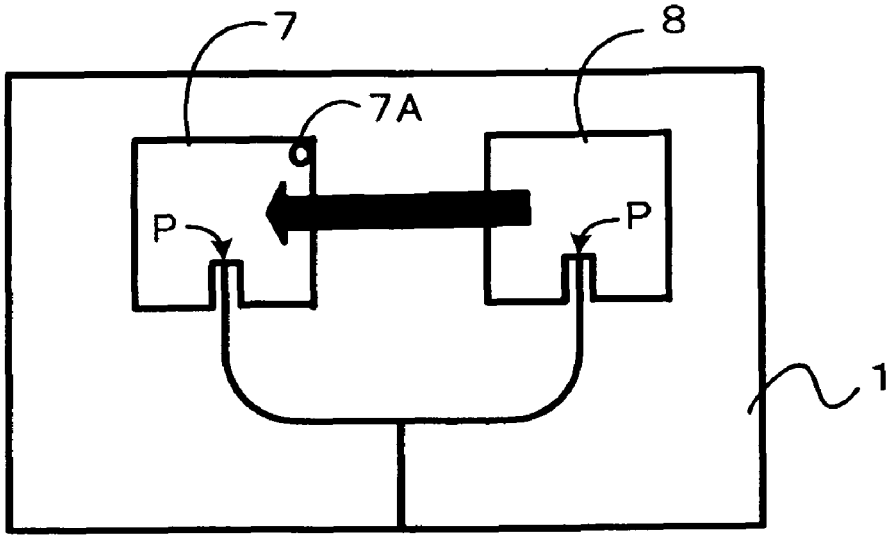
FIG. 9 is a plan view showing another example of arrangement of the ground contact point of the antenna electrode, in this embodiment.

In the embodiment of FIG. 8, when the ground contact point 7A of the A antenna electrode 7 is changed, for example, to the right end of the terminal edge as shown in FIG. 9, then the integrated radio wave beam inclines, for example, towards the A antenna electrode 2, as shown by the arrow sign in FIG. 9. If through holes are provided in the positions of both of the two ground contact points 7A shown in FIG. 8 and FIG. 9, and respective switches (not shown in the figures) are provided to those through holes, so that it is made to be possible to open and close those through holes individually, then it is possible to switch over the direction of the integrated radio wave beam between three directions, according as to whether all of these switches are OFF, or according to which single one of these switches is ON. With the structure shown in FIGS. 8 and 9, since the through holes are not all located on the antenna electrode on one side, it is possible to aggregate on one side the transmission losses due to variation during manufacture (mismatching of impedances), so that it is possible to supply an antenna of good output characteristics.

Figure 10:
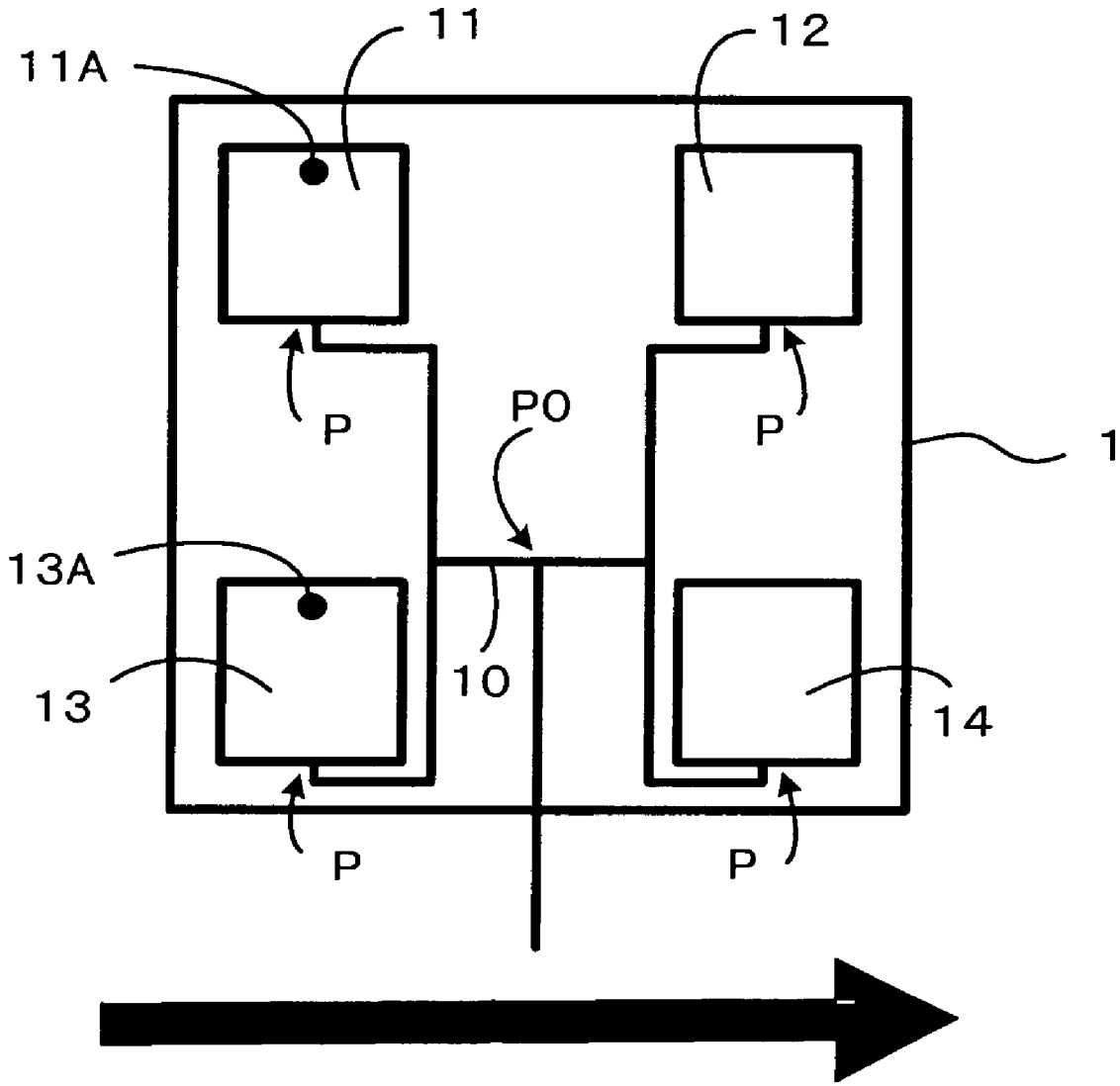
FIG. 10 is a plan view showing a fourth embodiment of the microstrip antenna of the present invention.

FIG. 10 is a plan view of a fourth embodiment of the microstrip antenna of the present invention.

As shown in FIG. 10, the following four antenna electrodes are arranged in the shape of a 2×2 matrix upon a substrate 1: an A antenna electrode 11, a B antenna electrode 12, a C antenna electrode 13, and a D antenna electrode 14. The A antenna electrode 11 and the B antenna electrode 12 are in a laterally symmetric shape and positional relationship, and the C antenna electrode 13 and the D antenna electrode 14 are also in a laterally symmetric shape and positional relationship. The electrode patterns of the A antenna electrode 11 and the B antenna electrode 12 are fundamentally the same in shape, and similarly the electrode patterns of the C antenna electrode 13 and the D antenna electrode 14 are fundamentally the same in shape. The lengths of the feed lines to the A antenna electrode 11, the B antenna electrode 12, the C antenna electrode 13, and the D antenna electrode 14 are all the same. The direction in which the feed line 10 branches off from the root feed point P0 which is almost in the center of the substrate 1 (in the figure, the left and right direction), and the direction in which the various electrodes 11 through 14 are excited (the direction from their feed points P towards their terminal edges, i.e. the vertical direction in the figure), are orthogonal, and do not agree with one another. A ground contact point 11A is provided at one spot upon the terminal edge of the A antenna electrode 11, and a ground contact point 13A is also provided at one spot upon the terminal edge of the C antenna electrode 13. Due to this, as for example shown by the arrow sign pointing rightwards in FIG. 10, the direction of the integrated radio wave beam is inclined towards the direction from the A, C antenna electrodes 11, 13 towards the B, D antenna electrodes 12, 14.

Figure 11:
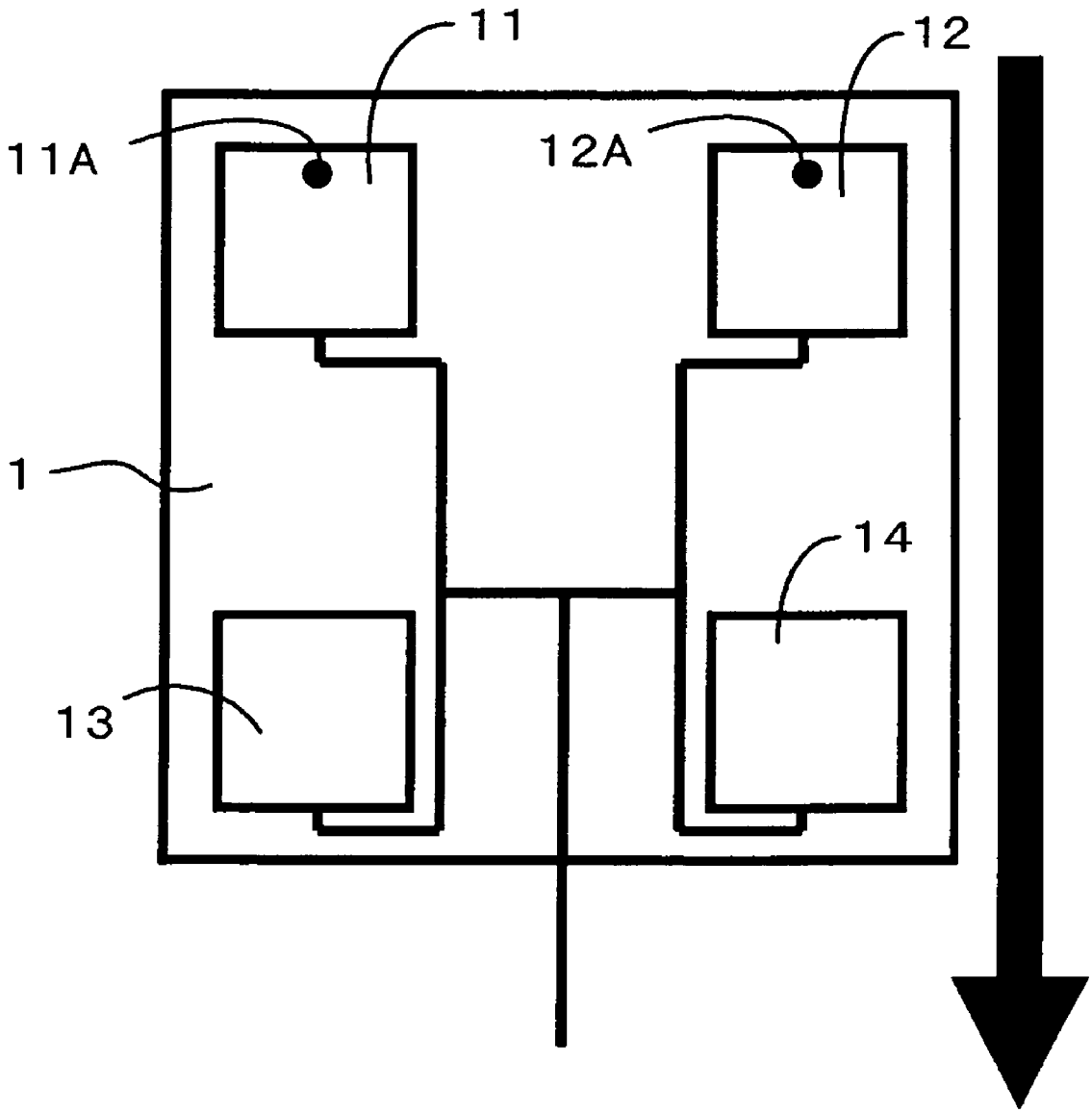
FIG. 11 is a plan view showing another example of arrangement of the ground contact point of the antenna electrode in this embodiment.

Furthermore if, in this embodiment, as shown in FIG. 11, ground contact points 11A, 12A are provided upon the terminal edges of the A antenna electrode 11 and the B antenna electrode 12 respectively, then, as for example shown by the arrow sign pointing downwards in FIG. 11, the direction of the integrated radio wave beam is inclined towards the direction from the A, B antenna electrodes 11, 12 towards the C, D antenna electrodes 13, 14.

Figure 12:
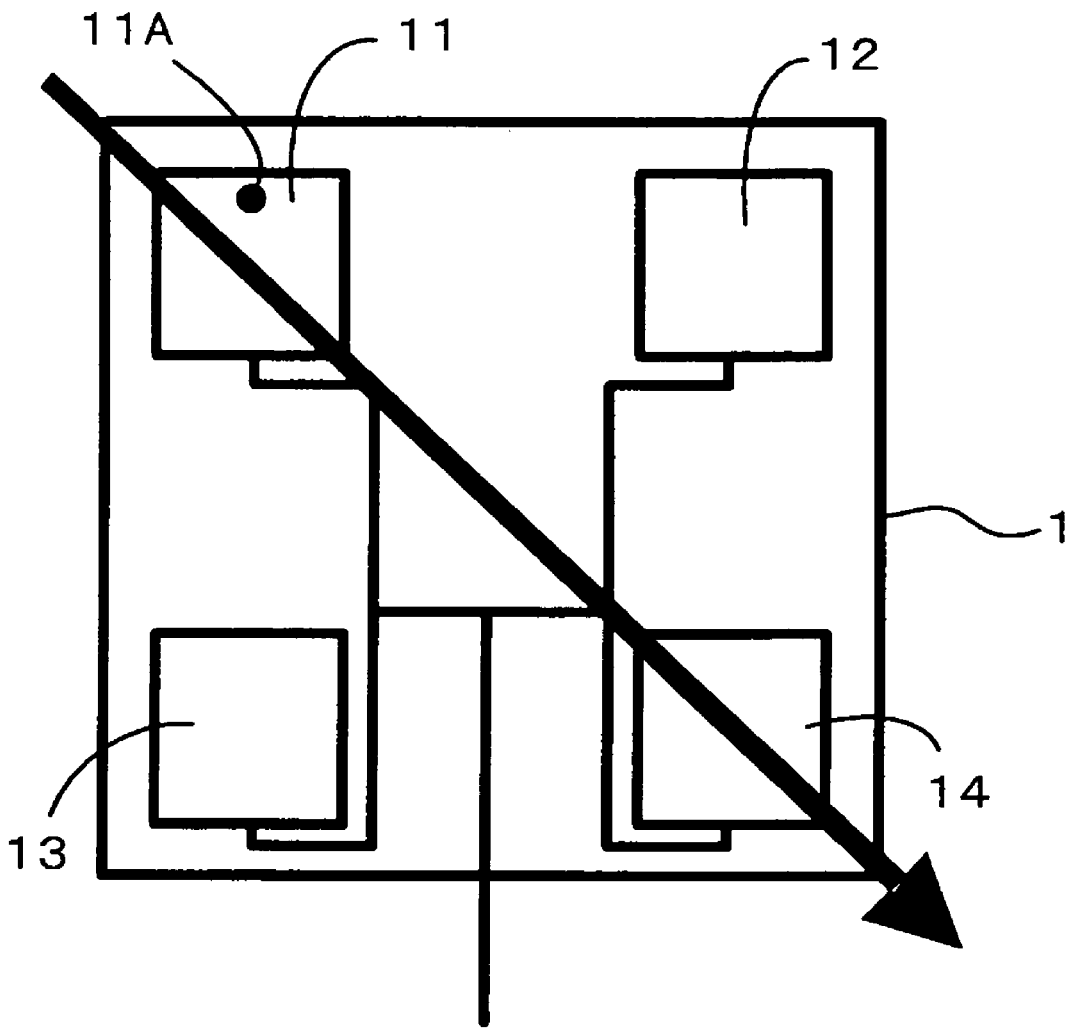
FIG. 12 is a plan view showing yet another example of arrangement of the ground contact point of the antenna electrode in this embodiment.

Furthermore if, in this embodiment, only a ground contact point 11A is provided upon the A antenna electrode 11, as shown in FIG. 12, then, as for example shown by the arrow sign sloping diagonally rightwards and downwards in FIG. 11, the direction of the integrated radio wave beam is inclined towards the direction from the A antenna electrode 11 towards the D antenna electrode 14.

Figure 13:
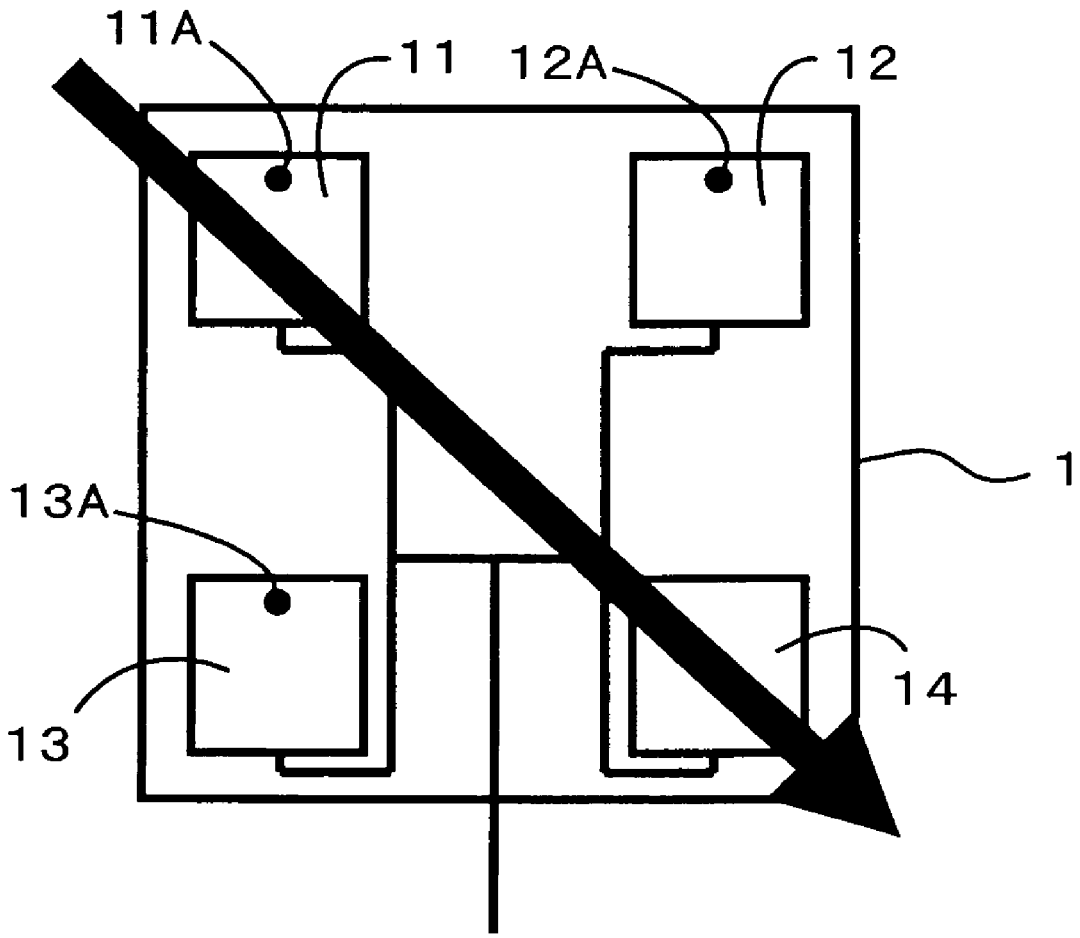
FIG. 13 is a plan view showing still yet another example of arrangement of the ground contact point of the antenna electrode in this embodiment.

Moreover if, in this embodiment, as shown in FIG. 13, ground contact points 11A, 12A, and 13A are provided upon the terminal edges of the A antenna electrode 11, the B antenna electrode 12, and the C antenna electrode 13 respectively, then, as for example shown by the arrow sign sloping rightwards and downwards in FIG. 13, the direction of the integrated radio wave beam is inclined towards the direction from the A antenna electrode 11 towards the D antenna electrode 14, and more so than in the case of FIG. 12. It would be possible to provide a switch (not shown in the figure) to each of the through holes connected to the ground contact points 11A through 13A, and to select between the variations shown in FIGS. 10 through 13 by selectively activating and deactivating these switches.

Figure 14:
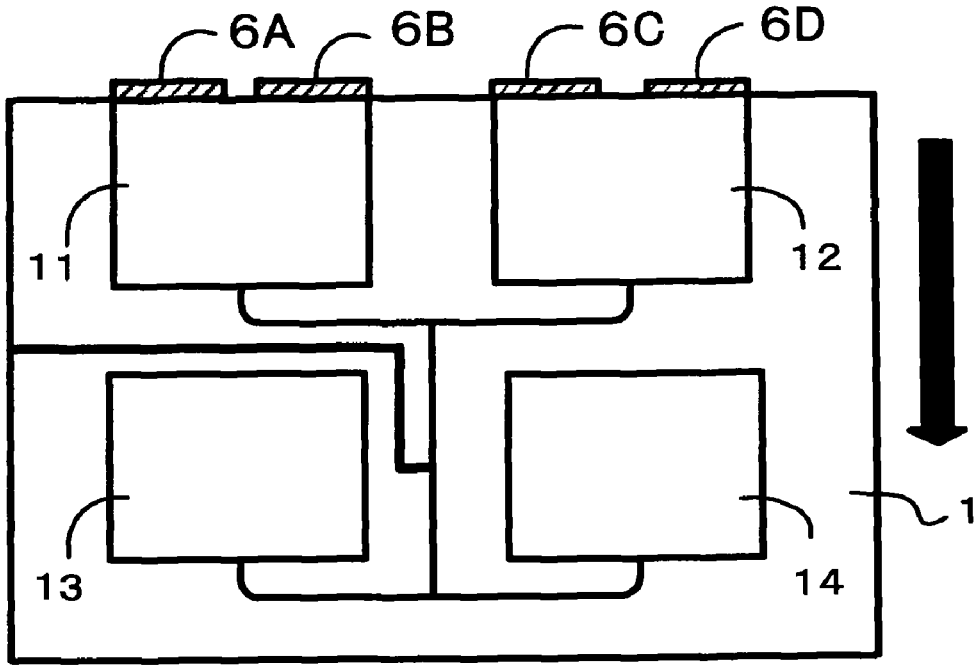
FIG. 14 is a plan view showing a fifth embodiment of the microstrip antenna of the present invention.

FIG. 14 is a plan view showing a fifth embodiment of the microstrip antenna of the present invention.

As shown in FIG. 14, the following four antenna electrodes are arranged in the shape of a 2×2 matrix: an A antenna electrode 11, a B antenna electrode 12, a C antenna electrode 13, and a D antenna electrode 14. The A antenna electrode 11 and the B antenna electrode 12 are in a laterally symmetric shape and positional relationship, and the C antenna electrode 13 and the D antenna electrode 14 are also in a laterally symmetric shape and positional relationship. The electrode patterns of the A antenna electrode 11 and the B antenna electrode 12 are fundamentally the same in shape, and similarly the electrode patterns of the C antenna electrode 13 and the D antenna electrode 14 are fundamentally the same in shape. The lengths of the feed lines to the A antenna electrode 11, the B antenna electrode 12, the C antenna electrode 13, and the D antenna electrode 14 are all the same. The terminal edges of the A antenna electrode 11 and the B antenna electrode 12 are disposed along the upper edge of the substrate 1. And two spots upon the terminal edge of the A antenna electrode 11 are respectively connected to a ground electrode (not shown in the figure) upon the rear surface of the substrate 1 by two respective connection members 6A, 6B which are arranged upon the side surface of the upper edge of the substrate 1, corresponding to these two spots. In the same manner, two spots upon the terminal edge of the B antenna electrode 12 are respectively connected to the ground electrode (not shown in the figure) upon the rear surface of the substrate 1 by two respective connection members 6C, 6D which are arranged upon the side surface of the upper edge of the substrate 1, corresponding to these two spots. Due to this, the direction of the integrated radio wave beam is inclined in the direction of the C antenna electrode 13 and the D antenna electrode 14, for example as shown by the arrow sign pointing downwards in FIG. 14. Switches (not shown in the figures) are provided in each of these connection members 6A, 6B, 6C, 6D, and the direction or angle of the integrated radio wave beam can be changed by opening and closing the connection members 6A, 6B, 6C, 6D with these switches.

Figure 15:
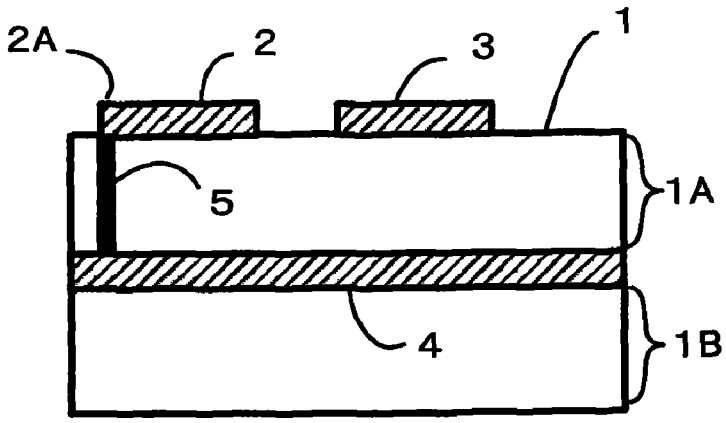
FIG. 15 is a plan view showing a sixth embodiment of the microstrip antenna of the present invention.

FIG. 15 is a plan view showing the arrangement of a sixth embodiment of the microstrip antenna of the present invention.

As shown in FIG. 15, the substrate 1 is a multi-layered substrate consisting of a plurality of substrates laminated upon one another, like an A substrate 1A and a B substrate 1B; and a ground electrode 4 is sandwiched between the A substrate 1A and the B substrate 1B. In other words, the ground electrode is disposed in the interior of the substrate 1. The A antenna electrode 2 and the B antenna electrode 3 may be arranged, for example, in the same manner as in the second embodiment. At, for example, a ground contact point 2A at one spot on its terminal edge, the A antenna electrode 2 is connected to the ground electrode 4 by a through hole 5 which is pierced through the A substrate 1A. In the same manner as in the second embodiment, the direction of the integrated radio wave beam is inclined in the direction of the B antenna electrode 3. A switch (not shown in the figure) is provided to the through hole 5, and it is possible to change the direction of the integrated radio wave beam by opening and closing the through hole 5 with this switch.

Figure 16:
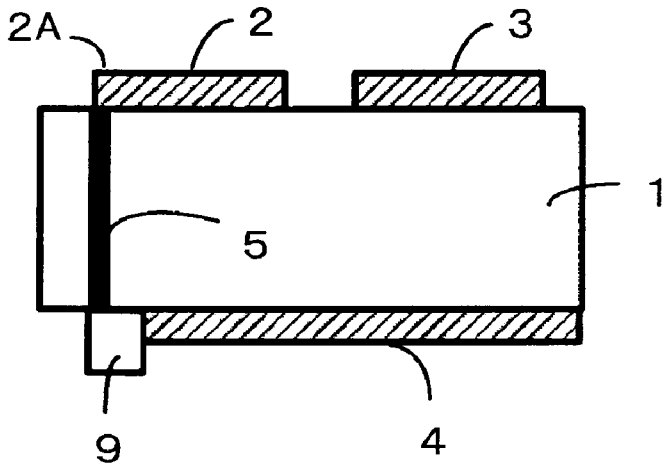
FIG. 16 is a sectional view of the arrangement of an antenna electrode and a ground electrode in an eleventh variation for implementing the microstrip antenna of the present invention.

FIG. 16 is a sectional view showing an example of the switch described above.

As shown in FIG. 16, a switch 9 is provided at a spot which connects between the through hole 5 which is connected to the A antenna electrode 2 and the ground electrode 4, and this switch 9 opens and closes the connection between this through hole 5 and the ground electrode 4. When the A antenna electrode 2 is seen in plan view, the switch 9 is provided at a position which enters into the region of the A antenna electrode 2. Since the switch 9 does not need to have a characteristic of passing a high frequency signal in a satisfactory manner, accordingly it is not necessary for it to be a high frequency switch. Thus the switch 9 may be a mechanical switch, or may be a semiconductor switch.

Figure 17:
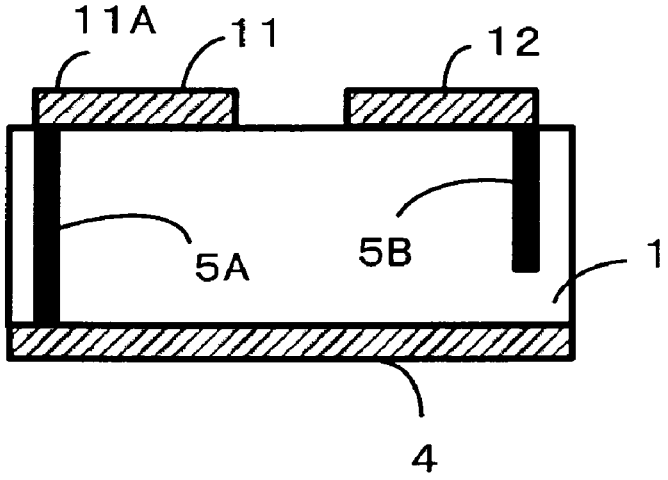
FIG. 17 is a sectional view showing a seventh embodiment of the microstrip antenna of the present invention.

FIG. 17 is a sectional view showing a seventh embodiment of the microstrip antenna of the present invention.

The plan view of this embodiment is the same as the one shown in FIGS. 10 through 13. As shown in FIG. 17, the A antenna electrode 11 is connected at its ground point 11A to the ground electrode 4 by a through hole 5A. On the other hand, while the B antenna electrode 12 is connected to a through hole 5B at a point 12A which is in a symmetric position to the ground contact point 11A of the A antenna electrode 11, this through hole 5B is not fully pierced through the substrate 1 and is not connected to the ground electrode 4. In other words, the through hole 5B is a dummy through hole which does not function as a through hole. Accordingly, the B antenna electrode 12 is not connected to the ground electrode 4. The same structure as this A antenna electrode 11 and B antenna electrode 12 is also applied to the C antenna electrode 13 and the D antenna electrode 14. Accordingly, in the same manner as in the case of FIG. 10, since only the A antenna electrode and the C antenna electrode are connected to the ground electrode 4, therefore the direction of the integrated radio wave beam is inclined in the same manner as in the case of FIG. 10. In addition to this, by the dummy through holes 5B being connected to both the B antenna electrode 12 and the D antenna electrode 14 but not connecting to the ground electrode 4, all of the antenna electrodes 11 through 14 come to have almost the same shape, and thus the compatibility between the antenna electrodes 11 through 14 becomes better.

Figure 18:
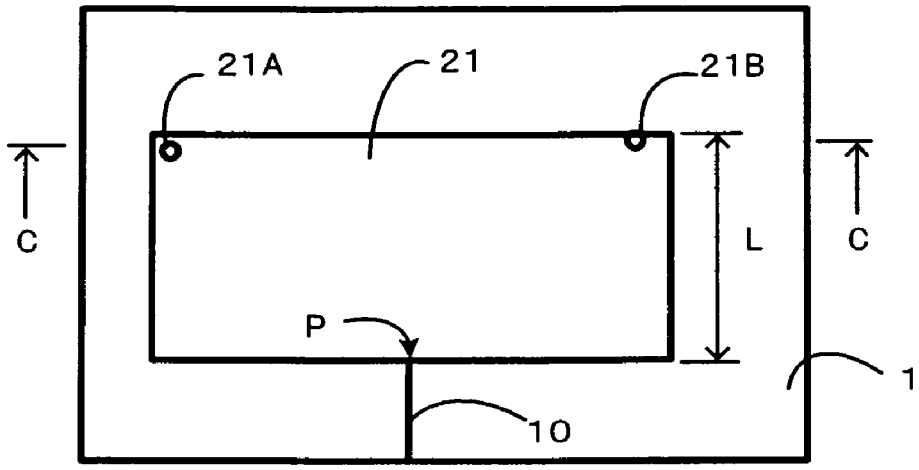
FIG. 18 is a plan view showing an eighth embodiment of the microstrip antenna of the present invention.
Figure 19:
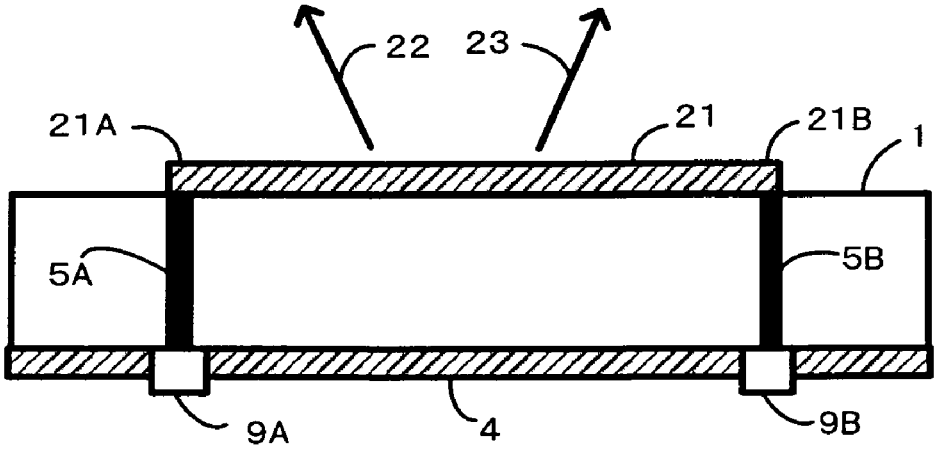
FIG. 19 is a sectional view of FIG. 18 in the plane C-C.

FIG. 18 is a plan view showing an eighth embodiment of the microstrip antenna of the present invention. Furthermore, FIG. 19 is a sectional view of FIG. 18 in the plane C-C.

In FIG. 18, the length L from the feed point P of the antenna electrode 21 to its terminal edge (the edge at the upper side) is set to be somewhat greater than the half wavelength $\lambda g/2$ of the high frequency signal. Due to this, the antenna electrode 21 operates in a secondary resonant frequency mode with respect to the high frequency signal, and, as a result, radio wave beams 22, 23 which have been split into two directions are outputted from the antenna electrode 21, as shown in FIG. 19. When the antenna electrode 21 is connected at its ground contact point 21A which is provided at some position thereupon (for example, at the left end of its terminal edge) through the through hole 5A to the ground electrode 4, since the phase between the two radio wave beams 22, 23 deviates (for example, the phase of the radio wave beam 22 on the side of the ground contact point 21A is advanced), accordingly the direction of the integrated radio wave beam which results from combining the radio wave beams 22, 23 is inclined towards the side where there is no ground contact point 21A (i.e., to the right side in the figure). When the antenna electrode 21 is connected at its ground contact point 21B which is provided at some other position thereupon (for example, at the right end of its terminal edge) through the through hole 5B to the ground electrode 4, then the direction of the integrated radio wave beam is inclined in some other direction (for example, to the left side). If the position of the ground contact point is changed by opening and closing the through holes 5A, 5B with the respective switches 9A, 9B, then the direction of the integrated radio wave beam is changed.

Figure 20:
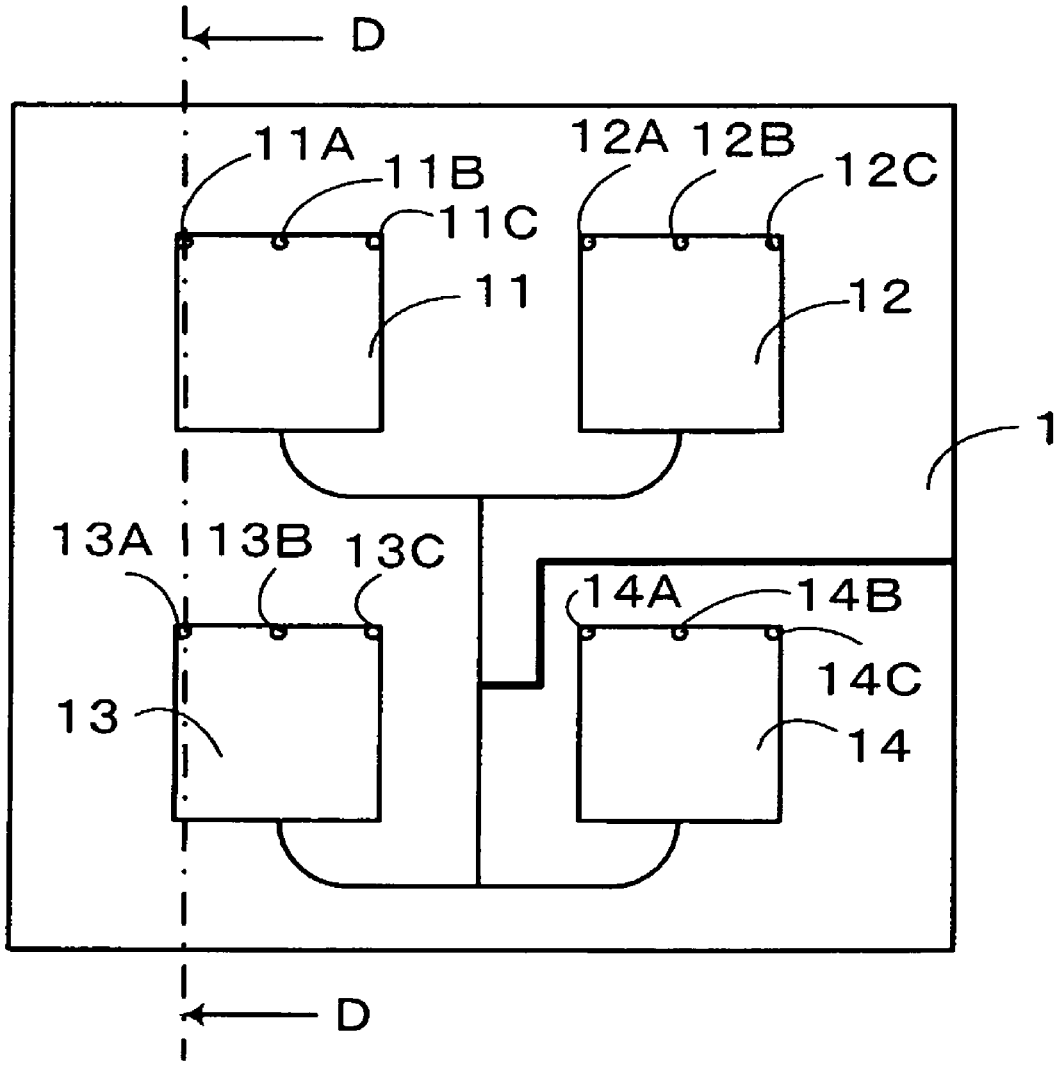
FIG. 20 is a plan view showing a ninth embodiment of the microstrip antenna of the present invention.
Figure 21:
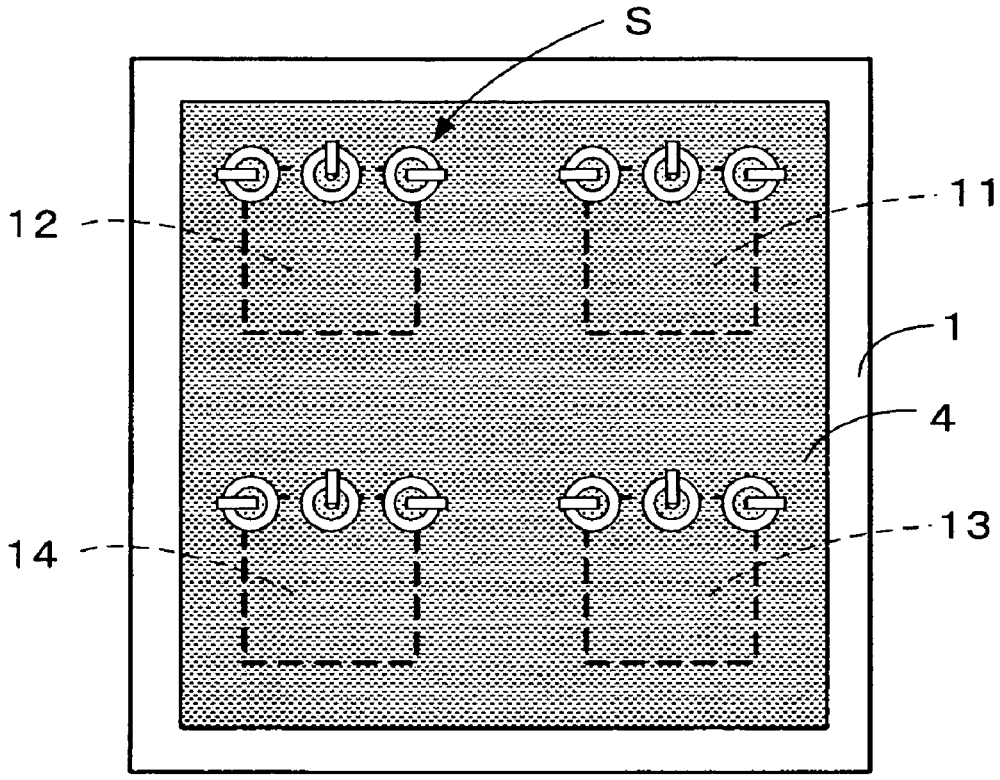
FIG. 21 is a rear view of the same embodiment.
Figure 22:
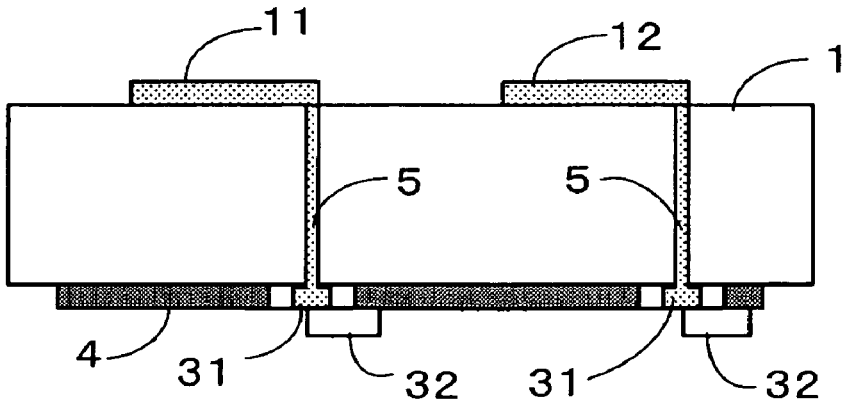
FIG. 22 is a sectional view of FIG. 20 in the plane D-D.
Figure 23:
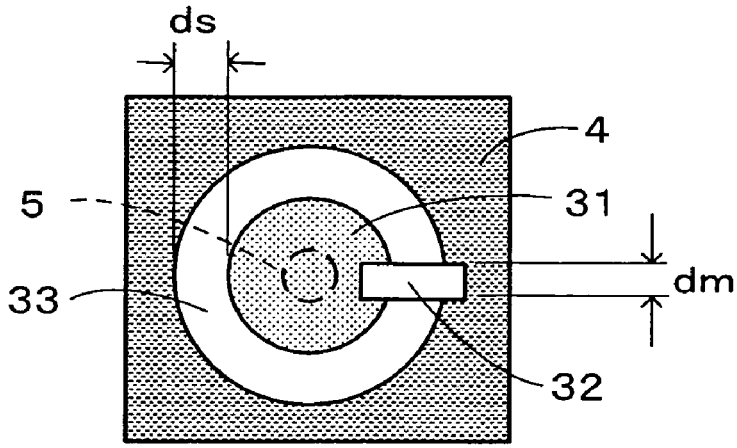
FIG. 23 is an enlarged view of a connection spot S between a through hole and a ground electrode of FIG. 21.

FIG. 20 is a plan view showing a ninth embodiment of the microstrip antenna of the present invention. And FIG. 21 is a rear view of the same embodiment. Moreover, FIG. 22 is a sectional view of FIG. 20 in a plane show by D-D. And FIG. 23 is an enlarged view of a connection spot S between a through hole and a ground electrode of FIG. 21.

As shown in FIGS. 20 and 22, a plurality of antenna electrodes 11, 12, 13, 14 are arranged in the form of a matrix upon the surface of a substrate 1. The antenna electrode 11 and 12 are in a laterally symmetric shape and positional relationship, and the antenna electrode 13 and 14 are also in a laterally symmetric shape and positional relationship. The electrode patterns of the antenna electrodes 11 and 12 are fundamentally the same in shape, and similarly the electrode patterns of the antenna electrodes 13 and 14 are fundamentally the same in shape. The lengths of the feed lines to the antenna electrodes 11, 12, 13, and 14 are all the same. Each of the antenna electrodes 11, 12, 13, and 14 is connected to a plurality of through holes 5, 5, . . . at a plurality of ground contact points 11A-11C, 12A-13C, 13A-13C, and 14A-14C which are arranged in different positions. As shown in FIG. 21, the ground electrode 4 is disposed over substantially the entire rear surface of the substrate 1. As shown in FIGS. 22 and 23, on each of the through holes 5, at its rear surface side which is pierced through the substrate 1, there is formed a blob-shaped electrode 31 (hereinafter termed a "land") of a circular shape. As shown in FIG. 23, at each spot on the ground electrode 4 which corresponds to one of the lands 31, a circular shaped gap is opened up which is larger than the concentric land 31, and accordingly an insulation space 33 is present between the land 31 and the ground electrode 4. A connection line 32 straddles this insulation space 33, and connects between the land 31 and the ground electrode 4. This connection line is endowed with the function of a switch, and it can electrically connect together the land 31 and the ground electrode 4, or can be severed. It is possible to vary the direction of the integrated radio wave beam by opening and closing the various connection lines 32, thus selecting which ones among the above described plurality of ground contact points 11A-11C, 12A-13C, 13A-13C, and 14A-14C are connected to the ground electrode 4.

It should be understood that various alterations may be considered for the number and the arrangement of the ground contact points of the antenna electrodes. For example, it is possible to dispose the ground contact points at a plurality of locations, so that, taking the vertical direction from the substrate as a center, it is possible to wag the direction of the integrated radio wave beam in opposite directions (for example up and down, or left and right), and moreover, so that it becomes possible to change the angle of inclination of the radio wave beam direction in each direction in a desired number of steps.

By the way, in all of the above described embodiments, the switches are changed over between two conditions, so that the antenna electrodes and the ground electrode are either connected (ON) or disconnected (OFF). However, as a variant embodiment, it would also be possible to arrange for it to be possible to change the direction of the integrated radio wave beam continuously, or stepwise, by adjusting the degrees of electrical coupling between the antenna electrodes and the ground electrode, or, to put it in another manner, the impedances Z ($=R+j\omega L-j\cdot 1/\omega C$) between the antenna electrodes and the ground electrode for the high frequency signal, continuously or stepwise. For example, in the case shown in FIG. 23, the width dm of the connection line 32 (or, to put it in another manner, its cross sectional area) and the distance ds across the insulation space and the like exert an influence upon the impedance between the land 31 (in other words, the antenna electrode) and the ground electrode 4. Accordingly, in the example shown in FIG. 23, by inserting a structure which makes it possible to vary the width dm of the connection line 32, or the distance ds across the insulation space, continuously or stepwise, it is possible to vary the impedance between the antenna electrode and the ground electrode 4, and thereby to make it possible to control the magnitude of the inclination of the direction of the integrated radio wave beam in a variable manner. For example, it is possible to vary the impedance (the resistance value) of the connection line 32 by varying the width dm of the connection line 32. Furthermore, it is also possible to vary the impedance between the antenna electrode and the ground electrode by varying the length of the through hole which connects from the antenna electrode to the ground electrode.

In the following, an embodiment in which it is arranged to vary the impedance between the antenna electrode and the ground electrode in this manner will be explained.

Figure 24:
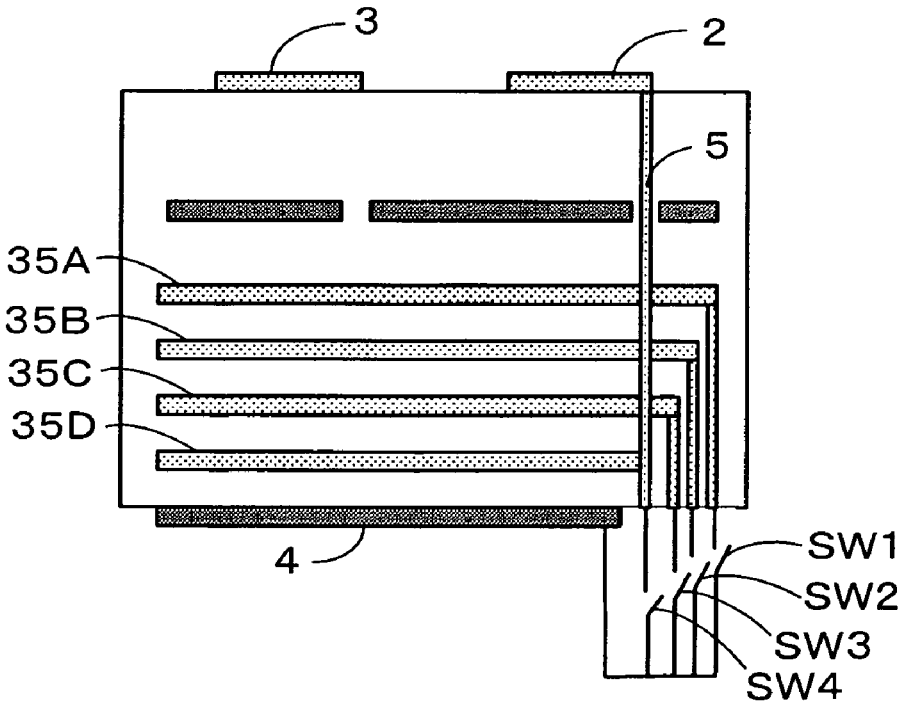
FIG. 24 is a plan view showing a tenth embodiment of the microstrip antenna of the present invention.

FIG. 24 is a sectional view showing a tenth embodiment of the microstrip antenna of the present invention.

In the embodiment shown in FIG. 24, the impedance between the antenna electrode 2 and the ground electrode 4 is controlled so as to be variable, by varying the length of the through hole 5. In other words, the antenna electrode 2 is disposed upon the surface of a multi layered substrate 34, and the through hole 5 which is connected to this antenna electrode 2 is pierced through to the rear surface of the multi layered substrate 34. The through hole 5 is formed from such a material, and of such a thinness, that it is possible to vary its impedance significantly, according to its length. The ground electrode 4 is provided upon the rear surface of the multi layered substrate 34. Moreover, intermediate electrodes 35A, 35B, 35C, and 35D are disposed between each layer of the multi layered substrate 34, and the through hole 5 is connected to all of these intermediate electrodes 35A, 35B, 35C, and 35D. And it is arranged for each of the intermediate electrodes 35A, 35B, 35C, and 35D to be connected to the ground electrode 4 on the rear surface by a respective switch SW1, SW2, SW3, and SW4.

Thus, when the switch SW1 is set to ON, then the effective length of the through hole 5 becomes the shortest, since the ground electrode 4 is positioned substantially at the position of the intermediate electrode 35A, and so the impedance between the antenna electrode 2 and the ground electrode 4 becomes the smallest. Furthermore, when the switch SW4 is set to ON, then the effective length of the through hole 5 becomes the longest, since the ground electrode 4 is positioned substantially at the position of the intermediate electrode 35D, and so the impedance between the antenna electrode 2 and the ground electrode 4 becomes the largest. By changing over the various switches SW1, SW2, SW3, and SW4 in this manner, the effective length of the through hole 5 is varied, so that the direction of the integrated radio wave beam is changed, since the impedance between the antenna electrode 2 and the ground electrode 4 is varied.

Figure 25A:
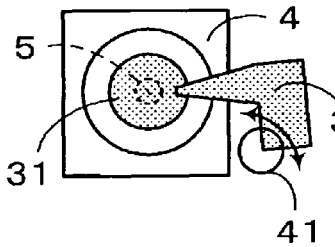
FIG. 25 is a plan view showing a portion of a connection location between a through hole and a ground electrode, in an eleventh embodiment of the microstrip antenna of the present invention.
Figure 25B:
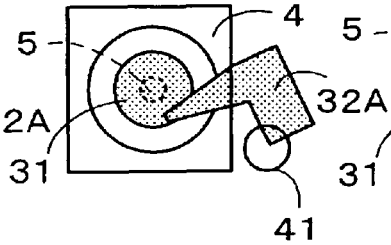
Figure 25C:
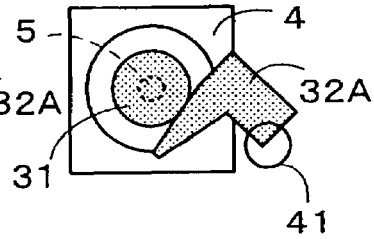

FIG. 25 is a plan view showing a portion of a connection spot between a through hole 5 and the ground electrode 4, in a eleventh embodiment of the microstrip antenna of the present invention.

In this embodiment, the through holes 5, the lands 31, and the ground electrode 4 have the same structure as the one shown in FIG. 23. As shown in FIGS. 25(*a*) through 25(*c*), the connection line 32A has a shape which becomes continuously thinner towards its end (i.e. its cross sectional area becomes smaller). And the connection line 32A is made so as to be rotationally shifted through a fixed range by an actuator 41. When, as shown in FIG. 25(*a*), the thinnest portion at the end of the connection line 32A connects together the land 31 and the ground electrode 4, the impedance of the connection line 32A (in other words, the impedance between the antenna electrode and the ground electrode 4) becomes the greatest. And when, as shown in FIGS. 25(*b*) and 25(*c*), the thicker portion of the connection line 32A connects together the land 31 and the ground electrode 4, then the impedance of the connection line 32A (in other words, the impedance between the antenna electrode and the ground electrode 4) becomes smaller. The angle of inclination of the integrated radio wave beam becomes an angle which corresponds to the magnitude of the above described impedance. By varying the magnitude of the impedance continuously in this manner, it is possible to vary the inclination of the integrated radio wave beam continuously.

Figure 26A:
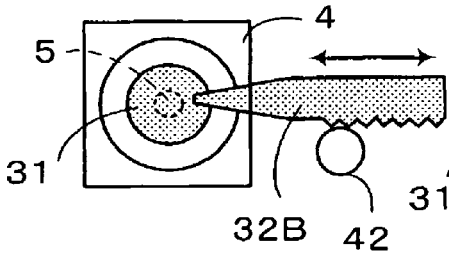
FIG. 26 is a plan view showing a portion of a connection location between a through hole and a ground electrode, in an twelfth embodiment of the microstrip antenna of the present invention.
Figure 26B:
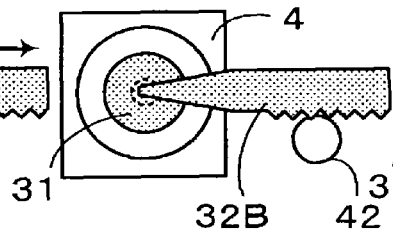
Figure 26C:
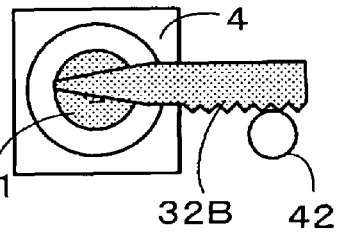

FIG. 26 is a plan view showing a portion of the connection location between the through hole 5 and the ground electrode 4, in a twelfth embodiment of the microstrip antenna of the present invention.

As shown in FIGS. 26(*a*) through 26(*c*), it is arranged for the connection line 32B of a shape which gets continuously thinner towards its end (i.e. whose cross sectional area becomes smaller) to be shifted in a straight line through a certain distance range by an actuator 42. The same beneficial effect in operation is obtained as in the case of the embodiment of FIG. 25.

Figure 27:
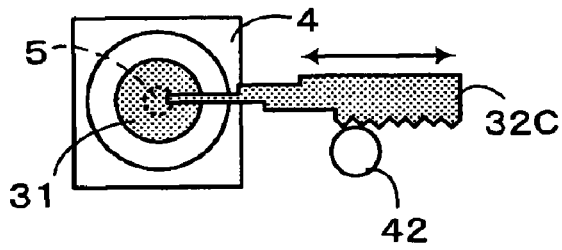
FIG. 27 is a plan view showing a portion of a connection location between a through hole and a ground electrode, in an thirteenth embodiment of the microstrip antenna of the present invention.

FIG. 27 is a plan view showing a portion of the connection location between the through hole 5 and the ground electrode 4, in a thirteenth embodiment of the microstrip antenna of the present invention.

As shown in FIG. 27, it is arranged for the connection line 32C of a shape which gets thinner (i.e. whose cross sectional area becomes thinner) stepwise towards its end to be shifted in a straight line through a certain distance range by an actuator 42. Due to this, it is possible to change the inclination of the integrated radio wave beam in a stepwise manner.

Figure 28A:
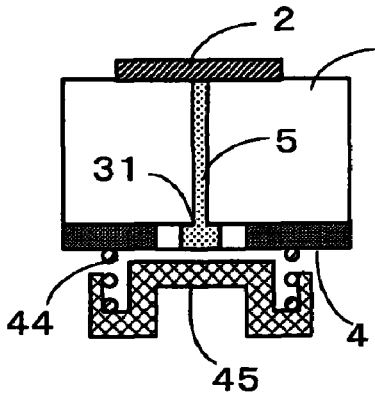
FIG. 28 is a plan view showing a portion of a connection location between a through hole and a ground electrode, in an fourteenth embodiment of the microstrip antenna of the present invention.
Figure 28B:
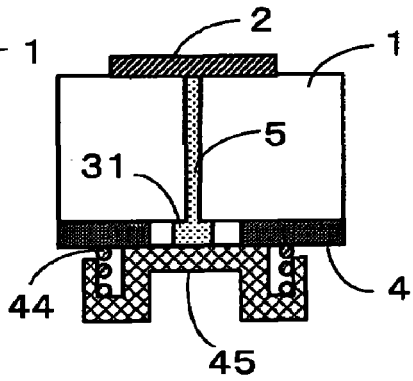

FIG. 28 is a sectional view showing a portion of the connection location between the through hole 5 and the ground electrode 4, in a fourteenth embodiment of the microstrip antenna of the present invention.

In the state shown in FIG. 28(*a*), a movable electrode 45 is impelled away from the ground electrode 4 and the land 31 by the resilient force of a spring 44, so that the impedance Z between the land 31 and the ground electrode 4 (in other words, between an antenna electrode and the ground electrode 4) becomes maximum. And, in the state shown in FIG. 28(*b*), the movable electrode 45 is perfectly contacted against the land 31 and the ground electrode 4 against the resistance of the spring 44, so that the impedance Z between the land 31 and the ground electrode 4 (in other words, between the antenna electrode and the ground electrode) becomes minimum. In this manner, the impedance between the antenna electrode and the ground electrode 4 is changed over in two stages. According to this, the direction of the integrated radio wave beam is changed in two stages.

Figure 29A:
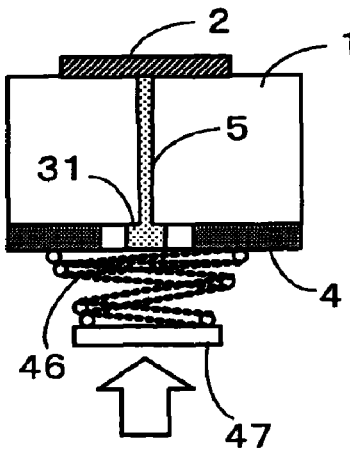
FIG. 29 is a plan view showing a portion of a connection location between a through hole and a ground electrode, in an fifteenth embodiment of the microstrip antenna of the present invention.
Figure 29B:
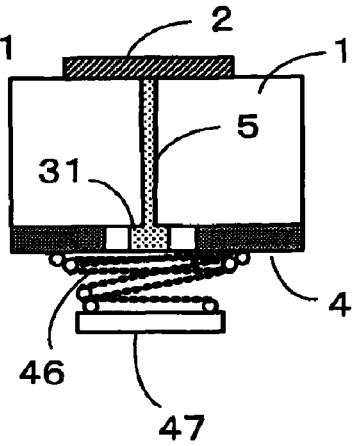
Figure 29C:
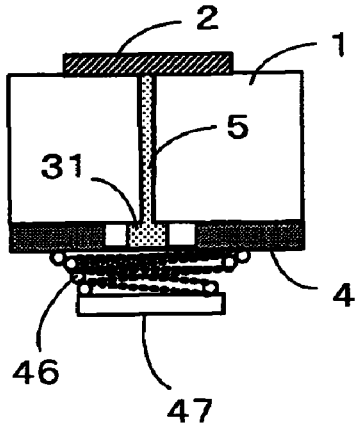

FIG. 29 is a sectional view showing a portion of the connection location between the through hole 5 and the ground electrode 4, in a fifteenth embodiment of the microstrip antenna of the present invention.

As shown in FIG. 29(*a*), a movable electrode 47 is impelled away from the ground electrode 4 and the land 31 by the resilient force of a spring 46 to just a predetermined maximum distance. At this time, the electrostatic capacity (C) between the land 31 and the ground electrode 4 via a connection plate 45 becomes minimum, and accordingly the impedance Z between the land 31 and the ground electrode 4 (in other words, between an antenna electrode and the ground electrode 4) becomes maximum. And when, as shown in FIG. 29(*b*), the movable electrode 47 is slightly approached towards the land 31 and the ground electrode 4 against the resistance of the spring 44, then the electrostatic capacity (C) between the land 31 and the ground electrode 4 becomes greater, so that the impedance Z between the land 31 and the ground electrode 4 (in other words, between the antenna electrode and the ground electrode 4) becomes smaller. And when, as shown in FIG. 29(*c*), the movable electrode 47 is further brought closer towards the land 31 and the ground electrode 4 against the resistance of the spring 44, then the electrostatic capacity (C) between the land 31 and the ground electrode 4 becomes yet greater, so that the impedance Z between the land 31 and the ground electrode 4 (in other words, between the antenna electrode and the ground electrode 4) becomes yet smaller. In this manner, the impedance between the antenna electrode and the ground electrode 4 is varied over continuously. And, according to this, the direction of the integrated radio wave beam is varied continuously.

The microstrip antenna according to the present invention as described above can be applied as a high frequency sensor for detection of a body or the like. Such a high frequency sensor comprises a transmission antenna which utilizes a microstrip antenna, a reception antenna for receiving a reflected wave or a transmitted wave from a body due to a radio wave outputted from the transmission antenna, and a processing circuit for receiving and processing the electrical signal from the reception antenna. Here, it is possible to provide the reception antenna separately from the transmission antenna, but, in particular when receiving a reflected wave, it is also possible to employ the transmission antenna as a reception antenna.

Next, the characteristics of the microstrip antenna according to the present invention will be explained.

According to experiments, the optimum shape for the antenna (in other words, its dimensions vertically and horizontally) are different according to the position of the feed points to the antenna electrodes and the gap between the antenna electrodes, even for the same resonant frequency. When the shape of the antenna changes, the amount of advance or delay of the phase varies, even if the arrangement of the ground contact points are the same, and as a result the angle of emission of the radio wave becomes different.

Figure 30A:
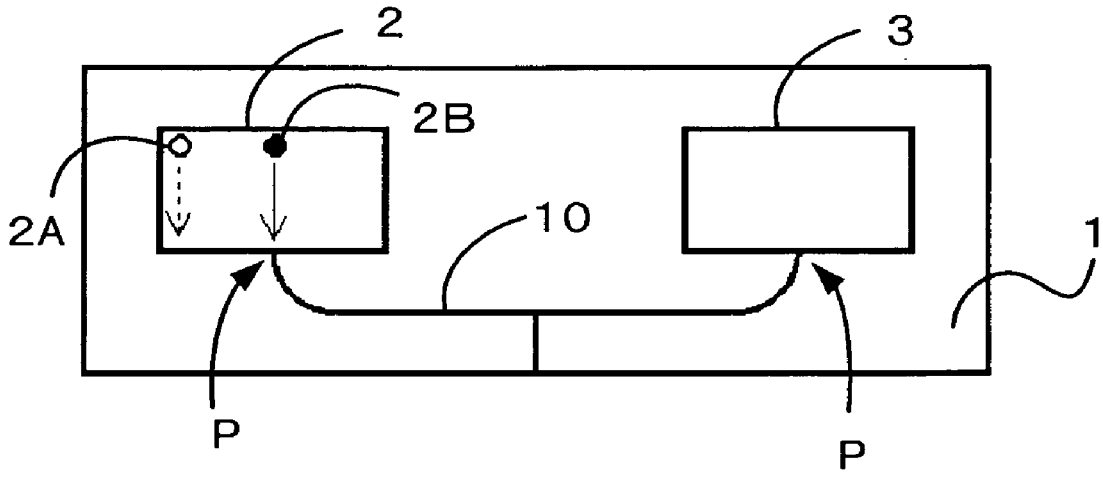
FIG. 30 is a figure showing a variation of the structure of the microstrip antenna of the present invention, and an example of changing the direction of the radio wave.
Figure 30B:
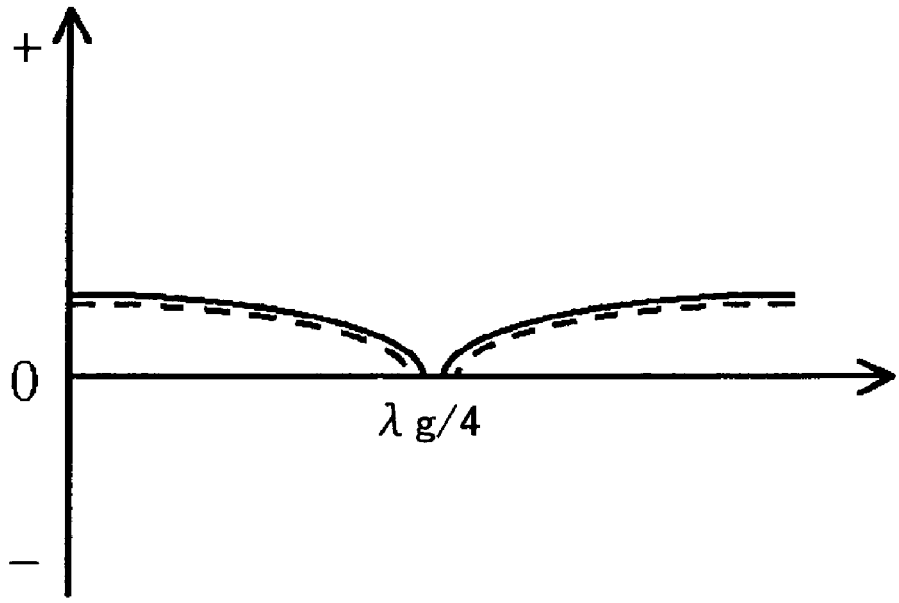
Figure 31:
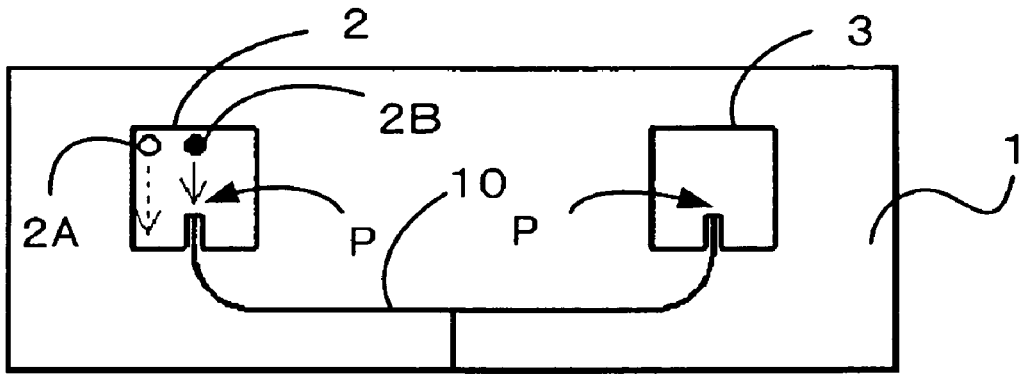
FIG. 31 is a figure showing a variation of the structure of the microstrip antenna of the present invention, and an example of changing the direction of emission of the radio wave.
Figure 31:
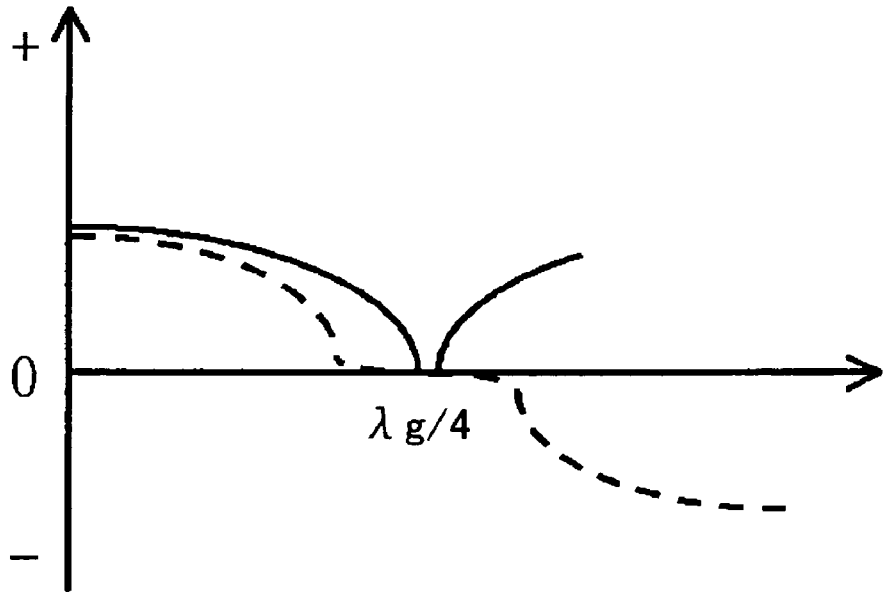
Figure 32A:
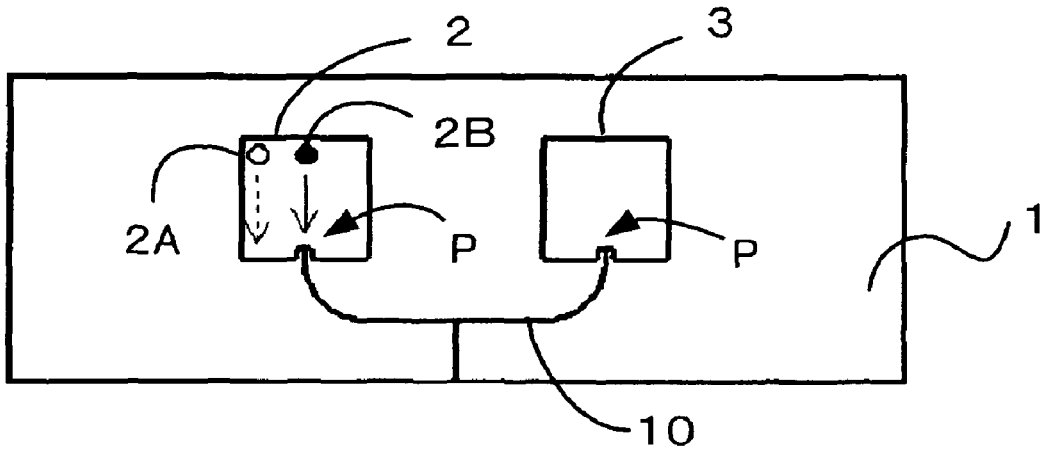
FIG. 32 is a figure showing a variation of the structure of the microstrip antenna of the present invention, and an example of changing the direction of emission of the radio wave.
Figure 32B:
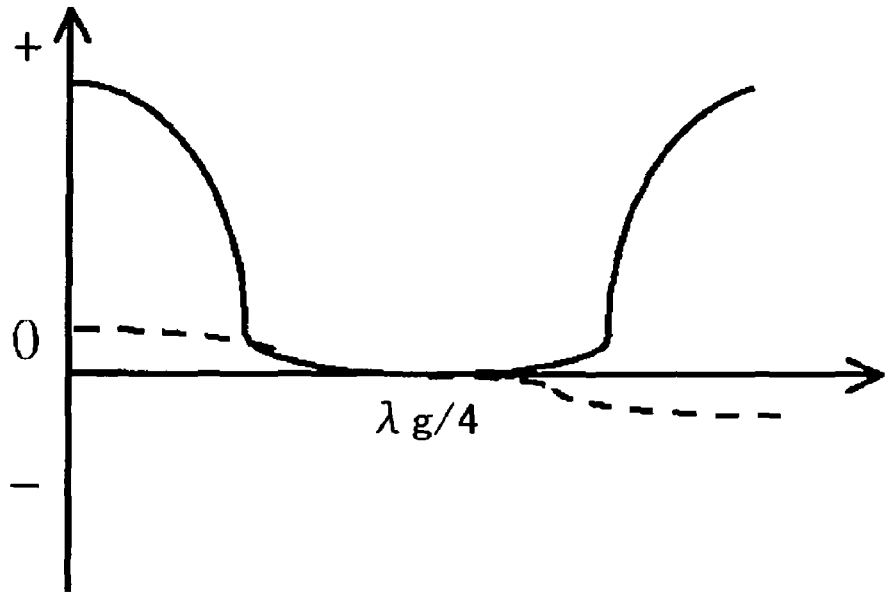

FIGS. 30 through 32 show variations of the structure of an antenna which is excited at 10 GHz: in FIG. 30, the feeds P (the connection spots to the signal transmission lines 10) are disposed upon the edges of the antenna electrodes 2 and 3, while, in FIGS. 31 and 32, these feed points P are disposed in the interiors of the antenna electrodes 2 and 3. The gap between the antenna electrodes 2 and 3 is 15 mm in FIGS. 30 and 31, and is 10 mm in FIG. 32. In the plan views of (a) in these figures, the white circles and the black circles show the positions of the ground contact points 2A and 2B, while, in the graphs of (b) in these figures, the horizontal axis is the position in the direction of the arrow sign of ground contact points 2A and 2B from the feed points P, and the vertical axis is the angle of emission of the integrated radio wave, while the curve of the dotted line shows the change of the angle of emission which has been obtained by experiment in the case of the ground contact point 2A shown by the white circle, and the curve of the solid line shows the change of the angle of emission which has been obtained by experiment in the case of the ground contact point 2B shown by the black circle. It should be understood that here (and the same in the subsequent explanation as well) by "angle of emission" is meant, when the vertical direction to the surface of the antenna electrode (in other words, the emission direction when no contact points are present) is taken as the zero angle, the angle of inclination of the emission direction with respect to this zero angle direction.

Referring to FIG. 30, as shown in FIG. 30(*a*), whether each of the ground contact points 2A and 2B is arranged at the upper left (the white circle) or at the upper center (the black circle) of its antenna electrode 2 in the figure, when the positions of the ground contact points 2A and 2B are changed downwards as shown by the arrow sign, then the angle of emission of the integrated radio wave changes with the same tendency, as shown in FIG. 30(*b*).

In FIGS. 31 and 32, when the ground contact 2B is arranged at the upper center of the antenna electrode (the black circle), the same change as in FIG. 30 is exhibited. However, when the ground contact point 2A is arranged at the upper left of the antenna electrode (the white circle), then the angle of emission changes from the + direction to the − direction symmetrically at the position $\lambda g/4$. And, as will be understood from comparison between FIGS. 31 and 32, the narrower the gap between the antenna electrodes 2 and 3 becomes, the greater does the angle of emission on the side where the phase advances become, and its amount of change is also greater.

Figure 33A:
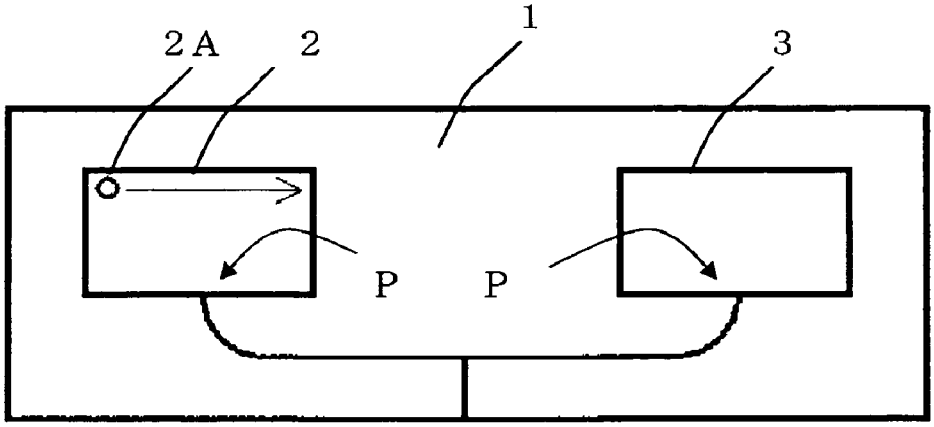
FIG. 33 is a figure showing a variation of the structure of the microstrip antenna of the present invention, and an example of changing the direction of emission of the radio wave.
Figure 33B:
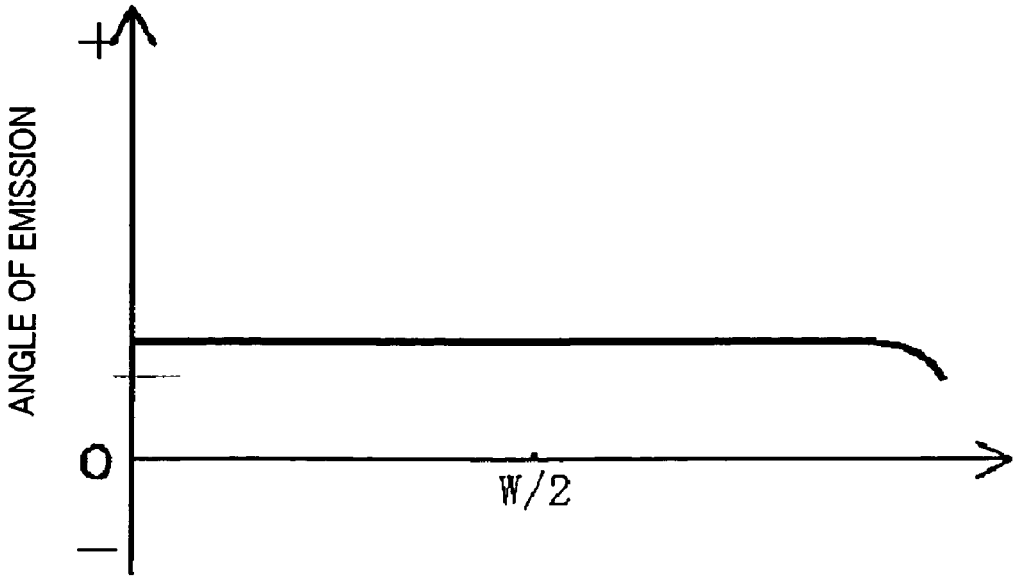
Figure 43A:
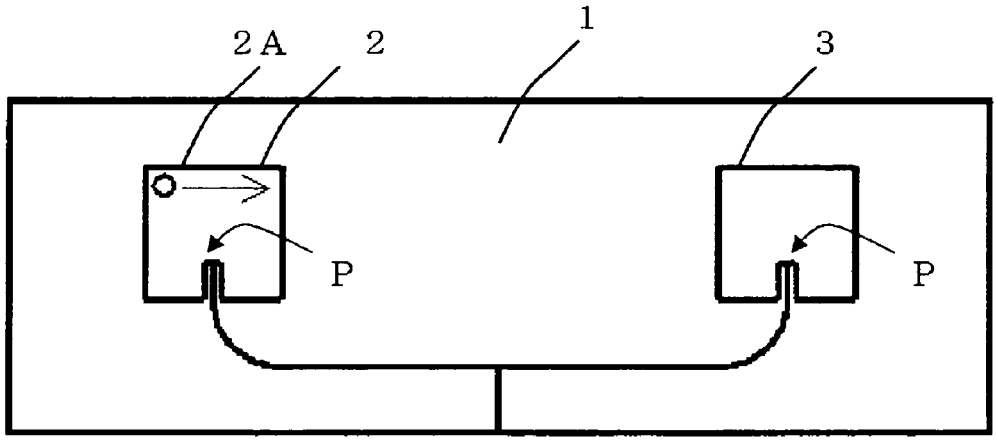
FIG. 43 is a figure showing a variation of the structure of the microstrip antenna of the present invention, and an example of changing the direction of emission of the radio wave.
Figure 43B:
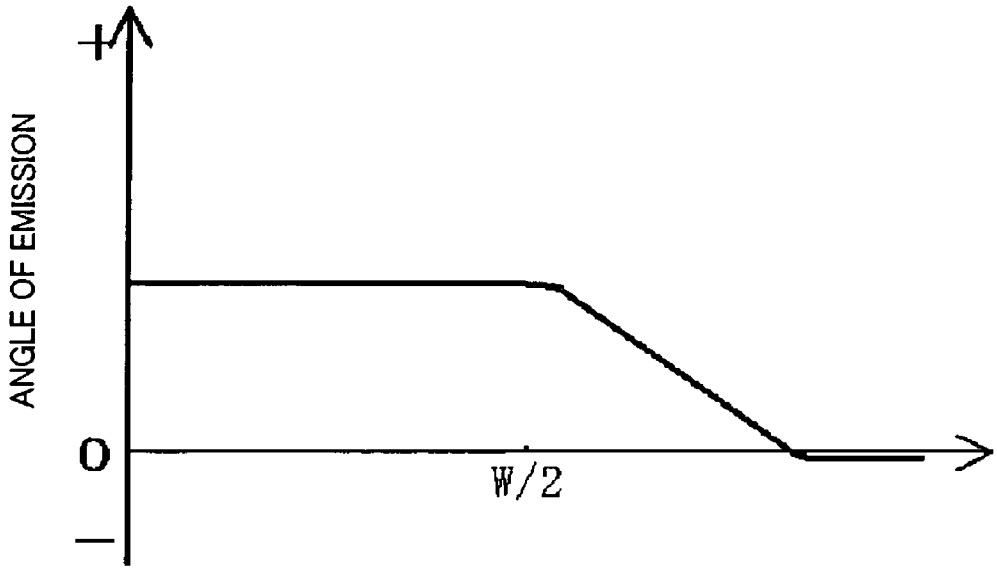
Figure 44A:
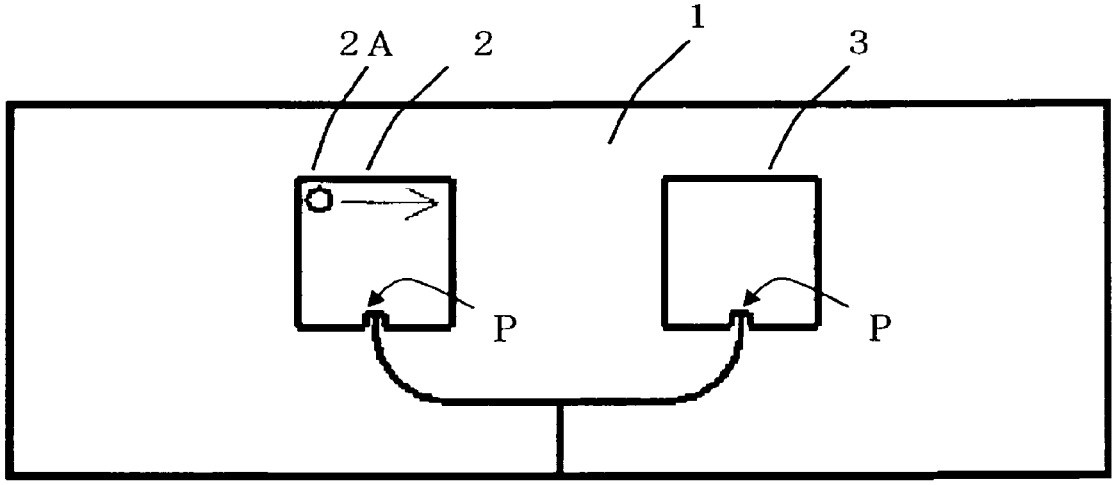
FIG. 44 is a figure showing a variation of the structure of the microstrip antenna of the present invention, and an example of changing the direction of emission of the radio wave.
Figure 44B:
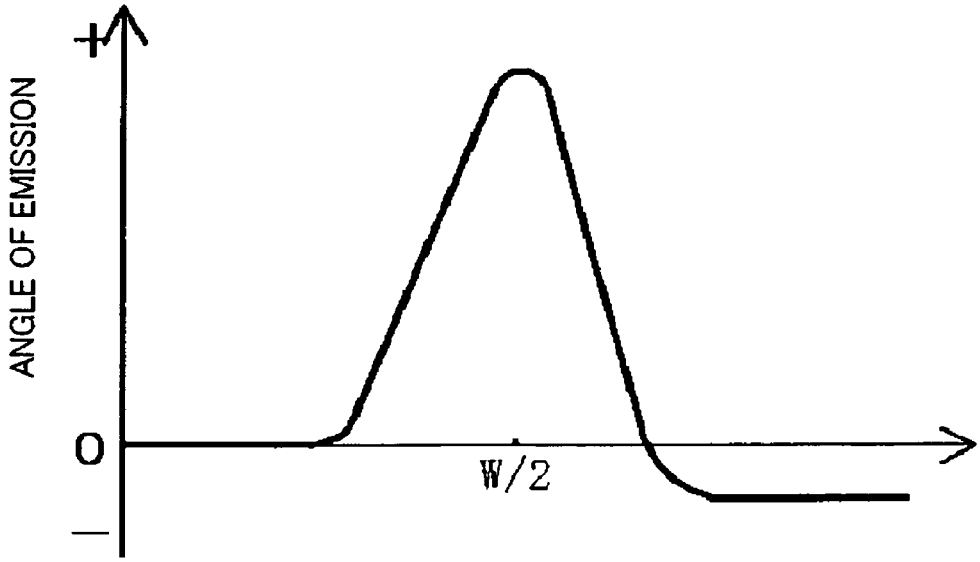

Each of FIGS. 33, 43, and 44 shows an antenna which has the same structure as the ones in the above described FIGS. 30, 31, and 32 respectively; and when, as shown in (a) of each of these figures, the position of the ground contact point 2A of the antenna electrode 2 is set to the neighborhood of the terminal edge on the opposite side from the edge on the side of the feed point P, and this is shifted, as shown by the arrow sign, along that terminal edge from its left end in the figure to its right end in the horizontal direction (the direction directly along the direction from the feed point P towards the terminal edge), then the relationship obtained by experiment between the position of the ground contact point 2A and the angle of emission of the integrated radio wave is shown (in (b) of the figures). It should be understood that, in (b) of each of these figures, the origin 0 of the ground contact point position along the horizontal axis corresponds to the left end position where the ground contact point 2A is positioned in (a) of each of the figures (i.e. to its position most remote from the other antenna electrode 3), and furthermore W denotes the dimension of the antenna electrode 2 in the above described horizontal direction (i.e. its width).

In the case of the antenna of FIG. 33 (which has the same structure as that of FIG. 30), the angle of emission is a constant angle, irrespective of the position of the ground contact point 2A. In the case of the antenna of FIG. 43 (which has the same structure as that of FIG. 31), with the position of the ground contact point 2A more to the left side than the central position (W/2), the angle of emission is constant (and is larger than the maximum angle of emission of the antenna of FIG. 33); but, with the ground contact point 2A more to the right side than the central position (W/2), the angle of emission decreases along with progress in the rightwards direction. And, in the case of the antenna of FIG. 44 (which has the same structure as that of FIG. 32), when the ground contact point 2A is at the central position (W/2), the angle of emission attains its peak (which is larger than the maximum angles of emission of the antennas of FIGS. 33 and 34), while, when the ground contact point 2A is shifted to either side, the angle of emission abruptly decreases.

Thus, the characteristics of the change of the angle of emission changes according to the structure of the antenna. Which antenna structure is to be employed, should be selected or discarded according to the application. However it will be understood from the above described considerations that, with many antenna structures, the maximum angle of emission is obtained by providing one ground contact point in the neighborhood of the terminal edge of the antenna electrode 2 at its central position (W/2) in the direction of the width W. Accordingly, by changing over this ground contact point at the central position of the terminal edge between effective and ineffective (in other words, whether it is connected to ground or not) with a switch or the like, it is possible to obtain the maximum change of the angle of emission with each of these antenna structures. Furthermore, by also providing another ground contact point at a position at which a smaller angle of emission is obtained than at the central position upon the terminal edge, it is possible to perform emission direction control more delicately, by selecting with switches or the like, which of the plurality of ground contact points to make effective, and which ineffective.

Although, here, the above explanation has been provided in terms of the excitation frequency being 10 GHz, if the excitation frequency is higher or lower, the same tendencies as those described above are exhibited, even though the shapes of the antenna electrodes 2 and 3, and the gap between them, are different from those in the case of 10 GHz.

When changing over the angle of emission of the radio wave by selecting one or more of the ground contact points among the plurality of ground contact points, as explained with reference to FIG. 23, it would be possible to employ a structure in which, for each ground contact point, a space is provided between the through hole and the ground electrode, so that they are electrically separated from one another.

Figure 34A:
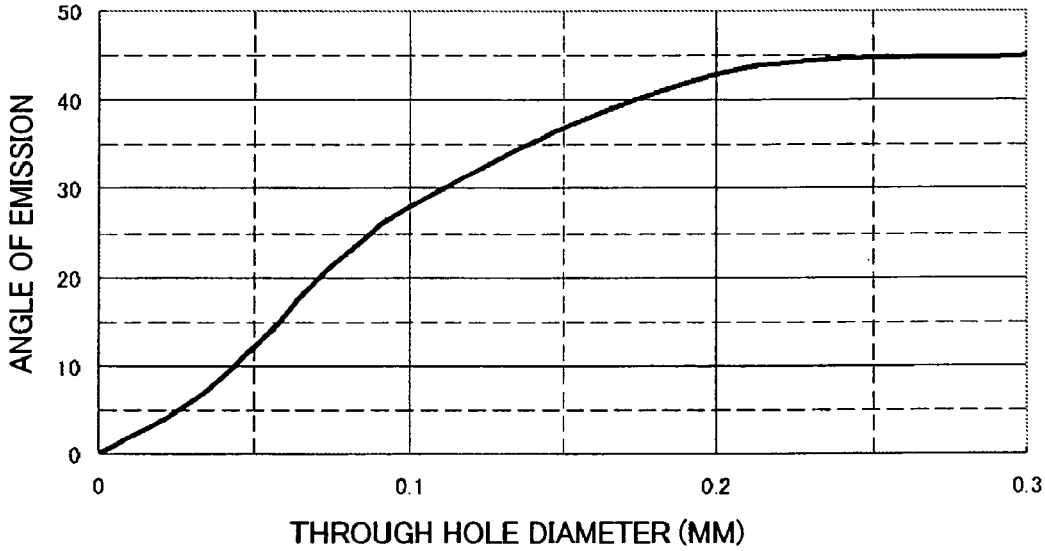
FIG. 34 is a figure showing a relationship, which has been obtained by experiment, between the diameter of a through hole (along the horizontal axis) and the angle of emission of the integrated radio wave (along the vertical axis)

FIG. 34 has been obtained from experiment, and shows the relationship between the diameter of the through hole (along the horizontal axis) and the angle of emission of the integrated radio wave (along the vertical axis). The excitation frequency for the antenna is 10 GHz.

As will be understood from FIG. 34, since the amount of propagation of the high frequency signal which is propagating through the through hole becomes small when the diameter of the through hole is too small, accordingly the change of the angle of emission becomes small. The reason is thought to be due to the fact that, when the diameter of the through hole becomes small, the amount of the high frequency signal which propagates through the through hole becomes small.

Conversely, although the angle of emission becomes large when the diameter of the through hole is made big, at a diameter around, for example, $\phi$0.3 mm (if the excitation frequency is, for example 10 GHz), the angle of emission attains a saturated state. Furthermore, the closer the outer circumference of the through hole becomes to the position of $\lambda/2$ on the antenna, the smaller does the angle of emission become. Accordingly (if the excitation frequency is, for example 10 GHz) it is desirable for the diameter of the through hole to be $\phi$10 ~$\phi$500 μm, and it is particularly effective for it to be $\phi$100~300 μm; and it is appropriate to employ $\phi$100~$\phi$200 μm when providing a plurality of through holes for changing over the angle of emission of the radio wave; while, for changing over the angle of emission by varying the impedance between a single through hole and the ground electrode, it is appropriate to employ $\phi$300 μm, in order to perform the process of opening the hole in the substrate with high efficiency.

It should be understood that the optimum diameter of the through hole changes according to the excitation frequency of the antenna; the higher the excitation frequency becomes, the smaller is it appropriate to make the diameter of the through hole. The reason is considered to be the same as the theory for making a microstrip line (MSL) finer when the frequency becomes high.

Figure 35:
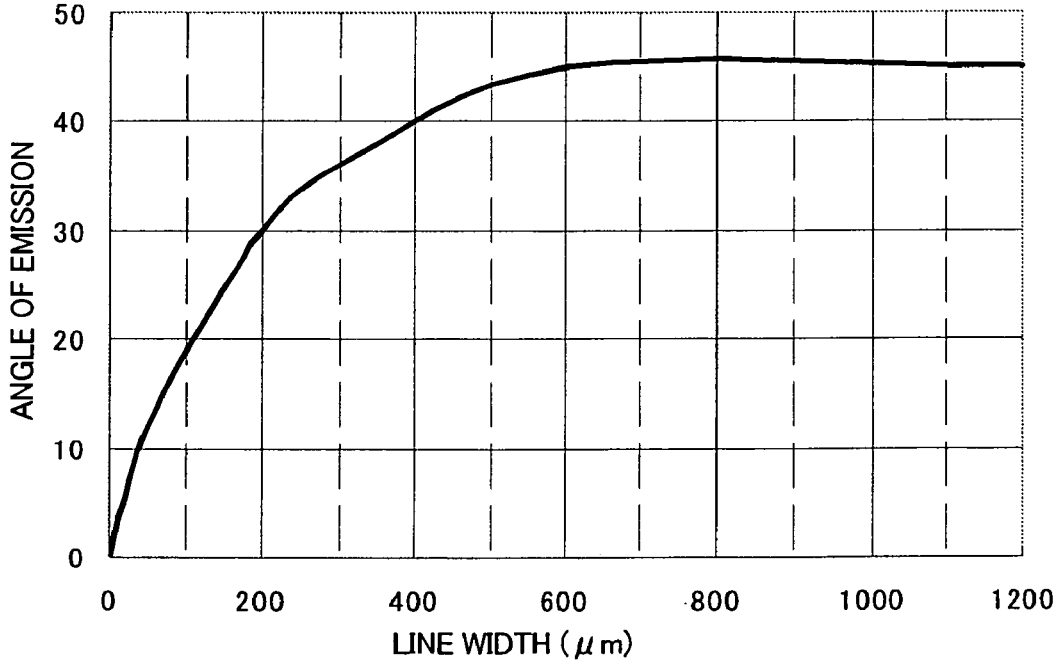
FIG. 35 is a showing a relationship, which has been obtained by experiment, between the line width of a shunt between a through hole and the ground electrode (along the horizontal axis) and the angle of emission of the integrated radio wave (along the vertical axis)

As a method of controlling the angle of emission of the radio wave, as in the various embodiments described above, the through hole may be arranged at a portion of the surface of the antenna electrode which makes the angle of emission be as desired (for example, at a position upon the antenna electrode at which the angle of emission becomes maximum; in other words, for example, the through hole may be arranged at the center of end portion thereof); and, as in the embodiment shown in FIGS. 25 through 27, it would also be possible to employ a structure in which it is arranged to control the angle of emission by changing the line width which shorts between the through hole and the ground electrode. FIG. 35 shows a relationship between line width (along the horizontal axis) and angle of emission (along the vertical axis) which has been obtained experimentally, for a case in which this structure is employed.

Or, in the following way, it is also possible to control the emission angle of the antenna stepwise by controlling the area which shorts between the through hole and the ground electrode in an electrical or a mechanical manner. In other words, it would be possible to employ a structure in which a plurality of plate shaped or needle shaped electrodes of a width (a thickness) of, for example, around 10~100 μm are disposed between the through hole, or a land connected to the through hole, and the ground electrode, and in which, from among those electrodes, an electrode is selected for shorting between the through hole and the ground electrode.

Figure 36:
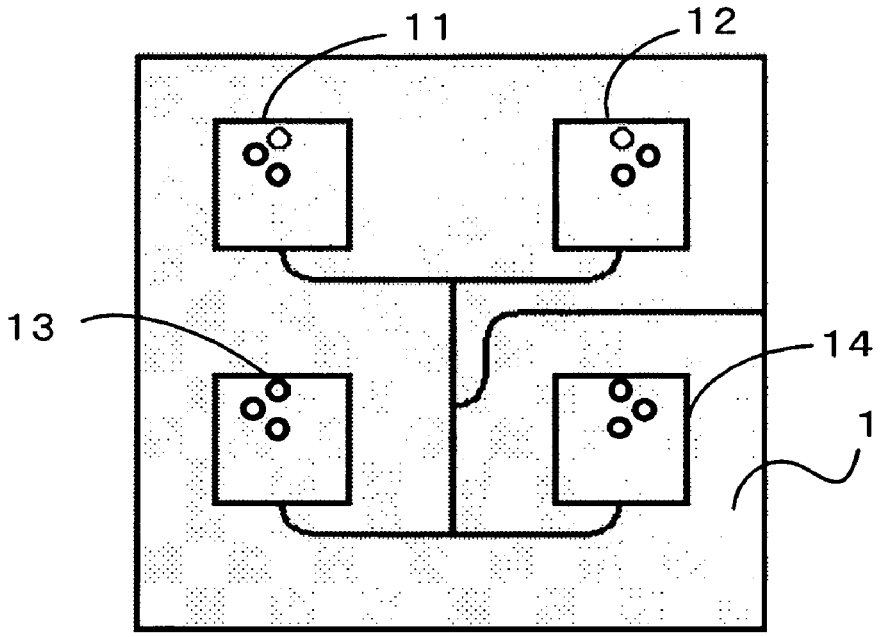
FIG. 36 is a plan view of a sixteenth embodiment of the microstrip antenna of the present invention.

Or, it would also be possible to provide a plurality of ground contact points upon each antenna electrode, and to control the angle of emission stepwise by selecting those. In this case, it is necessary to provide gaps between the center points of the ground contact points which are at least greater than or equal to the thickness of the substrate, or greater than or equal to the diameter of the through holes. Thus, in a case in which the angle of emission of the radio wave does not change even if the position of the ground contact point changes slightly in the width direction of the antenna electrode, it is possible, as for example shown in FIG. 36, to control the angle of emission more finely stepwise if the various ground contact points are arranged in a plurality of positions (the white circle marks) which meander over each of the antenna electrodes 11, 12, 13, and 14.

Figure 37:
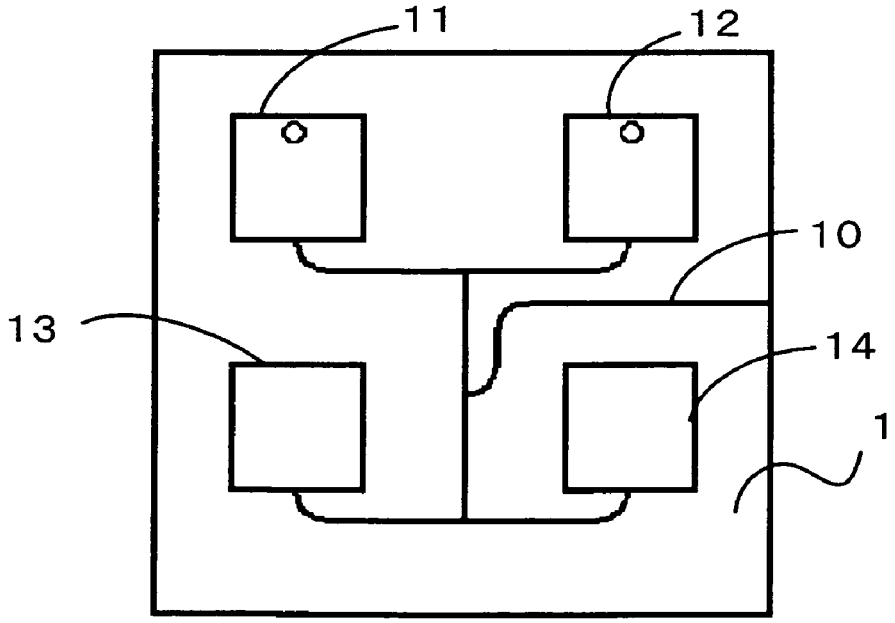
FIG. 37 is a plan view of a seventeenth embodiment of the microstrip antenna of the present invention.

With the antenna shown in FIG. 37, the electrical power is distributed equally, since the lengths of the feed lines 10 which are connected to the various antenna electrodes 11, 12, 13, and 14 are the same.

Figure 38:
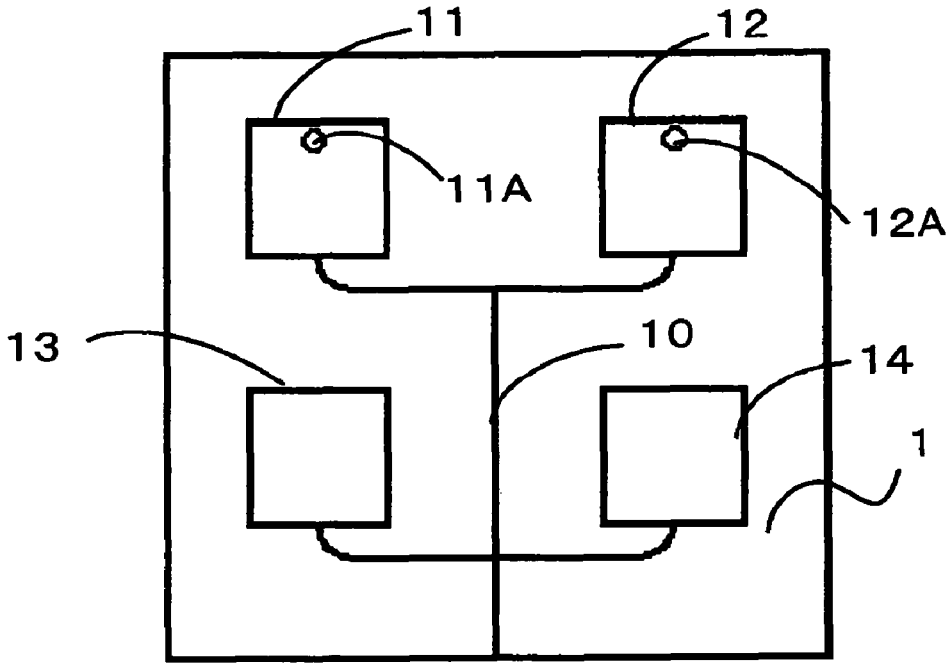
FIG. 38 is a plan view of an eighteenth embodiment of the microstrip antenna of the present invention.
Figure 39:
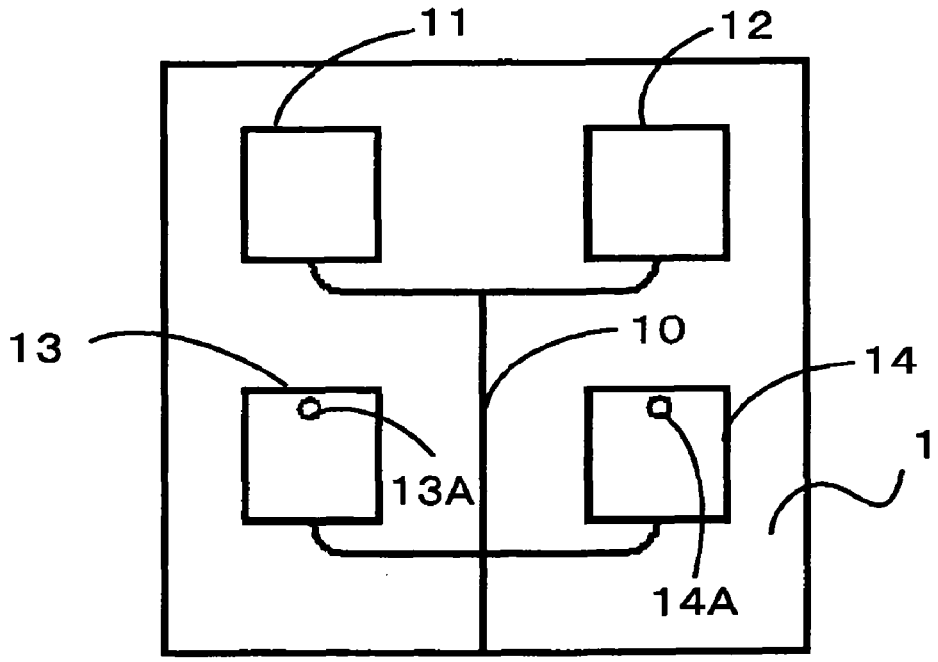
FIG. 39 is a plan view of a nineteenth embodiment of the microstrip antenna of the present invention.

With the antennas shown in FIGS. 38 and 39, the phases of the high frequency signals which are propagated from the lower pair of antenna electrodes 13 and 14 and from the upper pair of antenna electrodes 11 and 12 are the same, but, since the lengths of the feed lines 10 which are connected to the two lower antenna electrodes 13 and 14 are shorter than the lengths of the feed lines 10 which are connected to the two upper antenna electrodes 11 and 12, accordingly the amount of emitted electrical power is greater for the two lower antenna electrodes 13 and 14 than for the two upper antenna electrodes 11 and 12. With the antenna shown in FIG. 38, the ground contact points 11A and 12A are provided upon the upper ones 11 and 12 of the antenna electrodes for which the amount of emitted electrical power is the smaller, while, by contrast, with the antenna shown in FIG. 39, the ground contact points 13A and 14A are provided upon the lower ones 13 and 14 of the antenna electrodes for which the amount of emitted electrical power is the larger. Although the amount of emitted electrical power becomes smaller due to arranging the ground contact points upon the antenna electrodes and connecting them to the ground electrode, as shown in FIG. 38, by arranging the ground contact points 11A and 12A upon those antennas 11 and 12 for which the amount of emitted electrical power is the smaller, it is possible to suppress the decrease of emitted electrical power due to the ground contact points 11A and 12A.

Furthermore, in relation to the three types of antenna shown in FIGS. 37 through 39, if the gaps between their antenna electrodes are the same, to compare the amount of electrical power emitted from each of these antennas, then:

FIG. 39 (for example 0.28 mW)<FIG. 37 (for example 0.48 mW)<FIG. 38 (for example 0.68 mW).

On the other hand, to compare the magnitude of change of the angle of emission:

FIG. 38 (for example 39°)<FIG. 37 (for example 45°) <FIG. 39 (for example 57°).

Accordingly, each of the above three types of structure should be used appropriately, according to whether emphasis is placed upon the emitted power, or emphasis is placed upon the change of angle.

By using micromachining technology to construct dielectric concavo-convex lenses or reflecting mirrors upon this antenna, the characteristics of the antenna may be enhanced by yet a further factor.

Figure 40:
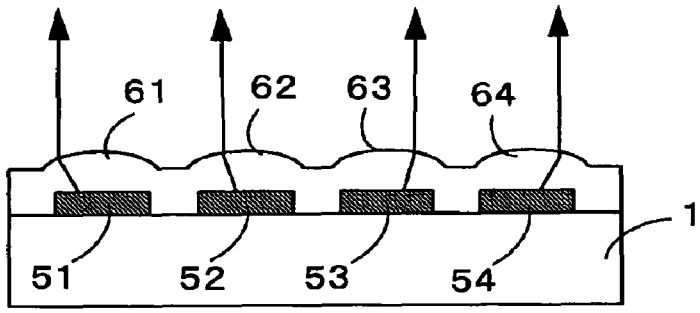
FIG. 40 is a plan view of a twentieth embodiment of the microstrip antenna of the present invention.

In the embodiment shown in FIG. 40, dielectric convex lenses 55, 56, 57, and 58 are provided upon the front surfaces of the antenna electrodes 51, 52, 53, and 54 respectively, so that the angle of emission of the integrated radio wave is changed according to the theory of the present invention. The refractive index of each of these dielectric convex lenses 55, 56, 57, and 58 is set appropriately. The radio wave beams which are emitted from each of the antenna electrodes 51, 52, 53, and 54 are condensed as shown by the arrow signs, and the resolution is thereby enhanced. It should be understood that, the known structure may be employed for each of the dielectric convex lenses 55, 56, 57, and 58 itself.

Figure 41:
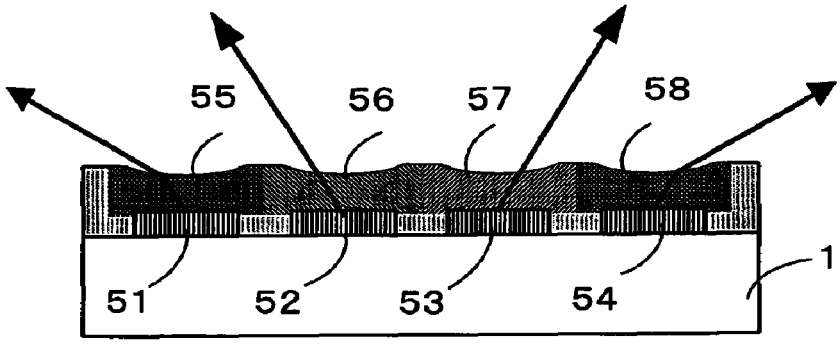
FIG. 41 is a plan view of a twenty-first embodiment of the microstrip antenna of the present invention.

Furthermore, in the embodiment shown in FIG. 41, dielectric concave lenses 55, 56, 57, and 58 are provided upon the front surfaces of the antenna electrodes 51, 52, 53, and 54 respectively, so that the angle of emission of the integrated radio wave is changed according to the theory of the present invention. The refractive index of each of these dielectric concave lenses 55, 56, 57, and 58 is set appropriately. In this case, the radio wave beams are radiated at a wide angle, as shown by the arrow sign. It should be understood that, for each of the dielectric concave lenses 55, 56, 57, and 58 itself, a device of a per se known structure may be employed.

Figure 42:
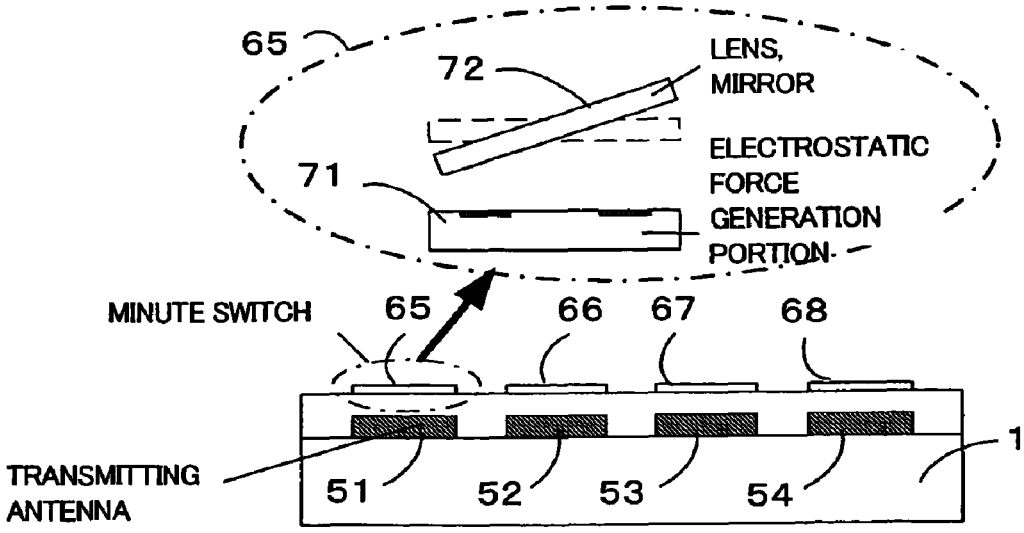
FIG. 42 is a plan view of a twenty-second embodiment of the microstrip antenna of the present invention.

Furthermore, in the embodiment shown in FIG. 42, minute beam direction changeover switches 65, 66, 67, and 68 are provided on the front surfaces of antenna electrodes 51, 52, 53, and 54 respectively, so that the angle of emission of the radio wave beam is changed over according to the theory of the present invention. These beam direction changeover switches 65, 66, 67, and 68 are devices which can change over the direction of the radio wave beams using radio wave reflection mirrors (or lenses), and, for them, devices of per se known structure may be employed. For example, as shown in the figure, each of these beam direction changeover switches 65, 66, 67, and 68 may comprise an electrostatic force generation portion 71 and a radio wave reflection mirror (or lens) 72, and its attitude (inclination) may, for example, be changed over in two steps due to the electrostatic force which is generated by the electrostatic force generation portion 71. According to the theory of the present invention, by changing over each of these beam direction changeover switches 65, 66, 67, and 68, since it is possible to incline the radio wave beam from the vertical direction with respect to the substrate through some constant angle (for example 45°), accordingly it is possible to scan the center of the radio wave beam, not only over some narrow area, but also over a wider area (for example over a full azimuth of 180°).

As will be understood from the above description, by changing the amount of transmission of the microwave signal through the through hole which connects a portion of the antenna electrodes among the plurality of antenna electrodes and the disposition electrode (in other words, by varying the impedance of the through hole), the amount of phase of the microwave signal at this antenna electrode is varied, and thereby the angle of inclination of the direction of the integrated radio wave beam which is emitted from the plurality of antenna electrodes is varied. By controlling the amount of transmission of the above described signal in a large number of steps, or continuously, it is possible to emit the radio wave beam at various different angles. As methods of controlling the amount of transmission of the signal through the through hole, apart from the methods employed in the various embodiments described above, it would be possible to employ, for example:

(1) a method of using a semiconductor switch (for example a FET) which acts as a switch for opening and closing the connection through the through hole, and, by controlling the gate voltage of this FET, adjusting the amount of signal transmission between its source and its drain; or (2) a method of connecting, to the same antenna electrode, a plurality of through holes whose amount of signal transmission is limited to be smaller than the saturation level, and selecting, from among those through holes, any desired number of through holes in any desired positions to be ON;

or the like.

Figure 45:
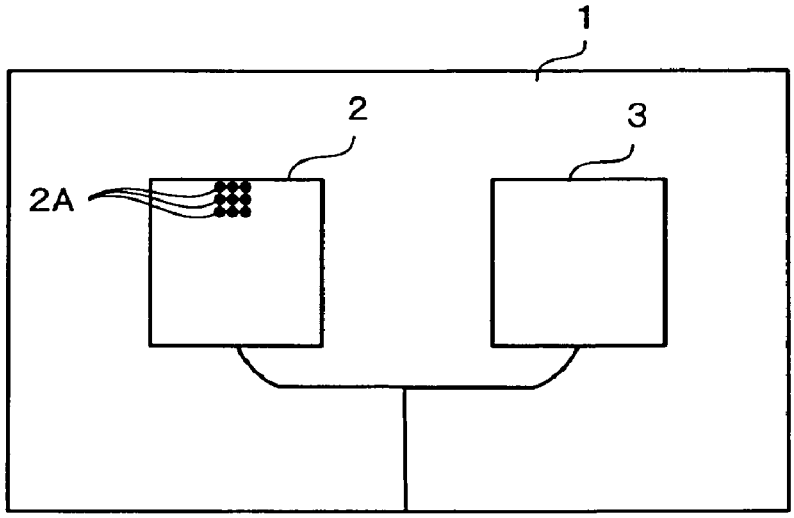
FIG. 45 is a plan view of antenna electrodes of a microstrip antenna according to a twenty-third embodiment of the microstrip antenna of the present invention.
Figure 46:
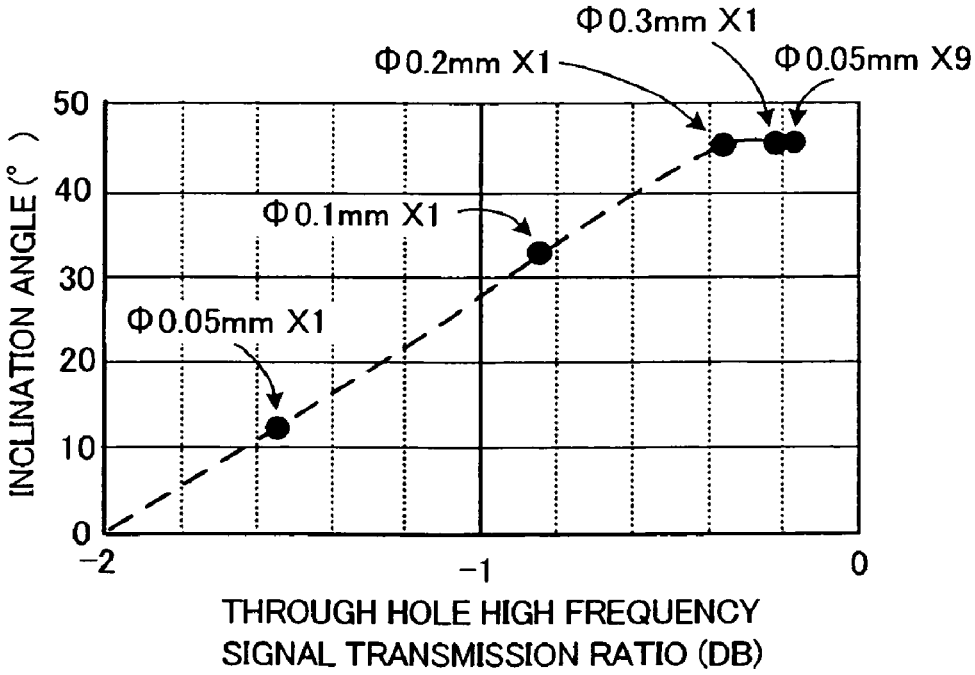
FIG. 46 is a figure, for the microstrip antenna of FIG. 45, showing examples of the relationships between the diameter of the through holes, the amount of signal transmission, and the angle of inclination of the radio wave beam.
Figure 47A:
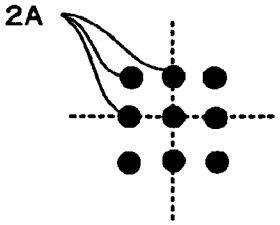
Figure 47B:
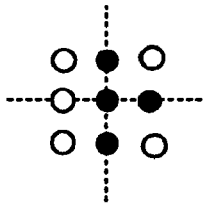
Figure 47C:
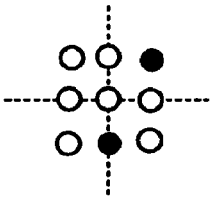
Figure 47D:
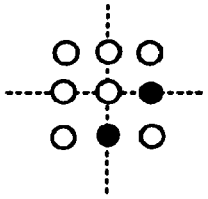
Figure 47E:
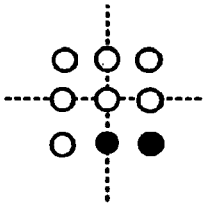
Figure 47F:
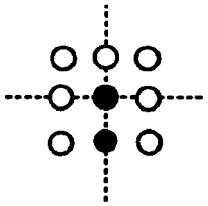

FIG. 45 is a plan view of the antenna electrodes of a microstrip antenna according to a twenty-third embodiment of the present invention, in which the above described method (2) is employed. And FIG. 46 is a figure showing an example of the relationship, with the microstrip antenna of FIG. 45, between the diameter of the through holes, the amount of signal transmission, and the angle of inclination of the radio wave beam. In FIG. 45, a direction which is perpendicular to the surface of the substrate is considered to have an angle of inclination of 0°.

As shown in FIG. 45, upon the surface of the substrate 1, there are two antenna electrodes 2 and 3 which are in a laterally symmetric shape and positional relationship, and one of these antenna electrodes 2 is connected to a plurality of ground contact points 2A, 2A, . . . (for example nine) via a plurality of through holes (for example nine) not shown in the figure. In the example shown in the figure, the nine ground contact points 2A, 2A, . . . are collected together in the vicinity of the terminal edge of the antenna electrode 2 and are arranged in the form of a 3×3 matrix, but this is only given as one example; it would be possible to employ various different numbers and arrangements of ground contact points in variant embodiments. At connection spots between a ground electrode on the rear surface of the substrate 1 and the nine through holes, there are provided nine switches for turning these through holes ON and OFF, although these features are not shown in the figure. By controlling these switches, it is possible to select and turn on any desired one or more of these through holes, and thereby it is possible to vary the amounts of transmission of the signal through the through holes, thus varying the direction of the radio wave beam.

In FIG. 46, for microstrip antennas of structures like that of FIG. 45, there are shown concrete examples of the amount of signal transmission through the through hole or holes which were turned ON (the ratio of the signal energy which was transmitted through the through holes to the total signal energy which was supplied to the antenna electrodes) and the angle of inclination of the radio wave beam, for when only one of the through holes 5 was turned ON when the diameters of the through holes were respectively 0.05 mm, 0.2 mm, and 0.3 mm, and for when all of the nine through holes were turned ON when the diameter of the through holes was 0.05 mm. As will be understood from FIG. 45, even in the state when only one of the through holes is ON, when the diameter of the through hole becomes greater than or equal to 0.2 mm, the amount of signal transmission through the through hole reaches the saturation value. On the other hand, when the diameter of the through hole 5 is less than or equal to 0.1 mm, then the amount of signal transmission through a single through hole 5 is less than or equal to a fraction of the saturation value, and accordingly, by varying the number of the through holes which are turned ON, it is possible to change the amount of signal transmission over several stages, and it is possible to vary the angle of inclination of the radio wave beam over several stages.

FIG. 47 shows, for a case in which the diameter of the through holes in the microstrip antenna of FIG. 45 is 0.05 mm, concrete examples, when the through holes which are ON are selected, of the relationship between the angle of inclination of the radio wave beam (the direction which is perpendicular to the surface of the substrate is 0°) and the directivity and the gain. In FIG. 47, the black circles indicate the ground contact points of the through holes which are turned ON, while the white circles indicate the ground contact points of the through holes which are turned OFF.

As will be understood from FIG. 47, the angle of inclination of the radio wave beam may be varied by varying the number of the through holes which are turned ON. As the general tendency, the greater is the number of the through holes which are turned ON, the greater does the angle of inclination become. Even if the number of the through holes which are turned ON is the same, the angle of inclination is different according to the positions of those through holes. Furthermore, the directivity and the gain of the radio wave beam also change according to the selection of the through holes which are turned ON. Even though the selection of the through holes which are turned ON is different, sometimes it happens that almost the same angle of inclination is obtained, and in this case as well, the directivity and the gain become different according to the selection of the through holes. It is best to utilize, from among the various options for the through holes for which the desired angle of inclination is obtained, that one from which the more desirable directivity and gain are obtained.

Figure 48:
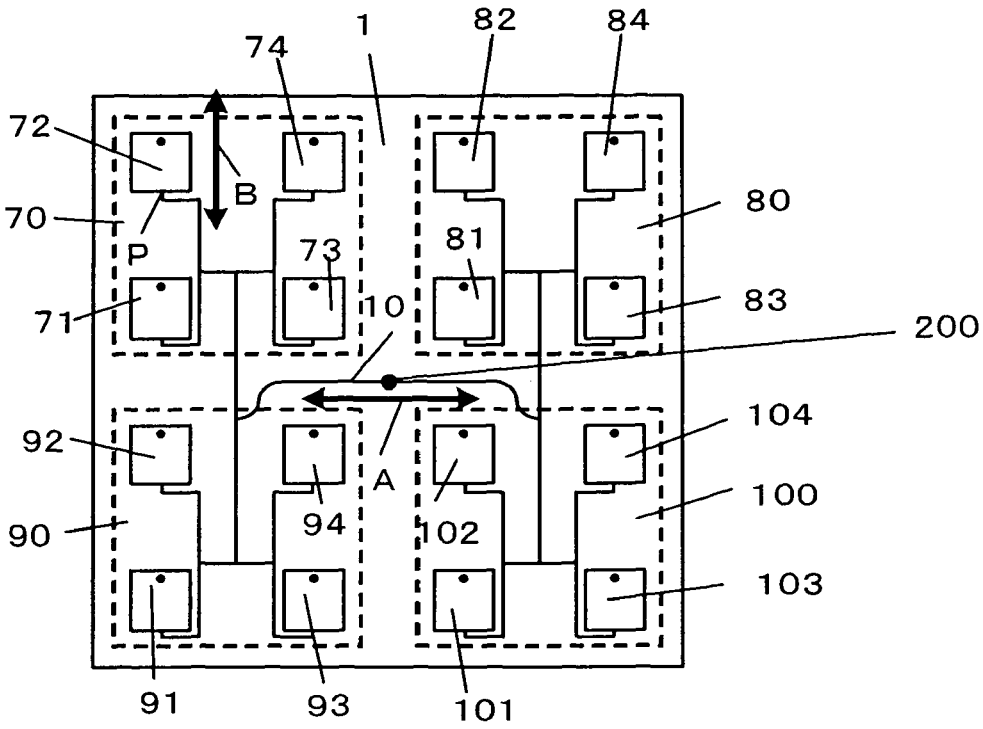
FIG. 48 is a plan view of antenna electrodes of a microstrip antenna according to a twenty-fourth embodiment of the microstrip antenna of the present invention.

FIG. 48 is a plan view of an antenna electrode of a microstrip antenna according to a twenty-fourth embodiment of the present invention.

As shown in FIG. 48, a plurality of (for example, four) electrode groups 70, 80, 90, 100 are arranged upon the surface of a substrate 1 in the form of a 2×2 matrix. The first electrode group 70 consists of a plurality of (for example, four) antenna electrodes 71, 72, 73, and 74, and these antenna electrodes 71, 72, 73, and 74 are arranged in the form of a 2×2 matrix. The antenna electrodes 71 and 73 are in a laterally symmetric shape and positional relationship, and the antenna electrodes 72 and 74 are also in a laterally symmetric shape and positional relationship. The electrode pattern of the antenna electrodes 71 and 73 is substantially the same as the electrode pattern of the antenna electrodes 72 and 74. The lengths of the feed lines 10 to the antenna electrodes 71, 72, 73, and 74 are all the same.

The second electrode group 80 consists of a plurality of (for example, four) antenna electrodes 81, 82, 83, and 84; the third electrode group 90 also consists of a plurality of (for example, four) antenna electrodes 91, 92, 93, and 94; and the fourth electrode group 100 also consists of a plurality of (for example, four) antenna electrodes 101, 102, 103, and 104; and the electrode pattern of each of these is the same as the electrode pattern of the first electrode group 70. The branching off directions of the feed lines 10 from the root feed point 200 which is almost at the center of the substrate 1 (which are shown by the arrow signs A) and the directions of excitation of the various antenna electrodes 71~74, 81~84, 91~94, and 101~104 (the directions shown by the arrow signs B, which, as shown for the representative electrode 72, are from the feed point of each antenna electrode to its terminal edge) are mutually orthogonal, and do not agree with one another. As shown by the black circular signs in FIG. 48, on all of the antenna electrodes, there is provided a ground contact point on the terminal edge at the opposite side to the feed point. A through hole not shown in the figure is connected to each of these ground contact points, and respective switches are connected to these through holes and turn them ON and OFF. These switches can be independently controlled.

With this microstrip antenna, by using the plurality of electrode groups 70, 80, 90, and 100 selectively, it is possible to change the direction of the integrated radio wave beam in two directions, both vertically and horizontally as seen in plan view. FIGS. 49 through 52 show concrete examples of concrete methods for changing the direction of the radio wave beam vertically and horizontally. In FIGS. 49 through 52, the hatching on certain ones of those antenna electrodes means that the through holes which are connected to those antenna electrodes are ON, while the lack of hatching on others of those antenna electrodes means that the through holes which are connected to those antenna electrodes are OFF.

Figure 49:
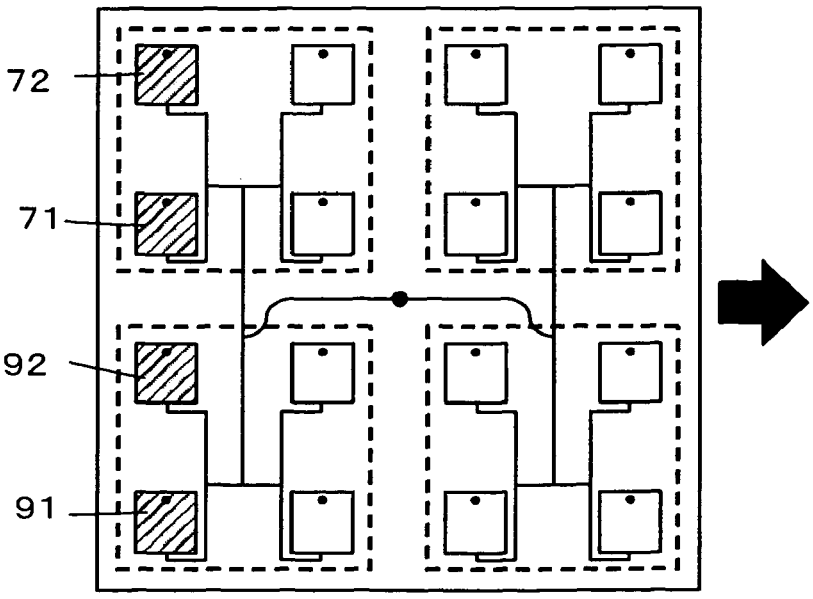
FIG. 49 is a plan view showing a method for inclining the radio wave beam in the rightward direction, with the microstrip antenna of FIG. 48.
Figure 50:
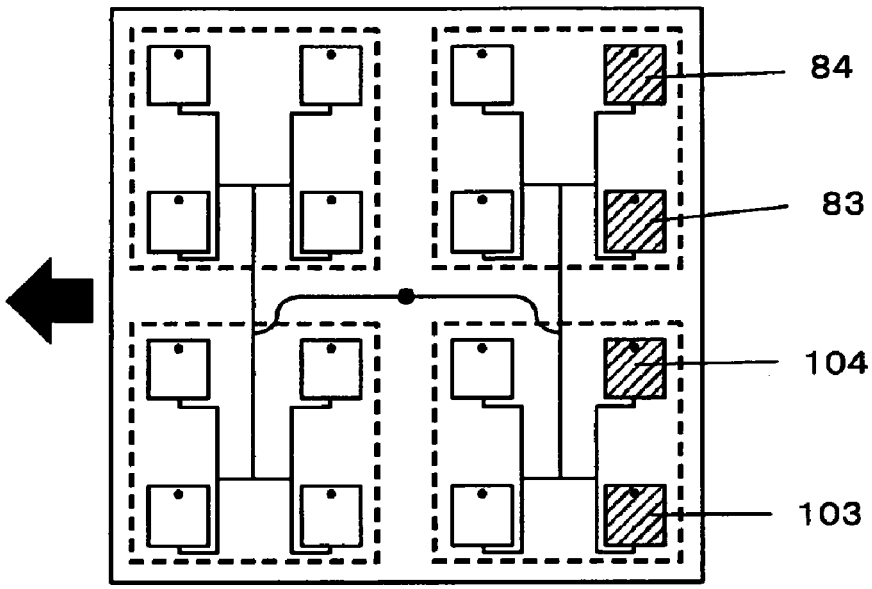
FIG. 50 is a plan view showing a method for inclining the radio wave beam in the leftward direction, with the microstrip antenna of FIG. 48.

As shown in FIGS. 49 and 50, it is possible to change the direction of the radio wave beam in the horizontal direction in the figure by using a set of antenna electrodes which are positioned along an end in the horizontal direction in the figure. In other words, when as shown in FIG. 49 only the through holes of the antenna electrodes 71, 72, 91, and 92 which are disposed at the left edge are turned ON, then the integrated radio wave beam is inclined to the right side, as shown by the arrow sign. Conversely, when as shown in FIG. 50 only the through holes of the antenna electrodes 83, 84, 103, and 104 which are disposed at the right edge are turned ON, then the integrated radio wave beam is inclined to the left side, as shown by the arrow sign.

Figure 51:
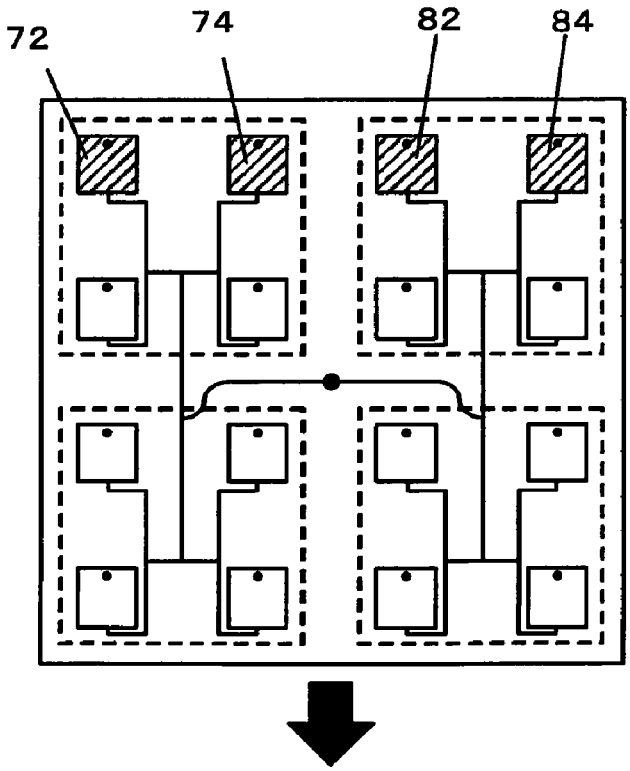
FIG. 51 is a plan view showing a method for inclining the radio wave beam in the downward direction, with the microstrip antenna of FIG. 48.
Figure 52:
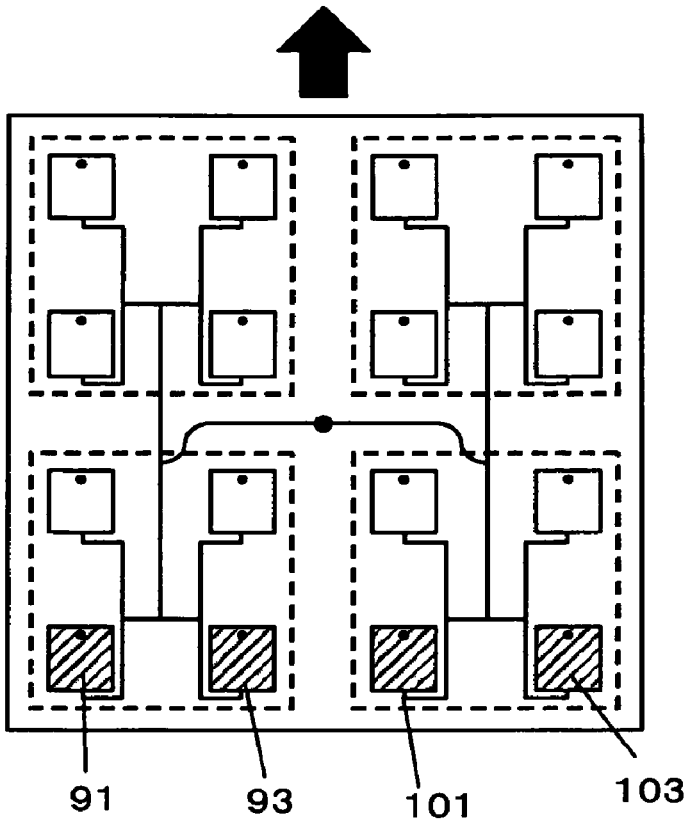
FIG. 52 is a plan view showing a method for inclining the radio wave beam in the upward direction, with the microstrip antenna of FIG. 48.

Furthermore, as shown in FIGS. 51 and 52, it is possible to change the direction of the radio wave beam in the vertical direction in the figure by using a set of antenna electrodes which are positioned along an end in the vertical direction in the figure. In other words, when as shown in FIG. 51 only the through holes of the antenna electrodes 72, 74, 82, and 84 which are disposed at the upper edge are turned ON, then the integrated radio wave beam is inclined to the lower side, as shown by the arrow sign. Conversely, when as shown in FIG. 52 only the through holes of the antenna electrodes 91, 93, 101, and 103 which are disposed at the lower edge are turned ON, then the integrated radio wave beam is inclined to the upper side, as shown by the arrow sign.

Figure 53:
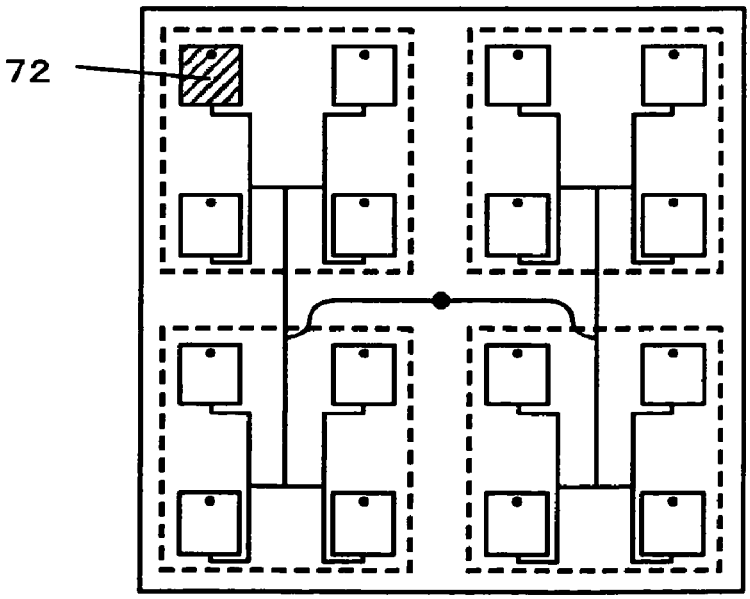
FIG. 53 is a plan view showing a method for adjusting the magnitude of the angle of inclination of the radio wave beam, with the microstrip antenna of FIG. 48.
Figure 54:
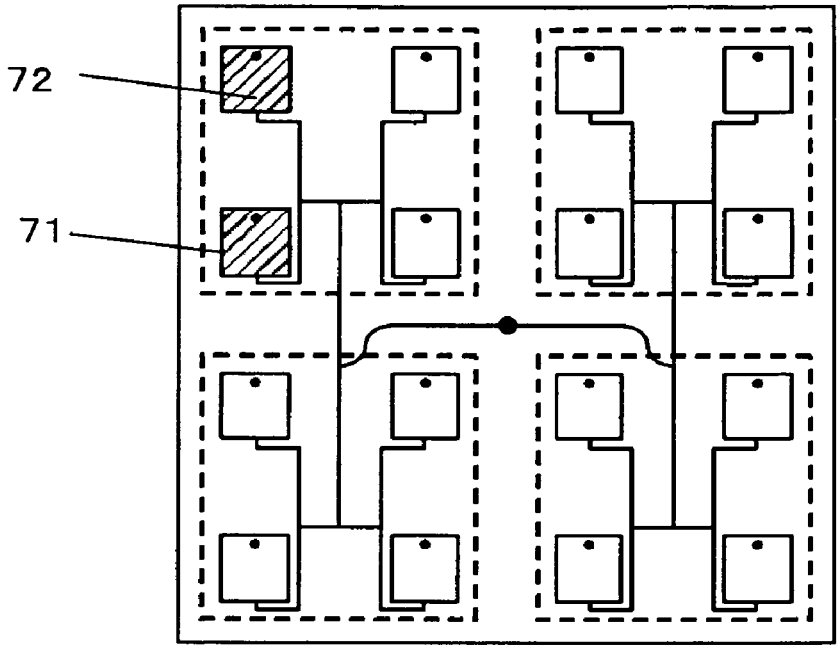
FIG. 54 is a plan view showing a method for adjusting the magnitude of the angle of inclination of the radio wave beam, with the microstrip antenna of FIG. 48.
Figure 55:
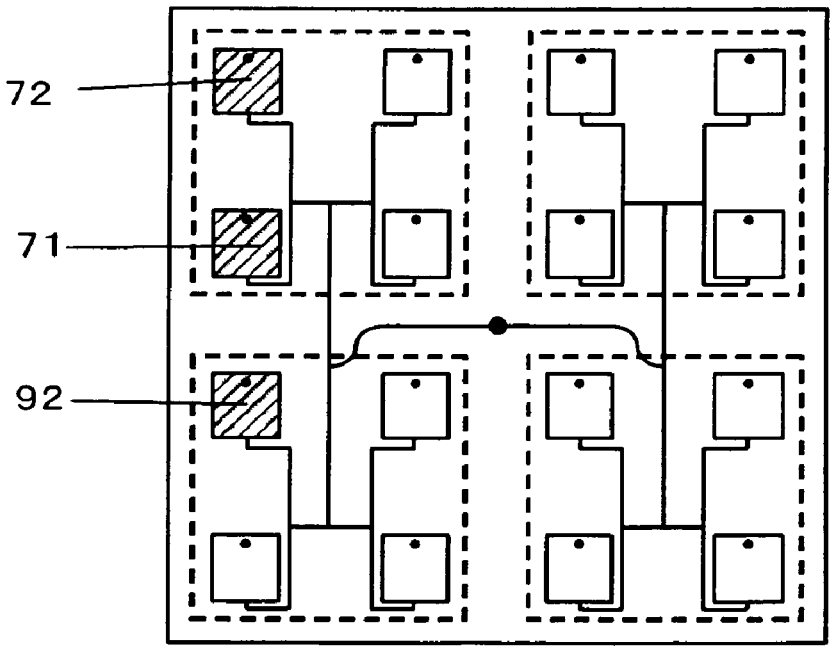
FIG. 55 is a plan view showing a method for adjusting the magnitude of the angle of inclination of the radio wave beam, with the microstrip antenna of FIG. 48.

FIGS. 53 through 55 show an example of a method of adjusting the magnitude of the angle of inclination of the radio wave beam with the microstrip antenna shown in FIG. 48. In FIGS. 53 through 55, the hatching on certain ones of those antenna electrodes means that the through holes which are connected to those antenna electrodes are ON, while the lack of hatching on others of those antenna electrodes means that the through holes which are connected to those antenna electrodes are OFF.

In the examples shown in FIGS. 53 through 55, the radio wave beam is inclined to the right side, in the same manner as in the example shown in FIG. 49; but the magnitudes of the angles of inclination are different, since the number of the antenna electrodes on which the through hole is turned ON is different. The number of antenna electrodes for which the through hole is turned ON is the minimum of one in the example of FIG. 53, is two in the example of FIG. 54, and is three in the example of FIG. 55, and in the example of FIG. 49 is the maximum of four; and the angle of inclination also becomes larger in accompaniment with this increase of the number of electrodes. It is possible to vary the magnitude of the angle of inclination by changing the number of antenna electrodes for which the through hole is turned ON in this manner.

Figure 57:
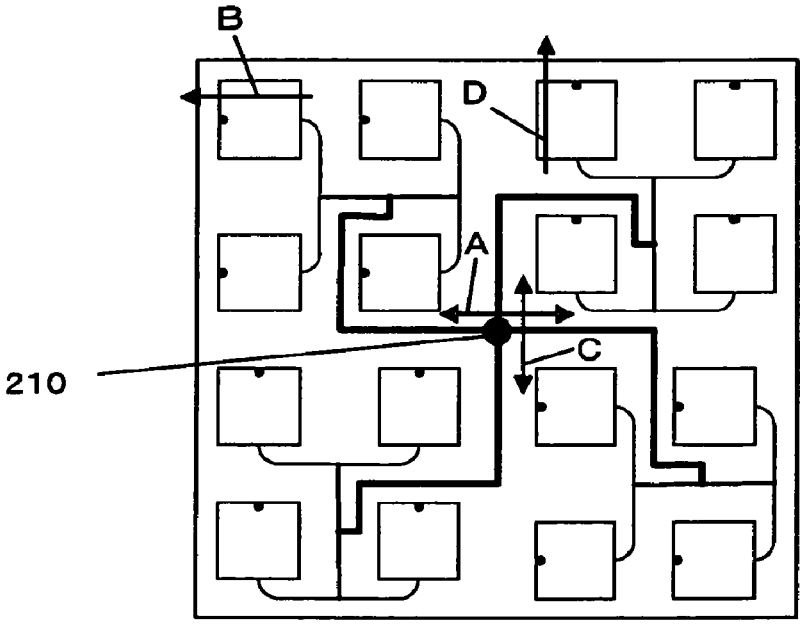
FIG. 57 is a plan view showing another variant embodiment of the microstrip antenna of FIG. 48.

As shown in FIG. 48, with a microstrip antenna of a structure in which a plurality of antenna electrodes are arranged upon the substrate 1, and the branching off direction at the root feed point 200 (the arrow sign A in FIG. 48) of the feed lines 10 which are fed from an oscillator (not shown in the figures) and the excitation direction of the antenna electrodes (the arrow sign B in FIG. 48) do not agree with one another (or a structure in which they agree with one another in two directions, as in the example of FIG. 57 which will be described hereinafter), i.e., with a microstrip antenna of a structure in which it is not arranged for the above described branching off direction and excitation direction to agree with one another in only one direction, by applying the method shown in the above described FIGS. 49 through 55, it is possible to scan the radio wave beam over a two dimensional range by wagging the direction of the radio wave beam upwards, downwards, leftwards, and rightwards through angles of various sizes.

Figure 56:
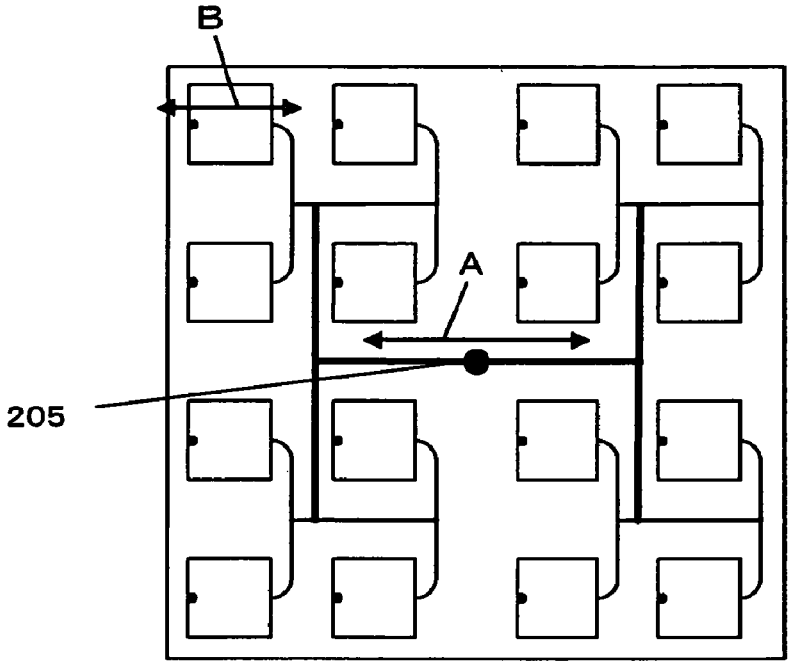
FIG. 56 is a plan view showing a variant embodiment of the microstrip antenna of FIG. 48.

It should be understood that, with the microstrip antennas shown in FIGS. 48 through 55, the number of electrode groups is four and the number of antenna electrodes which are included in each electrode group is also four, but this is only a feature of the shown example: the number of the electrode groups, and the number of antenna electrodes in each electrode group, may also be different from the ones described above. Furthermore, the pattern of arrangement of the electrodes may also be a different pattern from the ones shown in FIGS. 48 through 55; for example, they may also be arranged as shown in FIG. 56 or FIG. 57. Whichever arrangement is employed, by connecting a through hole to each one of the plurality of antenna electrodes, it is possible to employ a microstrip antenna in which it is made possible to turn each of those through holes ON and OFF with a switch. With a microstrip antenna of this type of structure, it is possible to incline the direction of the integrated radio wave beam in different directions, and also to vary the magnitude of its angle of inclination. By the way, with the arrangement of the antenna electrodes shown in FIG. 56, the branching off direction (the arrow sign A) of the feeds at the feed point 205 from the oscillator, and the excitation direction (the arrow sign B) of the antenna electrodes only agree with one another in one direction (the horizontal direction shown by the arrow signs A and B). In this type of case, according to experiments made by the present inventors, the direction of the integrated radio wave beam only inclines in the horizontal direction. However, it is possible to control the magnitude of the angle of inclination in the horizontal direction finely, since it changes depending upon the number of antennas for which the through holes are turned ON. On the other hand, with the arrangement of the antenna electrodes shown in FIG. 57, the branching off directions (the arrow sign A and the arrow sign C) of the feeds at the feed point 210, and the excitation directions (the arrow sign B and the arrow sign D) agree with one another in two directions (the horizontal direction shown by the arrow signs A and B, and the vertical direction shown by the arrow signs C and D), and accordingly it is not the case that they only agree with one another in one direction. In this type of case, according to experiments made by the present inventors, it is possible to incline the integrated radio wave beam both in the horizontal direction and in the vertical direction.

Figure 58:
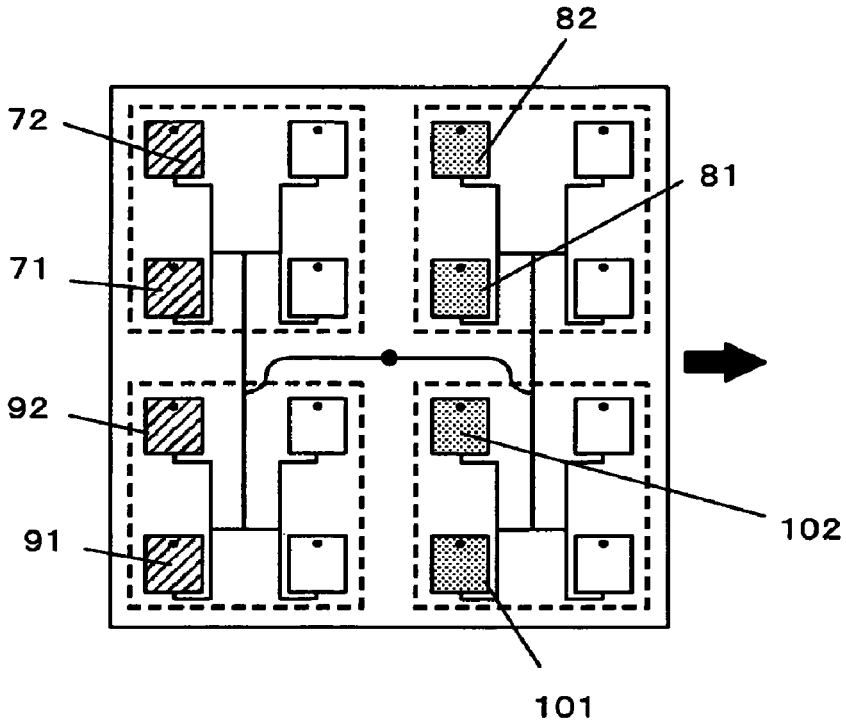
FIG. 58 is a plan view showing a method for improving the directivity of the radio wave beam, with the microstrip antenna of FIG. 48.
Figure 59:
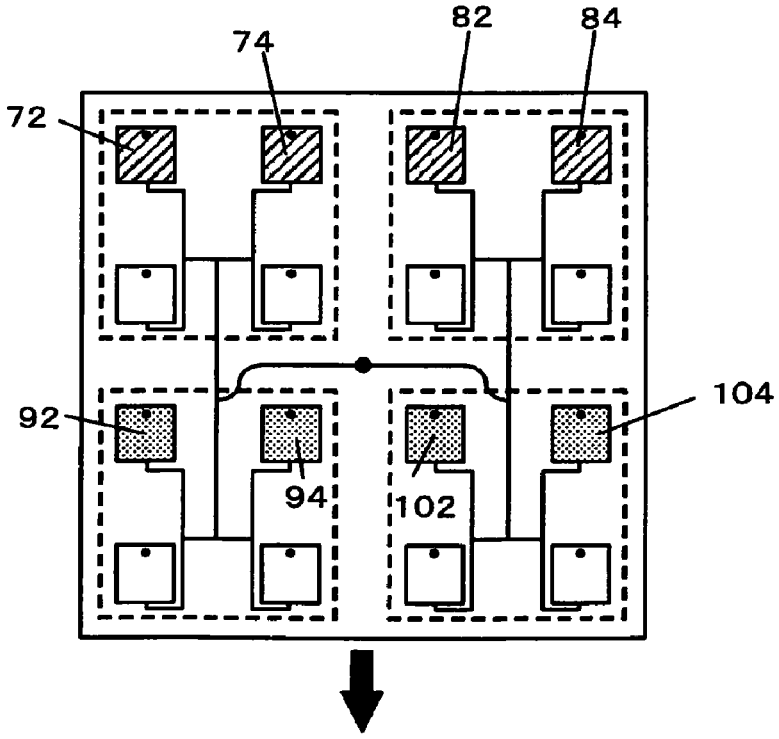
FIG. 59 is a plan view showing a method for improving the directivity of the radio wave beam, with the microstrip antenna of FIG. 48.

If the antenna electrodes shown in FIGS. 48 through 55 are employed, since the antenna electrodes 73, 81, 94, and 102 which are positioned at the inner side in each of the respective antenna electrode groups 70, 80, 90, and 100 are not required to be actuated with the objective of changing the direction of the radio wave beam, accordingly it is not necessary to provide any through holes or switches at these points, but it is effective to actuate these with the objective of narrowing down the angle of direction of the radio wave beam. For example if, as shown in FIG. 58, the radio wave direction is inclined to the right side in the figure, then the through holes of the antenna electrodes 71, 72, 91, and 92 on the left end are turned ON as described above; but if, in addition, the through holes of the antenna electrodes 81, 82, 101, and 102 which are on the inner side within each of the groups and moreover are on the left side are also turned ON, then the radiation angle of the integrated radio wave beam is squeezed down narrower (in other words, the directivity is enhanced). For the changing of the radiation angle from wide angle to narrow angle in this manner (i.e., for changing the directivity), it will be effective to change the number of the electrodes, among said four antenna electrodes on the inner side, for which the through holes are turned ON: the radiation angle becomes narrower, the more of them are turned ON. It should be understood that, for narrowing down the radiation angle of a radio wave beam which is inclined in the downward direction, the through holes of the antenna electrodes 92, 94, 102, and 104 within these groups which are on the inner side and moreover on the upper side should be turned ON, as shown in FIG. 59. And, with regard to other directions as well, it will be acceptable to apply the above description as a guide.

FIG. 60 shows variant embodiments for the structure of the electrodes, which may be employed with various ones of the antenna electrodes in the various embodiments described above.

Figure 60A:
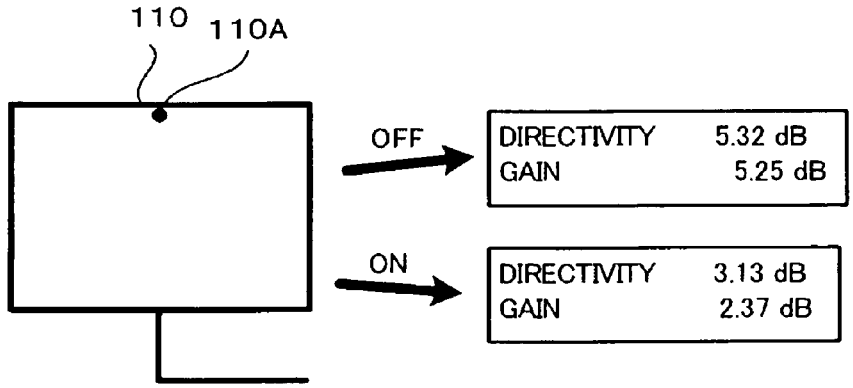
FIG. 60 is a plan view showing variant embodiments for the structure of the antenna electrodes.
Figure 60B:
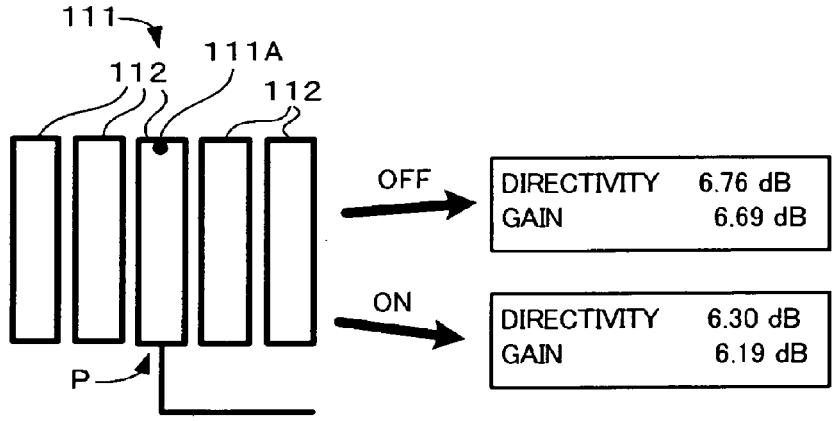
Figure 60C:
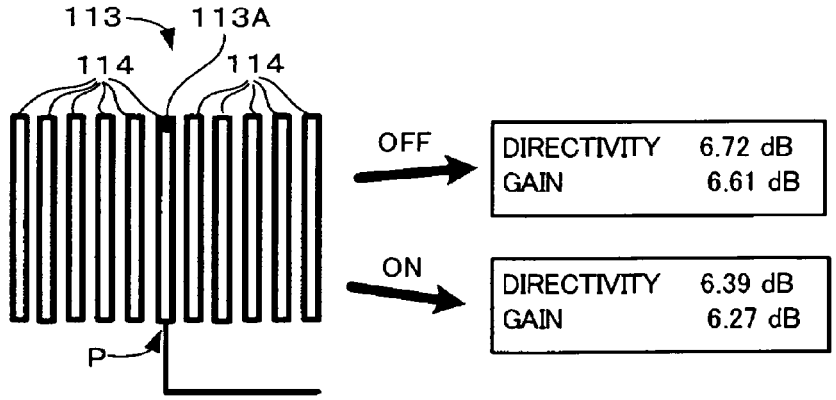

The antenna electrode 110 shown in FIG. 60A is one which consists of a single continuous conducting layer, and this structure may be employed for the various antenna electrodes of the various embodiments described above. And the antenna electrode 111 shown in FIG. 60B is divided into a plurality of stripe electrodes 112, 112 which extend in the direction from the feed point P towards their terminal edges. Moreover, the antenna electrode 113 shown in FIG. 60C is also divided into a plurality of stripe electrodes 114, 114 which extend in the direction from the feed point P towards their terminal edges, with their division being finer than in the case of the electrode 11 shown in FIG. 60B.

On the right sides of FIGS. 60A, B, and C, there are shown the directivity and the gain of the radio wave beam, when the antenna electrodes 110, 111, and 113 of the different structures shown in FIGS. 60A, B, and C are each connected to through holes (not shown in the figures) at ground contact points 110A, 11A, and 113A which are each provided at the same position, both for when the respective through hole is ON and for when it is OFF. As will be understood from this figure, the directivity and the gain of the radio wave beam are higher for the antenna electrode such as those of FIGS. 60B and 60C, in which the antenna electrode is divided into stripe electrodes, than for an antenna electrode like the one of FIG. 60A which is continuous. When the antenna electrode is divided up in this manner (or, to put it in another way, when one or more slits are inserted in the direction from the feed point P towards the terminal edge), then the directivity and the gain of the radio wave beam are improved. The reason is supposed to be because, since the electric field is concentrated at its end surface which is parallel to the feed direction, and almost no electric field is generated in the interior, accordingly, by inserting a slit in the antenna, the useless interior region is restricted, and the electric field which is generated at the central antenna exerts an influence upon the neighboring non-feed elements; and, since electrolysis is generated at both end portions of these non-feed elements, and a further influence is exerted upon the neighboring non-feed elements, accordingly the sum of the electric field intensities which are generated in the antenna electrode and the non-feed elements increases, and the radiant intensity is enhanced. Probably, in the various embodiments of the microstrip antenna described above, by applying the type of divided construction as in FIG. 60B or 60C to all of the antenna electrodes, or to some of the antenna electrodes included in those antenna electrodes which have ground contact points, it would be possible to improve the directivity and the gain of the radio wave beams radiated from those microstrip antennas; and, conversely, the magnitude of the angles of inclination of the radio wave beams produced due to the operation of the through holes would become smaller. Accordingly, although with a microstrip antenna in which this type of divided antenna electrode is used the angular range over which the radio wave beam could be wagged might not be very great, nevertheless it could be useful in various applications in which it is desired to project the radio wave beam quite far, such as for example in a radar for collision prevention for an automobile or the like.

Figure 61:
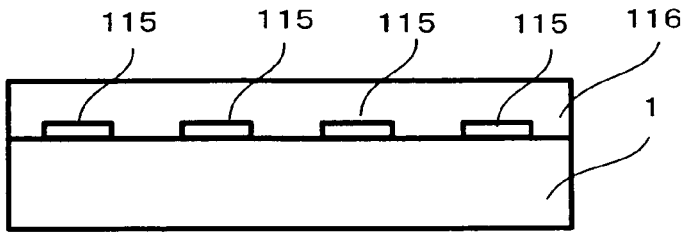
FIG. 61 is a sectional view showing a variant embodiment of the microstrip antenna, in which the antenna electrodes are covered with a dielectric.

FIG. 61 shows a variant embodiment of the structure of the substrate surface, which may be employed in the various embodiments described above.

Figure 62A:
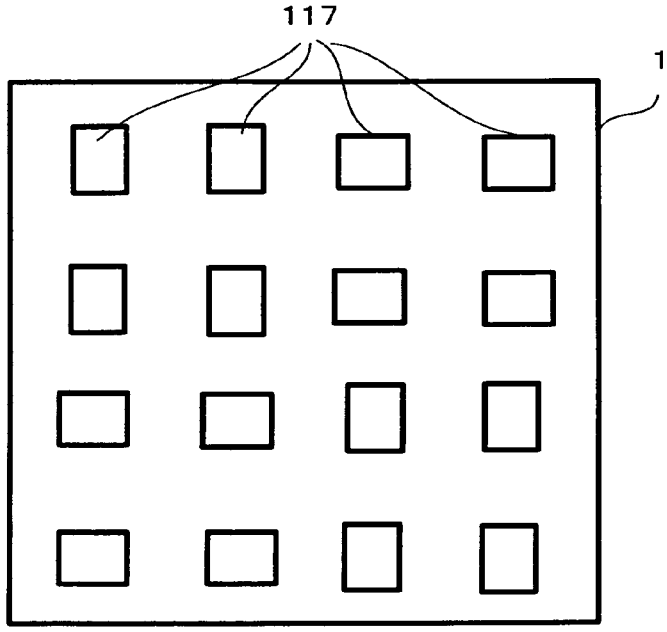
FIG. 62 is a plan view for explanation of the benefits of the improved integration of the antenna electrodes with the structure of FIG. 61.
Figure 62B:
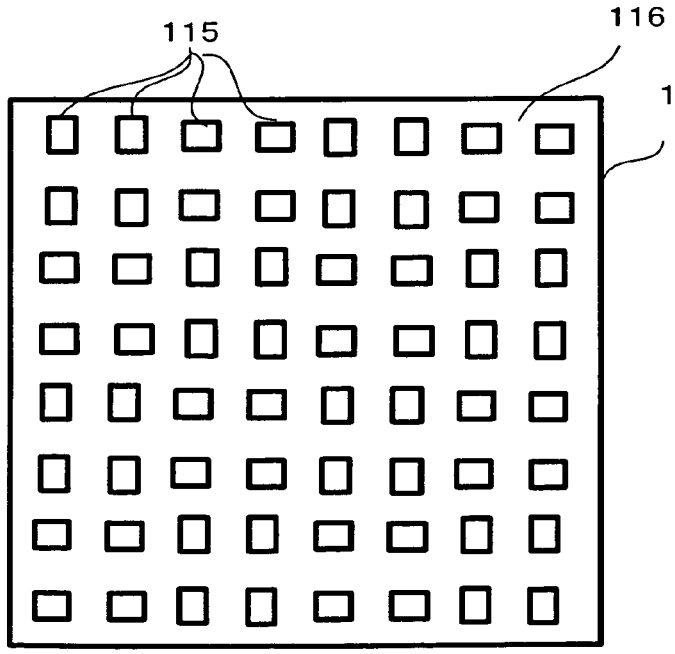
Figure 63A:
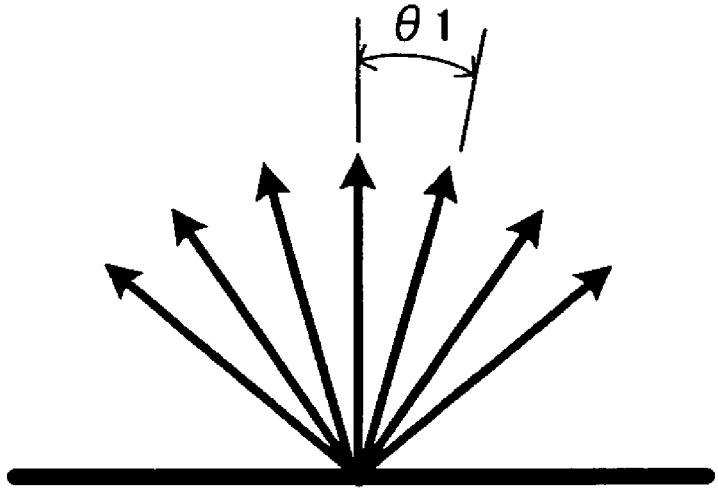
FIG. 63 is a figure for explanation of the beneficial effects in improvement of the resolution of change of the angle of inclination, due to the benefits of the improved integration of the antenna electrodes with the structure of FIG. 61.
Figure 63B:
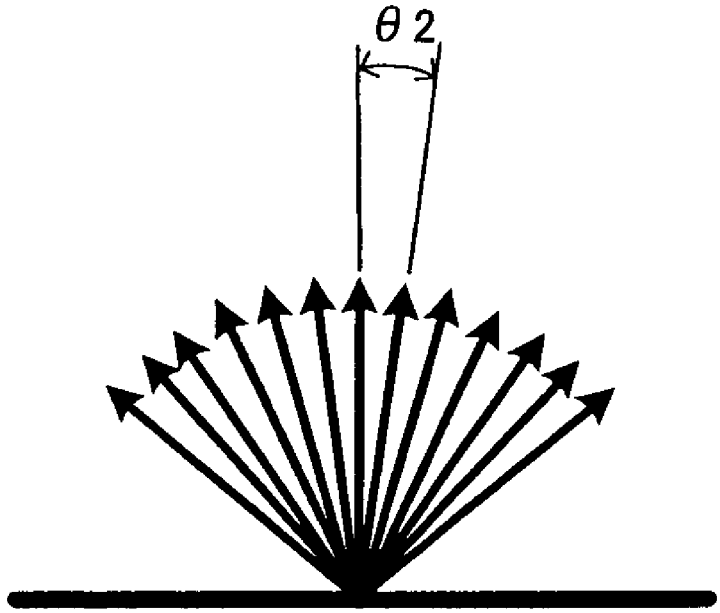

As shown in FIG. 61, upon the surface of the substrate 1, a dielectric film 116 is formed from a dielectric material which has a larger relative permittivity than the relative permittivity of the substrate 1, and this dielectric film 116 covers over the antenna electrodes 115, 115, . . . . The higher is the relative permittivity of this dielectric film 116, and the thicker this dielectric film is, the more is the wavelength of the microwave signals compressed at the antenna electrodes 115. As a result of this wavelength compression operation, the antenna electrodes can be made more compact, and it becomes possible to integrate them at higher density. In other words, by contrast to the case with the microstrip antenna shown in FIG. 62A in which it is arranged for the antenna electrode 117 to be in contact with air, which is of a size like that shown in the figure, with the microstrip antenna shown in FIG. 62B, since the antenna electrodes 115 are covered over by the above described dielectric film 116, accordingly the sizes and the gaps between the antenna electrodes 115 are shrunk to just the extent that the wavelength is compressed, and thus, even though the microstrip antenna may be of the same size and may have the same radiation efficiency for radio waves, the integration of the antenna electrodes is enhanced. As a result, by contrast to the case with the microstrip antenna of FIG. 62A in which the angular resolution with which it is possible to adjust the angle of inclination of the radio wave beam is a value like θ1 shown in FIG. 63A, with the microstrip antenna of FIG. 62B, the angular resolution is improved to a finer value θ2 as shown in FIG. 62, by just the amount that the integration is enhanced.

It should be understood that, the higher is the relative permittivity of the dielectric film 116, the higher is the above described wavelength compression beneficial effect. Due to this, the higher is the relative permittivity of the dielectric film 116, the thinner does the thickness of the dielectric film which is required for obtaining the same degree of wavelength compression beneficial effect become. Accordingly, if there is a demand for making the microstrip antenna of thinner form, it is desirable to utilize a dielectric material whose relative permittivity is high, and moreover, in this case, it is possible to anticipate a reduction of the manufacturing time for the dielectric film, so that it is also possible to reduce the manufacturing cost.

Figure 64:
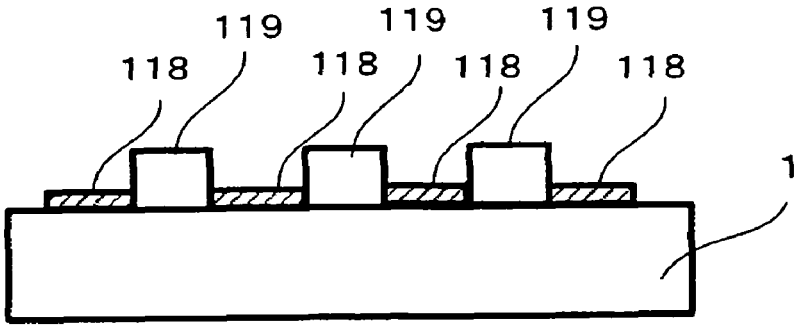
FIG. 64 is a sectional view showing a variant embodiment, in which a dielectric film is provided in the gaps between the antenna electrodes.

FIG. 64 shows another variant embodiment of the structure of the substrate surface, which may be employed in the various embodiments described above.

As shown in FIG. 64, dielectric films 119, 119, . . . which are made from a dielectric material whose relative permittivity is larger than the relative permittivity of the substrate 1 are provided upon the surface of the substrate 1 in the areas of the gaps between the antenna electrodes 118, 118, so as to touch the end portions of these antenna electrodes 118, 118, . . . . Accordingly, the antenna electrodes 118, 118, . . . are partitioned from one another by these dielectric films 119, 119, . . . . The electric field at the end portions of the antenna electrodes 118, 118, . . . exerts an influence upon the dielectric films 119, 119, . . . , so that the radiant intensity for emission of radio waves from the dielectric films 119, 119, . . . is enhanced. However, since the mutual interference between the antenna electrodes 118, 118 is restricted, the distance between the antenna electrodes 118, 118 effectively becomes in an extended state, and accordingly the tilt angle of the radio wave is restricted. Thus while, with a conventional antenna design, it is usual to insert a Wilkinson coupler at the branching off point in order to ensure that the antenna electrodes on one side, as seen from the branching off point of the feed lines, do not experience any influence of change of the impedance of the other antenna electrodes, by contrast, with the above described embodiment of the present invention, such a coupler is not desirable, since the mutual antenna interference is taken advantage of for inclining the beam.

Figure 65:
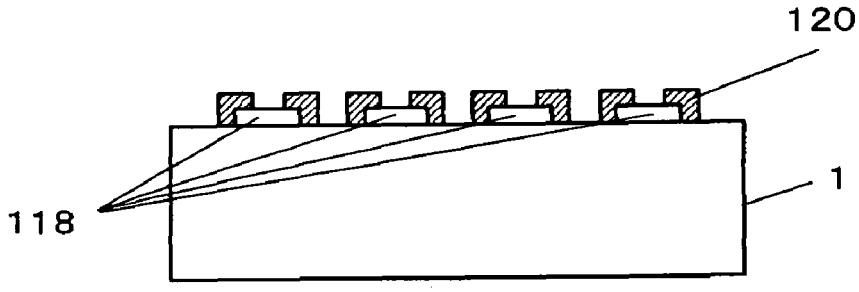
FIG. 65 is a sectional view showing a yet further variant embodiment of the structure of FIG. 64.

FIG. 65 shows a variant embodiment of the structure of FIG. 64.

In the structure of FIG. 65, dielectrics 120, 120, . . . are disposed in the neighborhood of the end portions of the antenna electrodes 118, 118, so as to contact these end portions. In the same manner as with the FIG. 64 structure, the electric field at the end portions of the antenna electrodes 118, 118 is excited with good efficiency at the dielectrics 120, 120, . . . , so that the intensity of radiation is enhanced.

Figure 66:
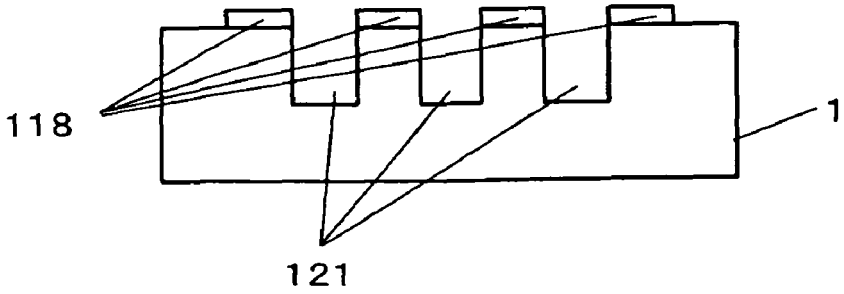
FIG. 66 is a sectional view showing a variant embodiment, in which cavities are provided in the gaps between the antenna electrodes.

FIG. 66 shows another variant embodiment.

With the structure of FIG. 66, cavity structures 121, 121, . . . are provided at portions of the substrate 1 between the antenna electrodes 118, 118. Since the mutual interference between the antenna electrodes 118, 118, . . . becomes stronger due to these cavity structures 121, 121, . . . , accordingly, although the radiant intensity decreases when the switches upon the through holes are turned OFF, it is possible to ensure the maximum intensity when the switches are ON. Since, as a result, the electric field intensity in the vertical direction with respect to the substrate and the electric field intensity when tilted become approximately equal, or the intensity during tilting becomes greater, accordingly, in an application in which the radio wave beam is used for body detection, the detection accuracy in the vertical direction with respect to the substrate 1 and the detection accuracy when tilted become equal, so that it is possible to supply an antenna device which is convenient for detecting a body in any direction.

Figure 67:
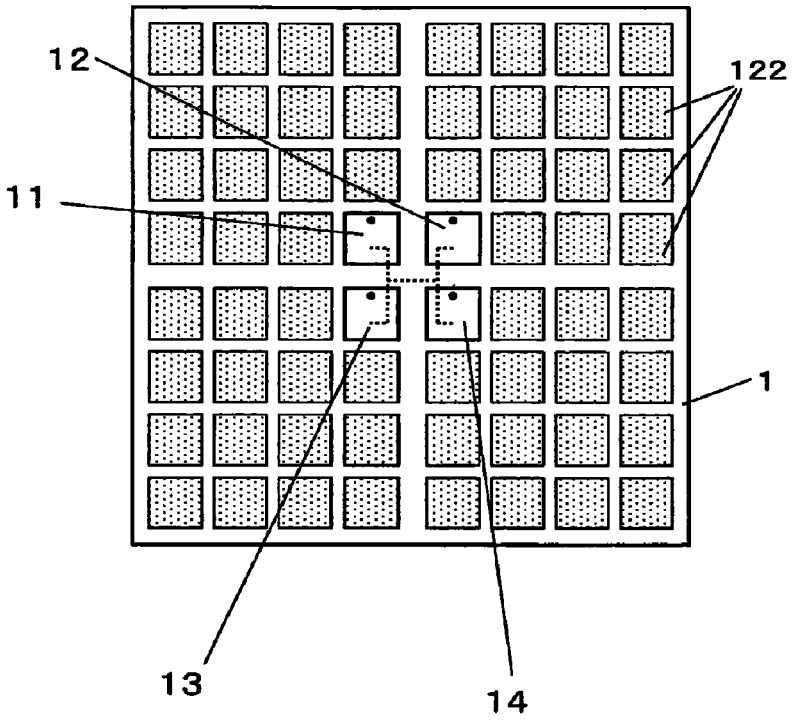
FIG. 67 is a plan view showing a microstrip antenna according to a twenty-fifth embodiment of the present invention.
Figure 68:
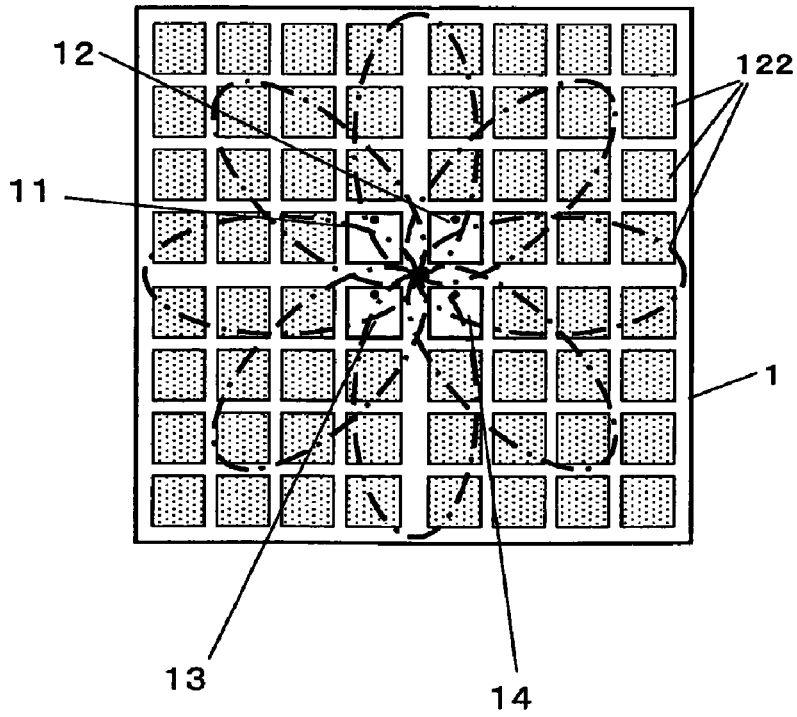
FIG. 68 is a plan view showing the operation of the microstrip antenna of FIG. 67.
Figure 69:
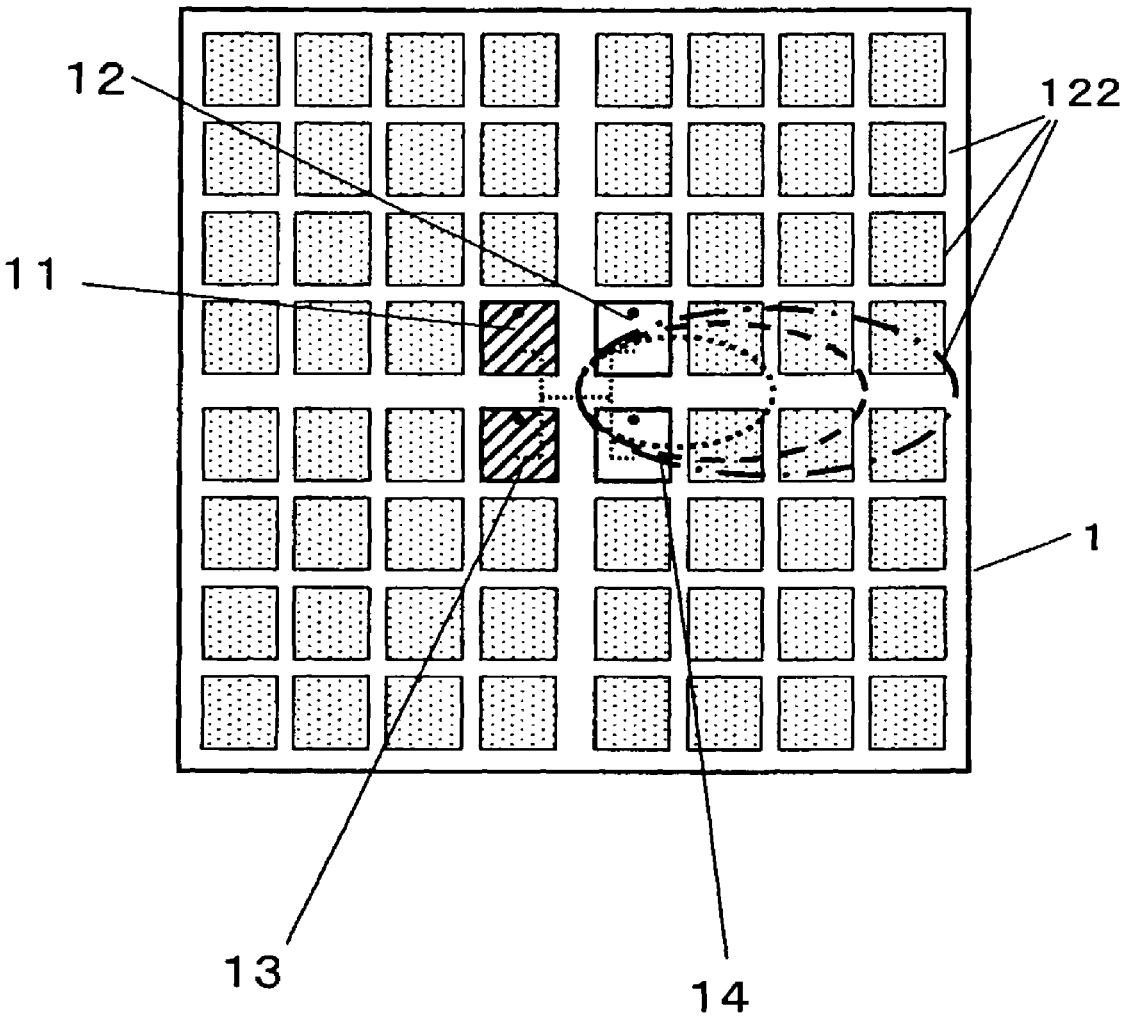
FIG. 69 is a plan view showing the operation of the microstrip antenna of FIG. 67.

FIGS. 67 through 69 show a microstrip antenna according to another embodiment.

With the microstrip antenna shown in FIG. 67, a large number of electrodes are provided upon the substrate 1, arranged as a two dimensional matrix. Among these electrodes, the central four electrodes 11, 12, 13, and 14 are antenna electrodes which receive a feed of high frequency, as for example in the structure shown in FIG. 10, and the large number of electrodes which are disposed in their neighborhood around them (the ones marked by hatching) are non-feed electrodes which receive no such feed. Through holes are provided to the antenna electrodes 11, 12, 13, and 14 as shown by black circles in the figure, and these through holes are coupled to a ground electrode (not shown in the figure) upon the rear surface of the substrate 1 via switches, for example FETs, which can control the amount of the high frequency electrical power which passes. The non-feed electrodes 122, 122, . . . have a beneficial operational effect of improving the directivity of the integrated radio wave beam which is emitted from the antenna electrodes 11, 12, 13, and 14 (in other words, they narrow and sharpen the beam). By adjusting the source/drain amount which passes through the above described FETs, it is possible to change the direction of the integrated radio wave beam in various manners. For example, as shown by the single dotted broken line in FIG. 68, it may be possible to change over the direction of the integrated radio wave beam in eight directions. Furthermore, as shown by the dotted line, the broken line, and the single dotted broken line in FIG. 69, it is possible to change the magnitude of the angle of inclination of the direction of the radio wave beam. Since, in this manner, the direction of the radio wave beam may be changed in multifarious ways, the number of switches (for example, FETs) which are required becomes low, such as four, which is low in cost.

Figure 70:
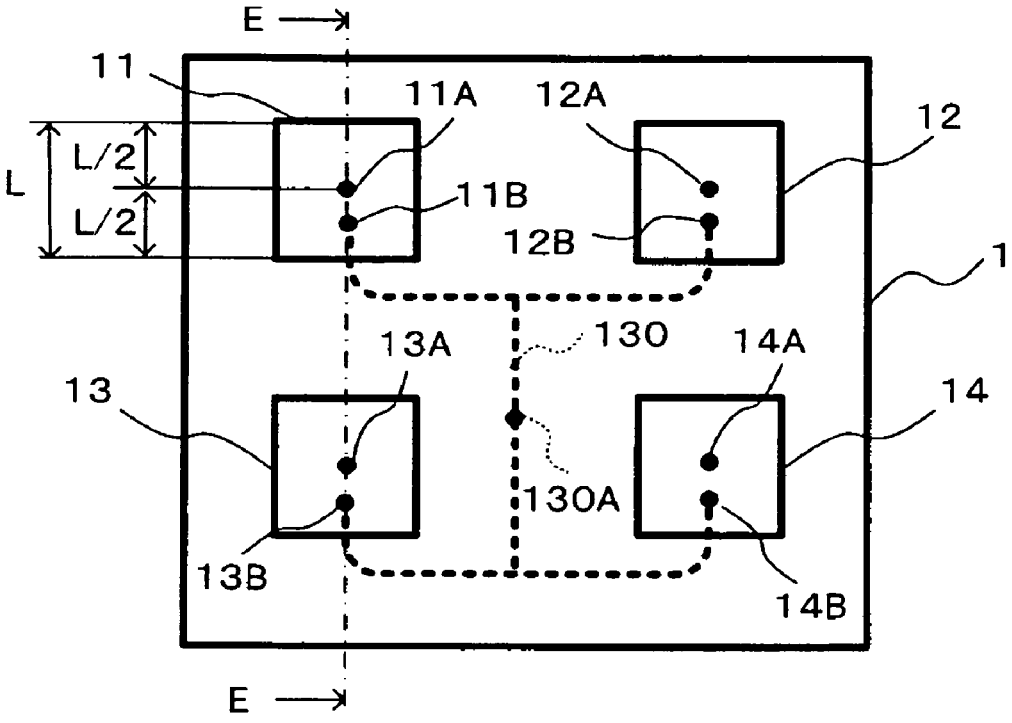
FIG. 70 is a plan view showing a microstrip antenna according to a twenty-sixth embodiment of the present invention.

FIG. 70 shows a plan view of the structure of a microstrip antenna according to yet another embodiment. And FIG. 70 is a sectional view of FIG. 70, taken along the line E-E.

Figure 71:
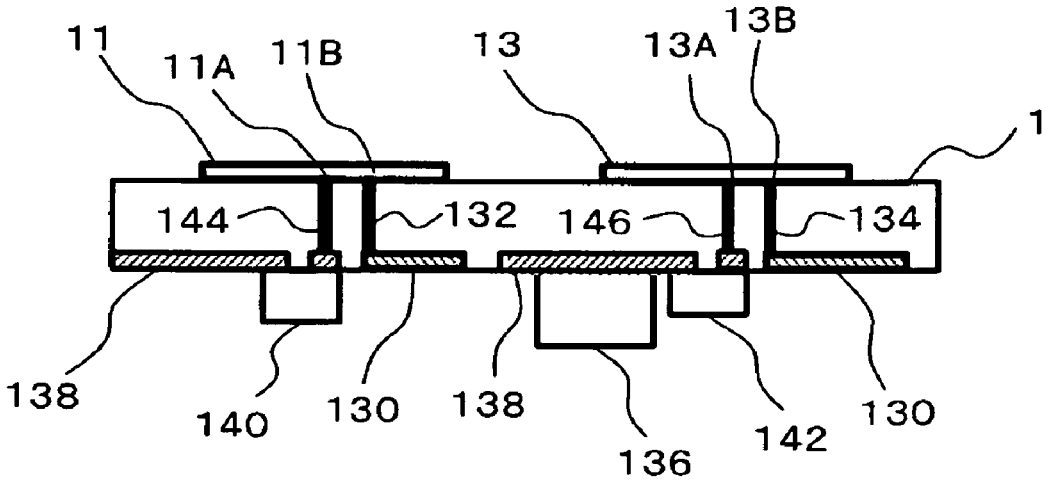
FIG. 71 is a sectional view of FIG. 70 in the plane E-E.

In the microstrip antenna of FIGS. 70 and 71, a feed line 130 for supplying high frequency to the antenna electrodes 11, 12, 13, and 14 are provided upon the rear surface of the substrate 1, i.e. on the opposite side to the antenna electrodes 11, 12, 13, and 14. As shown in FIG. 71, feed points 11B and 12B of the antenna electrodes 11 and 12 are connected via respective through holes 132 and 134 to the feed line 130, and, in the same manner, feed points 13B and 14B of the antenna electrodes 13 and 14 are connected via respective through holes (not shown in the figure) to the feed line 130. Furthermore, an oscillator circuit 136 is provided upon the rear surface of the substrate 1, and applies high frequency to the feed point 130A of the feed line 130. Moreover, on the rear surface of the substrate 1, there are provided switches 140, 144, . . . for connecting, to the ground electrode 138, through holes 144, 146, . . . which are connected to the ground contact points 11A, 12A, 13A, and 14A of the antenna electrodes 11, 12, 13, and 14. The length L in the various excitation directions of the antenna electrodes 11, 12, 13, and 14 (the upwards and downwards direction in FIG. 70) is approximately one half of the wavelength λg over the substrate 1 of the high frequency which is used.

As has already been explained with reference to FIG. 4, in the case of the microstrip antenna shown in FIG. 2, the ground contact point 2A is disposed at a position which is λg/4 (in other words, at L/2) in the excitation direction of the antenna electrode 2, so that it is not possible to incline the radio wave beam. However, this is not necessarily true for all of the microstrip antennas in this structure. For example, in the case of the microstrip antenna shown in FIGS. 70 and 71, it is possible to incline the radio wave beam by selectively connecting the ground contact points 11A, 12A, 13A, and 14A to ground, even though the ground contact points 11A, 12A, 13A, and 14A are disposed at λg/4 (in other words, at L/2) in the excitation direction of the antenna electrodes 11, 12, 13, and 14, as shown in FIG. 70. The reason may be that this is a structure in which the feed line 130 is provided upon the surface of the substrate 1 which is on the opposite side to the antenna electrodes 11, 12, 13, and 14, but this is not understood completely clearly. Anyway, in this manner, the arrangement of the ground contact points for inclining the radio wave beam is different, according to the structure of the microstrip antenna.

Figure 72A:
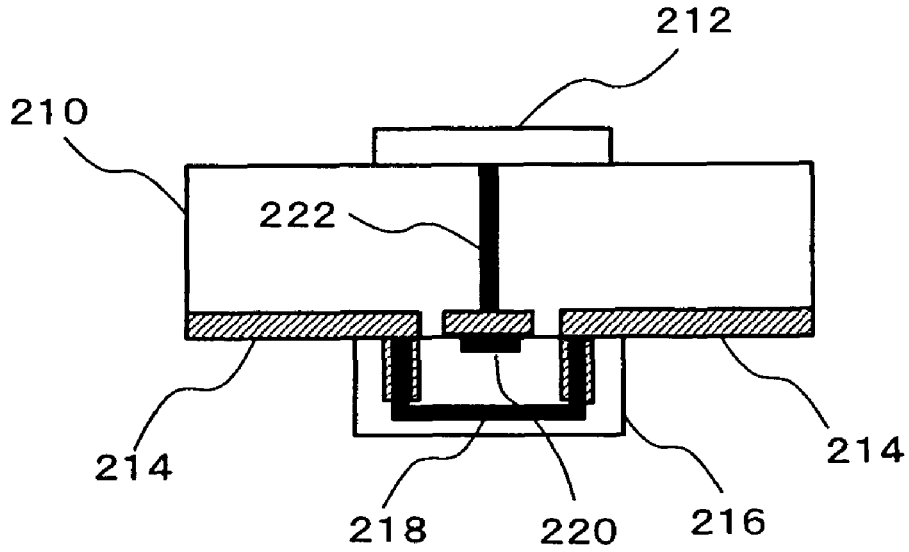
FIG. 72A is a sectional view showing the OFF state of a MEMS switch which has been applied for the purpose of controlling the inclination of a radio wave beam.
Figure 72B:
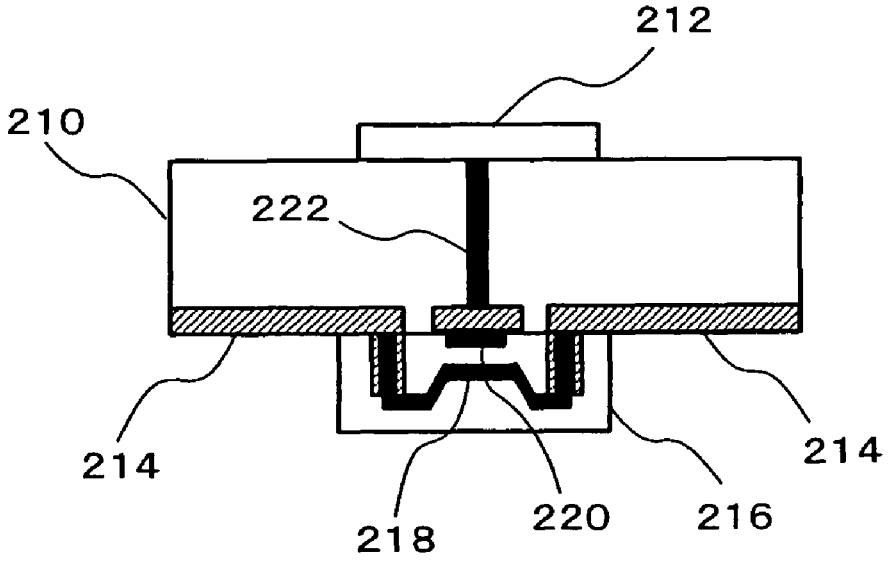
FIG. 72B is a sectional view showing the ON state of that MEMS switch.

FIGS. 72A and 72B show an example of a structure for a switch which may be employed, in the microstrip antennas of the various constructions described above, for turning the through holes ON and OFF The switch 216 which is shown in FIG. 72A and FIG. 72B is a switch (hereinafter termed a "MEMS switch") according to the MEMS (Micro Electro Mechanical System) technology for opening and closing between a through hole 222 which is connected to an antenna electrode 212 and a ground electrode 214. FIG. 72A shows the OFF state of this MEMS switch 216, while FIG. 72B shows its ON state. The point to which attention should be paid is that a fixed electrical contact point 220 and a movable electrical contact point 218 within the MEMS switch 216 are mechanically opened apart and do not contact one another, even in the ON state shown in FIG. 72B, although of course this is the case in the OFF state shown in FIG. 72A. In other words, in the ON state shown in FIG. 72B, there is still a small gap between the two electrical contact points 218 and 220, while, in the OFF state shown in FIG. 72A, this gap becomes much bigger. By employing a MEMS switch of this type of structure, it is possible to produce satisfactory ON states and OFF states in the high frequency bands such as 1 GHz~several hundreds of GHz. The theory of this will be explained with reference to FIGS. 73 through 74.

Figure 73A:
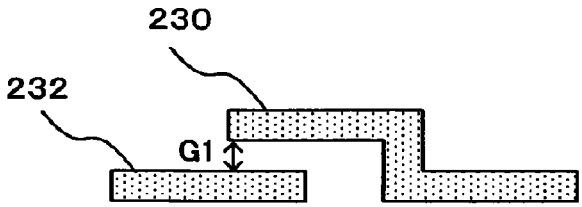
FIG. 73A is a sectional view showing the OFF state of the electrical contact points of a prior art type MEMS switch.
Figure 73B:
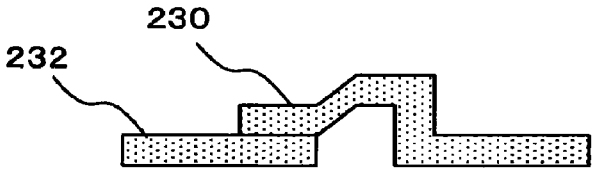
FIG. 73B is a sectional view showing the ON state of those electrical contact points.

FIG. 73A and FIG. 73B respectively show the nominal OFF state and the nominal ON state of the electrical contact points 230 and 232 of a prior art type MEMS switch. Furthermore, FIG. 74A and FIG. 74B respectively show the nominal OFF state and the nominal ON state of the electrical contact points 218 and 220 of the MEMS switch 216 shown in FIGS. 72A and 72B.

Figure 74A:
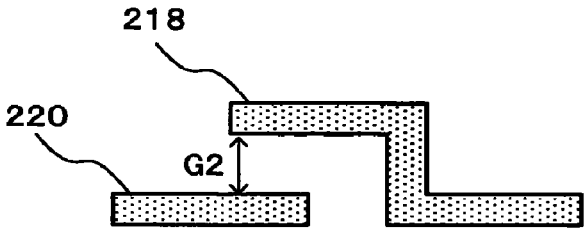
FIG. 74A is a sectional view showing the OFF state of the electrical contact points of the MEMS switch shown in FIG. 72.
Figure 74B:
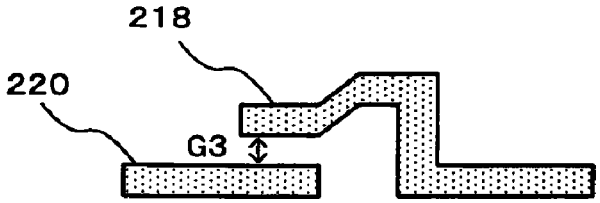
FIG. 74B is a sectional view showing the ON state of those electrical contact points.

As shown in FIGS. 73A and 73B, with a prior art type MEMS switch, in the nominal OFF state, the electrical contact points 230 and 232 are separated so that a slight gap G1 is opened between both of them, while, in the nominal ON state, they are mechanically contacted together. However, while with the slight gap G1 shown in FIG. 73A the switch is substantially in the OFF state in a low frequency band, it is substantially ON in a high frequency band. By contrast, with the MEMS switch 216 shown in FIG. 74A and FIG. 74B, in the nominal OFF state, the electrical contact points 218 and 220 are separated by a quite large gap G2, while, in the nominal ON state, they are separated by a slight gap G3. The quite large gap G2 which is present between the electrical contact points 218 and 220 as shown in FIG. 74A creates a substantially OFF state even in a high frequency band. Furthermore, even though the slight gap G3 between the electrical contact points 218 and 220 as shown in FIG. 74B is present, they are still in the substantially ON state in a high frequency band.

With the objective of controlling the inclination of the radio wave beam, it is more important for the switch to establish a state which is as close as possible to a true OFF state, rather than establishing a state which is as close as possible to a true ON state. The reason is because the sensitivity of change of the angle of inclination of the radio wave beam to change of the amount of transmission of high frequency through the through hole is larger, the smaller is the amount of transmission of high frequency through the through hole. Accordingly, the above described switch 216 which establishes a substantially OFF state at high frequency is suitable for application to the control of inclination of a radio wave beam.

Figure 75A:
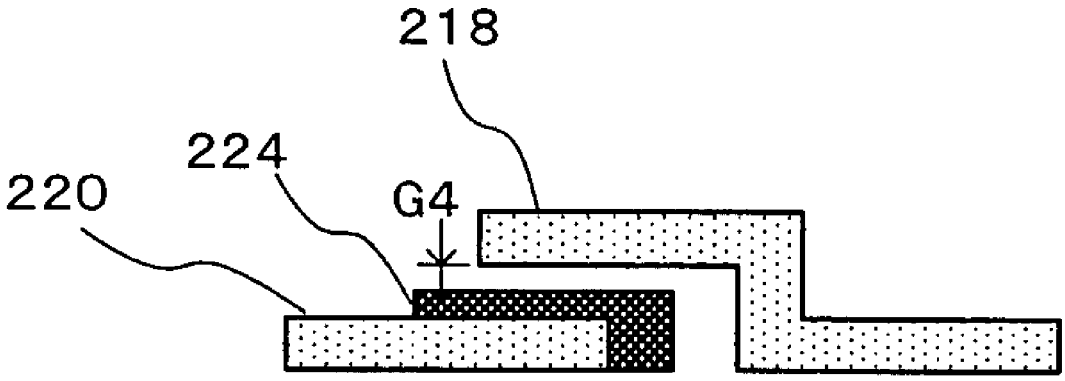
FIG. 75A is a sectional view showing the OFF state of the electrical contact points of a variant embodiment of a switch, which is applied for the purpose of controlling the inclination of a radio wave beam.
Figure 75B:
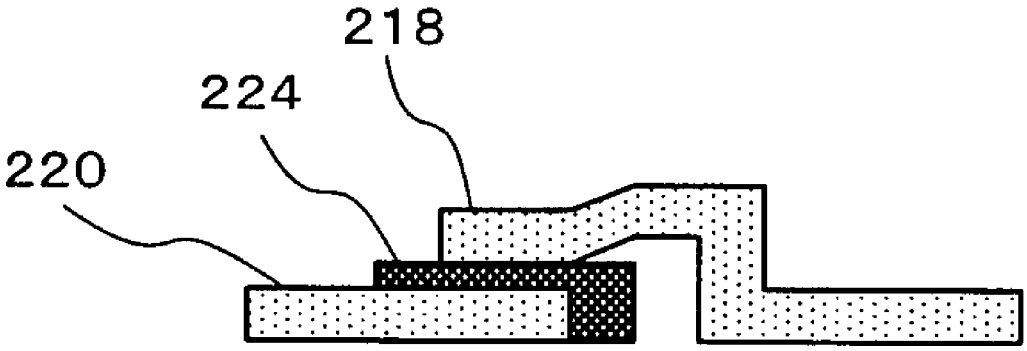
FIG. 75B is a sectional view showing the ON state of those electrical contact points.

FIGS. 75A and 75B show a variant embodiment of the electrical contact points of a switch which is applied to the purpose of controlling the inclination of the radio wave beam. FIG. 75A shows their OFF state, while FIG. 75B shows their ON state.

As shown in FIG. 75A and FIG. 75B, a thin film 214, such as a silicon oxide film made from a dielectric material or an insulating material, is provided between the electrical contact points 218 and 220. As shown in FIG. 75A, due to this thin insulating film 214, a substantially OFF state is produced for high frequencies, even though there is only the small gap G4 between the electrical contact points 218 and 220. In the state shown in FIG. 75B, by eliminating the gap G4 between the electrical contact points 218 and 220, a substantially ON state is produced for high frequencies, even though the thin insulating film 214 is present.

Although various embodiments of the present invention have been explained in the above, this embodiments are only given by way of example for explanation of the present invention, and the range of the present invention is not to be considered as being limited only to these embodiments. The present invention could be implemented as various other embodiments, provided that its gist is not departed from.

Moreover, it would be possible to apply the microstrip antenna according to the present invention as described above to a high frequency sensor for detecting a remote person or a body. In other words, this type of high frequency sensor may be made as a combination of: a transmission antenna which utilizes the microstrip antenna according to the present invention; a reception antenna, integral with the transmission antenna or consisting of a separate unit from the transmission antenna, for receiving from the body a reflected wave or a transmitted wave of the radio wave which has been outputted from this transmission antenna; and a processing circuit which receives and processes the electric signal from this reception antenna.

What is claimed is:

1. A microstrip antenna comprising:

an insulating substrate;

a plurality of antenna electrodes disposed upon one surface of said substrate, each having a feed point for application of a radio wave signal;

a ground electrode disposed upon the other side of, or in the interior of, said substrate, for supplying ground level; and a connection member that connects at least one antenna electrode among said plurality of antenna electrodes to said ground electrode, at least at one spot thereof which is different from said feed point of said at least one electrode, the connection member being configured such that at least one antenna electrode among the plurality of antenna electrodes is unconnected to said ground electrode;

wherein said connection member is disposed at a location within a plane region occupied by said at least one antenna electrode when said at least one antenna electrode is seen in plan view, such that a direction of an integrated radio wave beam which is emitted from said plurality of antenna electrodes is inclined from a direction normal to said substrate by connecting said at least one antenna electrode to said ground electrode at said location.

2. A microstrip antenna as described in claim 1, characterized in that:

said at least one spot of said at least one antenna electrode which is connected to said ground electrode is located at a position differing from a position which is separated from said feed point of said at least one antenna electrode in a direction to its terminal edge by just a distance which is an odd number of times the quarter wavelength of said high frequency signal.

3. A microstrip antenna as described in claim 1, characterized in that:

said connection member is an electrically conductive through hole which is pierced through at a spot of said substrate which corresponds to said at least one spot of said at least one antenna electrode, and has one end which is connected to said at least one spot of said at least one antenna electrode, and another end which is connected to said ground electrode.

4. A microstrip antenna as described in claim 1 or claim 2, characterized in that:

at least one edge of said at least one antenna electrode is disposed along at least one edge of said substrate; and said connection member is an electric conductor which is arranged upon a side surface of said at least one edge of said substrate, and has one end which is connected to said at least one spot of said at least one edge of said at least one antenna electrode, and another end which is connected to said ground electrode.

5. A microstrip antenna as described in claim 1, wherein:

said at least one spot of said at least one antenna electrode which is connected to said ground electrode is in the vicinity of a terminal edge of said at least one antenna electrode, the terminal edge being on a side opposite to said feed point.

6. A microstrip antenna as described in claim 1, wherein said connection member includes a switch which opens and closes the connection between said at least one antenna electrode and said ground electrode.

7. A microstrip antenna as described in claim 1, further comprising a feed line for supplying high frequency electrical power to said plurality of antenna electrodes, wherein said feed line is provided upon the other surface of said substrate, and is connected to said feed points of said plurality of antenna electrodes through electrically conductive through holes which are pierced through said substrate.

8. A microstrip antenna as described in claim 1, characterized by further comprising a feed line for supplying high frequency electrical power to said plurality of antenna electrodes, wherein said feed line has a root feed point which is connected to an oscillator circuit and located at approximately the center of the substrate, and branches off in both mutually opposite directions from said root feed point, and wherein the direction of branching off of said feed line from said root feed point, and the direction of excitation of each of the antenna electrodes, do not agree with one another in one direction.

9. A microstrip antenna as described in claim 1, characterized in that:

said plurality of antenna electrodes upon the one surface of said substrate are covered by a dielectric body which has a relative permittivity which is larger than the relative permittivity of said substrate.

10. A microstrip antenna as described in claim 1, characterized in that:

said at least one antenna electrode is divided into a plurality of stripe electrodes which extend in a direction from said feed point to a terminal edge.

11. A microstrip antenna as described in claim 1, further comprising a dielectric body which is arranged so as to contact an end of said antenna electrode.

12. A microstrip antenna as described in claim 1, further comprising a cavity structure arranged in the vicinity of said antenna electrode.

13. A microstrip antenna as described in claim 1, further comprising a non-feed electrode arranged in the vicinity of said antenna electrode.

14. A microstrip antenna comprising:

an insulating substrate;

a plurality of antenna electrodes disposed upon one surface of said substrate, each having a feed point for application of a radio wave signal;

a ground electrode disposed upon the other side of, or in the interior of, said substrate, for supplying ground level; and a connection member that selectively connects at least a first antenna electrode selected from among said plurality of antenna electrodes to said ground electrode, and leaves at least one second antenna electrode selected from among said plurality of antenna electrodes unconnected to said ground electrode, in response to one or more control signals, at least at one spot of the connection member being different from said feed point of said at least first antenna electrode;

wherein said connection member is disposed at a location within a plane region occupied by said at least first antenna electrode when said at least first antenna electrode is seen in plan view, such that a direction of an integrated radio wave beam which is emitted from said plurality of antenna electrodes is inclined from a direction normal to said substrate by connecting said at least first antenna electrode to said ground electrode at said location.

* * * * *